US009145797B2

(12) United States Patent
Price et al.

(10) Patent No.: US 9,145,797 B2
(45) Date of Patent: Sep. 29, 2015

(54) VARIABLE TRAVEL VALVE APPARATUS FOR AN INTERNAL COMBUSTION ENGINE

(71) Applicant: JP Scope, Inc., Mt. Juliet, TN (US)

(72) Inventors: Charles E. Price, Mt. Juliet, TN (US); Howard E. Moore, Seymour, IN (US); Kelly E. Stephenson, Columbus, IN (US)

(73) Assignee: JP Scope, Inc., Mt. Juliet, TN (US)

( * ) Notice: Subject to any disclaimer, the term of this patent is extended or adjusted under 35 U.S.C. 154(b) by 0 days.

(21) Appl. No.: 14/021,548

(22) Filed: Sep. 9, 2013

(65) Prior Publication Data

US 2014/0007829 A1 Jan. 9, 2014

Related U.S. Application Data

(63) Continuation of application No. 12/394,700, filed on Feb. 27, 2009, now Pat. No. 8,528,511, which is a continuation-in-part of application No. 12/329,964, filed on Dec. 8, 2008, now Pat. No. 7,874,271, which is a continuation of application No. 11/534,519, filed on Sep. 22, 2006, now Pat. No. 7,461,619.

(60) Provisional application No. 60/719,506, filed on Sep. 23, 2005, provisional application No. 60/780,364, filed on Mar. 9, 2006.

(51) Int. Cl.

| | |
|---|---|
| ***F01L 5/00*** | (2006.01) |
| ***F01L 1/34*** | (2006.01) |
| ***F01L 1/20*** | (2006.01) |
| ***F01L 7/08*** | (2006.01) |
| ***F01L 9/04*** | (2006.01) |
| ***F02B 33/22*** | (2006.01) |
| ***F02D 17/02*** | (2006.01) |
| *F01L 1/46* | (2006.01) |
| *F01L 1/053* | (2006.01) |

(52) U.S. Cl.

CPC ... *F01L 1/34* (2013.01); *F01L 1/20* (2013.01); *F01L 1/205* (2013.01); *F01L 7/08* (2013.01); *F01L 9/04* (2013.01); *F02B 33/22* (2013.01); *F02D 17/02* (2013.01); *F01L 1/462* (2013.01); *F01L 2001/0535* (2013.01); *F01L 2001/0537* (2013.01); *F01L 2101/00* (2013.01); *F01L 2101/02* (2013.01); *F01L 2820/01* (2013.01); *F01L 2820/02* (2013.01); *F01L 2820/031* (2013.01)

(58) Field of Classification Search

CPC ..... F01L 1/047; F01L 5/00; F02B 33/022; F02D 17/02

USPC ..... 123/81 R, 81 B, 81 D, 188.4, 88

See application file for complete search history.

(56) References Cited

U.S. PATENT DOCUMENTS

| | | | |
|---|---|---|---|
| 13,905 | A | 12/1855 | Gardiner |
| 1,123,986 | A | 1/1915 | Bowman et al. |

(Continued)

*Primary Examiner* — Lindsay Low
*Assistant Examiner* — Kevin Lathers
(74) *Attorney, Agent, or Firm* — Cooley LLP

(57) ABSTRACT

An apparatus includes a valve and an actuator. The valve has a portion movably disposed within a valve pocket defined by a cylinder head of an engine. The valve is configured to move relative to the cylinder head a distance between a closed position and an opened position. The portion of the valve defines a flow opening that is in fluid communication with a cylinder of an engine when the valve is in the opened position. The actuator is configured to selectively vary the distance between the closed position and the opened position.

5 Claims, 46 Drawing Sheets

(56) References Cited

U.S. PATENT DOCUMENTS

| | | | | | |
|---|---|---|---|---|---|
| 1,161,223 | A | | 11/1915 | Koken et al. | |
| 1,161,224 | A | | 11/1915 | Koken et al. | |
| 1,273,002 | A | | 7/1918 | Samuels | |
| 1,303,748 | A | | 5/1919 | Wattel | |
| 1,537,248 | A | | 5/1925 | Maloney | |
| 1,599,430 | A | | 9/1926 | Ofeldt | |
| 1,612,550 | A | | 12/1926 | Tom | |
| 1,618,687 | A | | 2/1927 | Swanstrom | |
| RE16,814 | E | | 12/1927 | Farmer et al. | |
| 1,818,527 | A | | 8/1931 | Becker | |
| 1,835,971 | A | | 12/1931 | Schattanek | |
| 1,877,760 | A | | 9/1932 | Berner et al. | |
| 1,922,678 | A | | 8/1933 | Hallett | |
| 2,201,292 | A | | 5/1940 | Hickey | |
| 2,244,706 | A | | 6/1941 | Irving | |
| 2,296,081 | A | | 9/1942 | Aspin | |
| 2,302,442 | A | | 11/1942 | Hickey | |
| 2,364,040 | A | | 11/1944 | Grube | |
| 2,409,350 | A | * | 10/1946 | Forrest | 123/188.4 |
| 2,741,931 | A | | 4/1956 | Sills | |
| 2,770,140 | A | | 11/1956 | Palumbo | |
| 3,198,181 | A | | 8/1965 | Dolphin | |
| 3,633,869 | A | | 1/1972 | Lehmann | |
| 3,788,597 | A | | 1/1974 | Ichioka | |
| 3,882,833 | A | | 5/1975 | Longstaff et al. | |
| 3,896,781 | A | | 7/1975 | Smith | |
| 4,333,427 | A | | 6/1982 | Burillo et al. | |
| 4,342,294 | A | | 8/1982 | Hopkins | |
| 4,363,302 | A | | 12/1982 | Pischinger | |
| 4,455,543 | A | | 6/1984 | Pischinger et al. | |
| 4,614,170 | A | | 9/1986 | Pischinger et al. | |
| 4,700,684 | A | | 10/1987 | Pischinger et al. | |
| 4,722,315 | A | | 2/1988 | Pickel | |
| 4,765,287 | A | | 8/1988 | Taylor et al. | |
| 4,777,915 | A | * | 10/1988 | Bonvallet | 123/90.11 |
| 4,815,421 | A | | 3/1989 | Paul et al. | |
| 4,911,115 | A | | 3/1990 | Boyesen | |
| 4,976,227 | A | | 12/1990 | Draper | |
| 5,070,826 | A | | 12/1991 | Kawamura | |
| 5,074,259 | A | | 12/1991 | Pusic | |
| 5,076,221 | A | | 12/1991 | Kawamura | |
| 5,124,598 | A | | 6/1992 | Kawamura | |
| 5,203,830 | A | | 4/1993 | Faletti et al. | |
| 5,275,337 | A | * | 1/1994 | Kolarik et al. | 239/91 |
| 5,289,802 | A | | 3/1994 | Paquette et al. | |
| 5,329,897 | A | | 7/1994 | Hemphill et al. | |
| 5,333,582 | A | | 8/1994 | Kawamura | |
| 5,398,647 | A | | 3/1995 | Rivera | |
| 5,417,403 | A | | 5/1995 | Shurman et al. | |
| 5,515,818 | A | | 5/1996 | Born | |
| 5,542,385 | A | | 8/1996 | Kim | |
| 5,558,049 | A | | 9/1996 | Dubose | |
| 5,596,966 | A | | 1/1997 | Elder | |
| 5,603,292 | A | | 2/1997 | Hakansson | |
| 5,647,311 | A | | 7/1997 | Liang et al. | |
| 5,655,494 | A | | 8/1997 | Donaldson, Jr. | |
| 5,694,890 | A | | 12/1997 | Yazdi | |
| 5,740,769 | A | | 4/1998 | Mori | |
| 5,839,400 | A | | 11/1998 | Vattaneo et al. | |
| 5,878,707 | A | | 3/1999 | Ballard | |
| 5,967,108 | A | | 10/1999 | Kutlucinar | |
| 6,065,432 | A | | 5/2000 | Zakharov et al. | |
| 6,105,542 | A | | 8/2000 | Efford | |
| 6,205,850 | B1 | | 3/2001 | Wehrman et al. | |
| 6,222,294 | B1 | | 4/2001 | Stacy et al. | |
| 6,257,191 | B1 | | 7/2001 | Kutlucinar | |
| 6,340,010 | B1 | | 1/2002 | Hara et al. | |
| 6,382,193 | B1 | | 5/2002 | Boyer et al. | |
| 6,443,116 | B1 | | 9/2002 | Dahlborg | |
| 6,546,347 | B2 | | 4/2003 | Batchelor et al. | |
| 6,644,255 | B1 | | 11/2003 | Henry | |
| 6,666,197 | B2 | | 12/2003 | Bayer | |
| 6,672,270 | B2 | * | 1/2004 | Armer | 123/188.4 |
| 6,763,790 | B2 | | 7/2004 | Watson et al. | |
| 6,827,067 | B1 | | 12/2004 | Yang et al. | |
| 6,957,635 | B2 | | 10/2005 | Katayana | |
| 6,968,819 | B2 | | 11/2005 | Fujii et al. | |
| 7,128,062 | B2 | | 10/2006 | Kuo et al. | |
| 7,159,556 | B2 | | 1/2007 | Yoshihara | |
| 7,249,597 | B2 | | 7/2007 | Muller et al. | |
| 7,263,963 | B2 | | 9/2007 | Price | |
| 7,373,909 | B2 | | 5/2008 | Price | |
| 7,448,352 | B2 | | 11/2008 | Warren | |
| 7,448,354 | B2 | | 11/2008 | Price | |
| 7,461,619 | B2 | | 12/2008 | Price | |
| 2001/0020693 | A1 | | 9/2001 | Bischofberger et al. | |
| 2002/0124822 | A1 | | 9/2002 | Cornell et al. | |
| 2003/0145838 | A1 | | 8/2003 | Leman et al. | |
| 2003/0196646 | A1 | | 10/2003 | Shoyama et al. | |
| 2004/0154597 | A1 | | 8/2004 | Kashima et al. | |
| 2005/0076890 | A1 | | 4/2005 | Seitz et al. | |
| 2005/0131618 | A1 | | 6/2005 | Megli et al. | |
| 2005/0205028 | A1 | | 9/2005 | Lewis et al. | |
| 2005/0268880 | A1 | | 12/2005 | Bidner et al. | |
| 2005/0274337 | A1 | | 12/2005 | Chang | |
| 2006/0118087 | A1 | | 6/2006 | Lewis et al. | |
| 2006/0130792 | A1 | | 6/2006 | Katou et al. | |
| 2007/0067988 | A1 | | 3/2007 | Price | |
| 2007/0068470 | A1 | | 3/2007 | Price | |
| 2007/0068471 | A1 | | 3/2007 | Price | |
| 2007/0068494 | A1 | | 3/2007 | Price | |
| 2008/0017161 | A1 | | 1/2008 | Price | |

* cited by examiner 6414 6410 6412

| | 0 | 700 | 1000 | 1500 | 1800 | 2100 | 2400 | 3000 | 4000 | 5000 | 6000 | 7000 | 8000 | 9000 |
|---|---|---|---|---|---|---|---|---|---|---|---|---|---|---|
| 0 | 30 | 30 | 30 | 30 | 40 | 40 | 40 | 50 | 60 | 60 | 70 | 80 | 90 | 90 |
| 25 | 30 | 30 | 30 | 30 | 40 | 40 | 40 | 50 | 60 | 60 | 70 | 80 | 90 | 90 |
| 50 | 30 | 30 | 30 | 30 | 40 | 40 | 40 | 50 | 60 | 60 | 70 | 80 | 90 | 90 |
| 75 | 35 | 35 | 37 | 40 | 43 | 47 | 50 | 55 | 60 | 65 | 70 | 80 | 90 | 95 |
| 100 | 37 | 37 | 39 | 42 | 45 | 49 | 52 | 57 | 62 | 67 | 70 | 80 | 90 | 95 |
| 125 | 41 | 41 | 41 | 44 | 47 | 51 | 54 | 59 | 64 | 69 | 70 | 80 | 90 | 95 |
| 150 | 43 | 43 | 43 | 46 | 49 | 53 | 56 | 61 | 66 | 71 | 75 | 80 | 90 | 95 |
| 175 | 45 | 45 | 45 | 48 | 51 | 55 | 58 | 63 | 68 | 73 | 75 | 80 | 90 | 95 |
| 200 | 47 | 47 | 47 | 50 | 53 | 57 | 60 | 65 | 70 | 75 | 78 | 80 | 90 | 95 |
| 225 | 50 | 50 | 50 | 52 | 55 | 59 | 62 | 65 | 70 | 75 | 78 | 80 | 90 | 95 |
| 250 | 50 | 50 | 50 | 52 | 55 | 59 | 62 | 65 | 70 | 75 | 78 | 80 | 90 | 95 |
| 275 | 50 | 50 | 50 | 52 | 55 | 59 | 62 | 65 | 70 | 75 | 78 | 80 | 90 | 95 |
| 300 | 50 | 50 | 50 | 52 | 55 | 59 | 62 | 65 | 70 | 75 | 78 | 80 | 90 | 95 |

6416

6420

6422

6424

| | 0 | 700 | 1000 | 1500 | 1800 | 2100 | 2400 | 3000 | 4000 | 5000 | 6000 | 7000 | 8000 | 9000 |
|---|---|---|---|---|---|---|---|---|---|---|---|---|---|---|
| 0 | 330 | 330 | 330 | 330 | 330 | 330 | 330 | 330 | 330 | 330 | 330 | 330 | 330 | 330 |
| 25 | 330 | 330 | 330 | 330 | 330 | 330 | 330 | 330 | 330 | 330 | 330 | 330 | 330 | 330 |
| 50 | 330 | 330 | 330 | 330 | 330 | 330 | 330 | 330 | 330 | 330 | 330 | 330 | 330 | 330 |
| 75 | 330 | 330 | 330 | 330 | 330 | 330 | 330 | 330 | 330 | 330 | 330 | 330 | 330 | 330 |
| 100 | 330 | 330 | 330 | 330 | 330 | 330 | 330 | 330 | 330 | 330 | 330 | 330 | 330 | 330 |
| 125 | 330 | 330 | 330 | 330 | 330 | 330 | 330 | 330 | 330 | 330 | 330 | 330 | 330 | 330 |
| 150 | 330 | 330 | 330 | 330 | 330 | 330 | 330 | 330 | 330 | 330 | 330 | 330 | 330 | 330 |
| 175 | 330 | 330 | 330 | 330 | 330 | 330 | 330 | 330 | 330 | 330 | 330 | 330 | 330 | 330 |
| 200 | 330 | 330 | 330 | 330 | 330 | 330 | 330 | 330 | 330 | 330 | 330 | 330 | 330 | 330 |
| 225 | 330 | 330 | 330 | 330 | 330 | 330 | 330 | 330 | 330 | 330 | 330 | 330 | 330 | 330 |
| 250 | 330 | 330 | 330 | 330 | 330 | 330 | 330 | 330 | 330 | 330 | 330 | 330 | 330 | 330 |
| 275 | 330 | 330 | 330 | 330 | 330 | 330 | 330 | 330 | 330 | 330 | 330 | 330 | 330 | 330 |
| 300 | 330 | 330 | 330 | 330 | 330 | 330 | 330 | 330 | 330 | 330 | 330 | 330 | 330 | 330 |

6426

FIG.67

6434

6430

6432

| | 0 | 700 | 1000 | 1500 | 1800 | 2100 | 2400 | 3000 | 4000 | 5000 | 6000 | 7000 | 8000 | 9000 |
|---|---|---|---|---|---|---|---|---|---|---|---|---|---|---|
| 0 | 510 | 510 | 510 | 510 | 510 | 510 | 510 | 510 | 510 | 510 | 510 | 510 | 510 | 510 |
| 25 | 510 | 510 | 510 | 510 | 510 | 510 | 510 | 510 | 510 | 510 | 510 | 510 | 510 | 510 |
| 50 | 510 | 510 | 510 | 510 | 510 | 510 | 510 | 510 | 510 | 510 | 510 | 510 | 510 | 510 |
| 75 | 510 | 510 | 510 | 510 | 510 | 510 | 510 | 510 | 510 | 510 | 510 | 510 | 510 | 510 |
| 100 | 510 | 510 | 510 | 510 | 510 | 510 | 510 | 510 | 510 | 510 | 510 | 510 | 510 | 510 |
| 125 | 510 | 510 | 510 | 510 | 510 | 510 | 510 | 510 | 510 | 510 | 510 | 510 | 510 | 510 |
| 150 | 510 | 510 | 510 | 510 | 510 | 510 | 510 | 510 | 510 | 510 | 510 | 510 | 510 | 510 |
| 175 | 510 | 510 | 510 | 510 | 510 | 510 | 510 | 510 | 510 | 510 | 510 | 510 | 510 | 510 |
| 200 | 510 | 510 | 510 | 510 | 510 | 510 | 510 | 510 | 510 | 510 | 510 | 510 | 510 | 510 |
| 225 | 510 | 510 | 510 | 510 | 510 | 510 | 510 | 510 | 510 | 510 | 510 | 510 | 510 | 510 |
| 250 | 510 | 510 | 510 | 510 | 510 | 510 | 510 | 510 | 510 | 510 | 510 | 510 | 510 | 510 |
| 275 | 510 | 510 | 510 | 510 | 510 | 510 | 510 | 510 | 510 | 510 | 510 | 510 | 510 | 510 |
| 300 | 510 | 510 | 510 | 510 | 510 | 510 | 510 | 510 | 510 | 510 | 510 | 510 | 510 | 510 |

6436

FIG.68

VARIABLE TRAVEL VALVE APPARATUS FOR AN INTERNAL COMBUSTION ENGINE

CROSS-REFERENCE TO RELATED APPLICATIONS

This application is a continuation of U.S. patent application Ser. No. 12/394,700 entitled "Variable Travel Valve Apparatus for an Internal Combustion Engine", filed on Feb. 27, 2009, which is a continuation-in-part of U.S. Pat. No. 7,874,271 entitled "Valve Apparatus for an Internal Combustion Engine," and filed Dec. 8, 2008, which is a continuation of U.S. Pat. No. 7,461,619 entitled "Valve Apparatus for an Internal Combustion Engine," and filed Sep. 22, 2006, which claims priority to U.S. Provisional Application Ser. No. 60/719,506 entitled "Side Cam Open Port," filed Sep. 23, 2005 and U.S. Provisional Application Ser. No. 60/780,364 entitled "Side Cam Open Port Engine with Improved Head Valve," filed Mar. 9, 2006; each of which is incorporated herein by reference in its entirety.

This application is related to copending U.S. patent application Ser. No. 11/534,508 entitled "Valve Apparatus for an Internal Combustion Engine," filed on Sep. 22, 2006, which is incorporated herein by reference in its entirety.

BACKGROUND

The embodiments described herein relate to an apparatus for controlling gas exchange processes in a fluid processing machine, and more particularly to a valve and cylinder head assembly for an internal combustion engine.

Many fluid processing machines, such as, for example, internal combustion engines, compressors, and the like, require accurate and efficient gas exchange processes to ensure optimal performance. For example, during the intake stroke of an internal combustion engine, a predetermined amount of air and fuel must be supplied to the combustion chamber at a predetermined time in the operating cycle of the engine. The combustion chamber then must be sealed during the combustion event to prevent inefficient operation and/or damage to various components in the engine. During the exhaust stroke, the burned gases in the combustion chamber must be efficiently evacuated from the combustion chamber.

Some known internal combustion engines use poppet valves to control the flow of gas into and out of the combustion chamber. Known poppet valves are reciprocating valves that include an elongated stem and a broadened sealing head. In use, known poppet valves open inwardly towards the combustion chamber such that the sealing head is spaced apart from a valve seat, thereby creating a flow path into or out of the combustion chamber when the valve is in the opened position. The sealing head can include an angled surface configured to contact a corresponding surface on the valve seat when the valve is in the closed position to effectively seal the combustion chamber.

The enlarged sealing head of known poppet valves, however, obstructs the flow path of the gas coming into or leaving the combustion cylinder, which can result in inefficiencies in the gas exchange process. Moreover, the enlarged sealing head can also produce vortices and other undesirable turbulence within the incoming air, which can negatively impact the combustion event. To minimize such effects, some known poppet valves are configured to travel a relatively large distance between the closed position and the opened position. Increasing the valve lift, however, results in higher parasitic losses, greater wear on the valve train, greater chance of valve-to-piston contact during engine operation, and the like.

Because the sealing head of known poppet valves extends into the combustion chamber, they are exposed to the extreme pressures and temperatures of engine combustion, which increases the likelihood that the valves will fail or leak. Exposure to combustion conditions can cause, for example, greater thermal expansion, detrimental carbon deposit build-up and the like. Moreover, such an arrangement is not conducive to servicing and/or replacing valves. In many instances, for example, the cylinder head must be removed to service or replace the valves.

To reduce the likelihood of leakage, known poppet valves are biased in the closed position using relatively stiff springs. Thus, known poppet valves are often actuated using a camshaft to produce the high forces necessary to open the valve. Known camshaft-based actuation systems, however, have limited flexibility to change the valve travel (or lift), timing and/or duration of the valve event as a function of engine operating conditions. For example, although some known camshaft-based actuation systems can change the valve opening or duration, such changes are limited because the valve events are dependent on the rotational position of the camshaft and/or the engine crankshaft. Accordingly, the valve events (i.e., the timing, duration and/or travel) are not optimized for each engine operating condition (e.g., low idle, high speed, full load, etc.), but are rather selected as a compromise that provides the desired overall performance.

Some known poppet valves are actuated using electronic actuators. Such solenoid-based actuation systems, however, often require multiple springs and/or solenoids to overcome the force of the biasing spring. Moreover, solenoid-based actuation systems require relatively high power to actuate the valves against the force of the biasing spring.

Thus, a need exists for an improved valve actuation system for an internal combustion engine and like systems and devices.

SUMMARY

Gas exchange valves and methods are described herein. In some embodiments, an apparatus includes a valve and an actuator. The valve has a portion movably disposed within a valve pocket defined by a cylinder head of an engine. The valve is configured to move relative to the cylinder head a distance between a closed position and an opened position. The portion of the valve defines a flow opening that is in fluid communication with a cylinder of an engine when the valve is in the opened position. The actuator is configured to selectively vary the distance between the closed position and the opened position.

BRIEF DESCRIPTION OF THE DRAWINGS

FIG. 65 is a schematic illustration of an engine having an engine control unit (ECU) according to an embodiment.

FIGS. 66-68 are graphical representation of calibration tables contained within the ECU shown in FIG. 65.

DETAILED DESCRIPTION

In some embodiments, an apparatus includes a valve and an actuator. The valve has a portion movably disposed within a valve pocket defined by a cylinder head of an engine. The valve is configured to move relative to the cylinder head a distance between a closed position and an opened position. The portion of the valve defines a flow opening that is in fluid communication with a cylinder of an engine when the valve is in the opened position. The actuator is configured to selectively vary the distance between the closed position and the opened position.

In some embodiments, an apparatus includes a valve and an actuator. The valve has a portion movably disposed within a flow passageway defined by a cylinder head of an engine. The valve is configured to move relative to the cylinder head a distance between a closed position and an opened position. The valve is configured to move independent of the rotation of a crankshaft of the engine. The valve is disposed outside of a cylinder of the engine when the valve is in the opened position. The actuator is configured to selectively vary the distance between the closed position and the opened position.

In some embodiments, an apparatus includes a valve, a biasing member and an actuator. The valve has a portion movably disposed within a flow passageway defined by a cylinder head of an engine. The valve is configured to move relative to the cylinder head a distance between a closed position and an opened position. The valve is configured to move independent of the rotation of a crankshaft of the engine. The biasing member, which can be, for example, a spring, is configured to bias the valve towards the closed position. The biasing member is configured to exert a force on the valve when the valve is in the closed position. The actuator is configured to selectively vary the distance between the closed position and the opened position. The force exerted by the biasing member on the valve is maintained at a substantially constant value when the valve is in the closed position. Similarly stated, the actuator is configured to selectively vary the valve travel without changing the force exerted by the biasing member on the valve when the valve is in the closed position.

Figure 1:
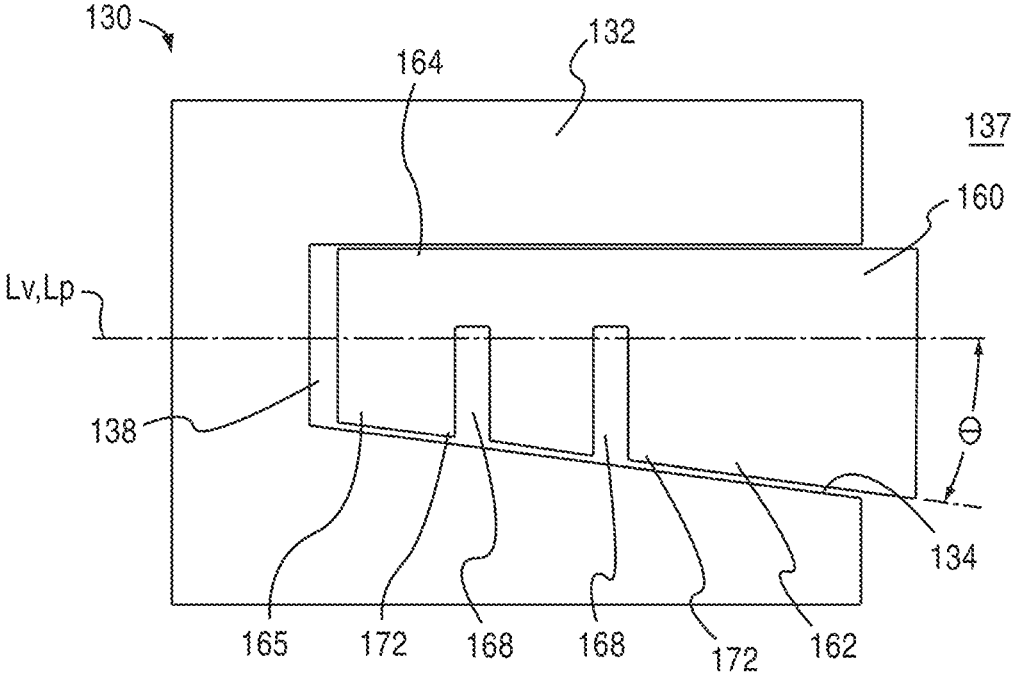
FIGS. 1 and 2 are schematics illustrating a cylinder head assembly according to an embodiment in a first configuration and a second configuration, respectively.
Figure 2:
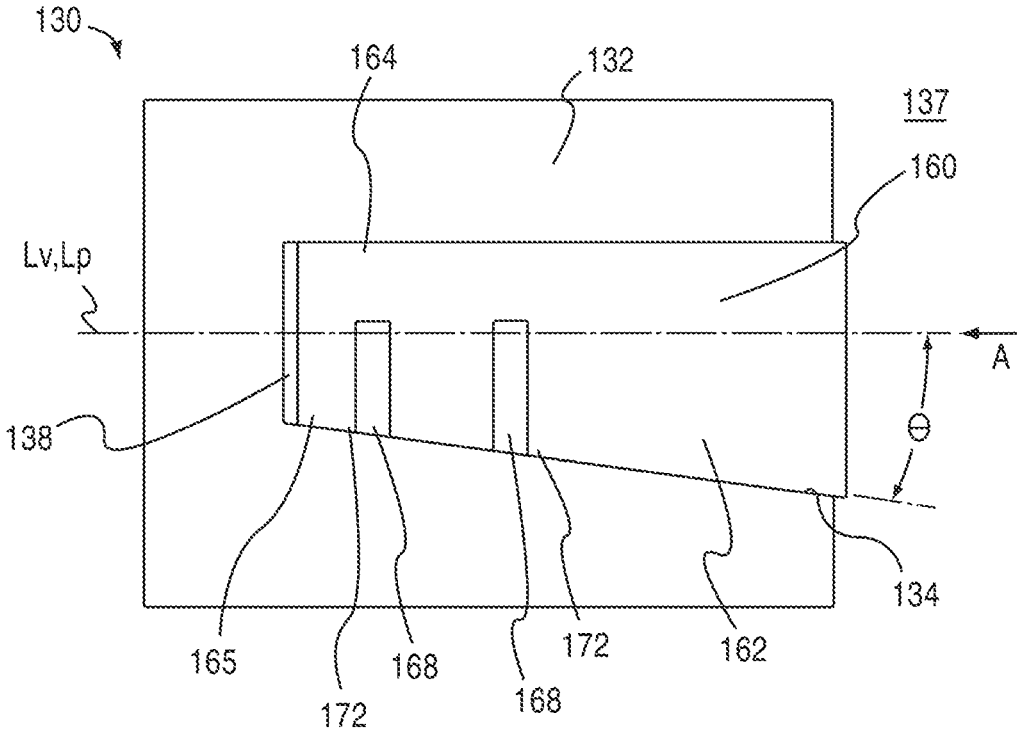

FIGS. 1 and 2 are schematic illustrations of a cylinder head assembly 130 according to an embodiment in a first and second configuration, respectively. The cylinder head assembly 130 includes a cylinder head 132 and a valve member 160. The cylinder head 132 has an interior surface 134 that defines a valve pocket 138 having a longitudinal axis Lp. The valve member 160 has tapered portion 162 defining two flow passages 168 and having a longitudinal axis Lv. The tapered portion 162 includes two sealing portions 172, each of which is disposed adjacent one of the flow passages 168. The tapered portion 162 includes a first side surface 164 and a second side surface 165. The second side surface 165 of the tapered portion 162 is angularly offset from the longitudinal axis Lv by a taper angle Θ, thereby producing the taper of the tapered portion 162. Although the first side surface 164 is shown as being substantially parallel to the longitudinal axis Lv, thereby resulting in an asymmetrical tapered portion 162, in some embodiments, the first side surface 164 is angularly offset such that the tapered portion 162 is symmetrical about the longitudinal axis Lv. Although the tapered portion 162 is shown as including a linear taper defining the taper angle Θ, in some embodiments the tapered portion 162 can include a non-linear taper.

The valve member 160 is reciprocatably disposed within the valve pocket 138 such that the tapered portion 162 of the valve member 160 can be moved along the longitudinal axis Lv of the tapered portion 162 within the valve pocket 138. In use, the cylinder head assembly 130 can be placed in a first configuration (FIG. 1) and a second configuration (FIG. 2). As illustrated in FIG. 1, when in the first configuration, the valve member 160 is in a first position in which the sealing portions 172 are disposed apart from the interior surface 134 of the cylinder head 132 such that each flow passage 168 is in fluid communication with an area 137 outside of the cylinder head 132. As illustrated in FIG. 2, the cylinder head assembly 132 is placed into the second configuration by moving the valve member 160 inwardly along the longitudinal axis Lv in the direction indicated by the arrow labeled A. When in the second configuration, the sealing portions 172 are in contact with a portion of the interior surface 134 of the cylinder head 132 such that each flow passage 168 is fluidically isolated from the area 137 outside of the cylinder head 132.

Although the entire valve member 160 is shown as being tapered, in some embodiments, only a portion of the valve member is tapered. For example, as will be discussed herein, in some embodiments, a valve member can include one or more non-tapered portions. In other embodiments, a valve member can include multiple tapered portions.

Although the flow passages 168 are shown as being substantially normal to the longitudinal axis Lv of the valve member 160, in some embodiments, the flow passages 168 can be angularly offset from the longitudinal axis Lv. Moreover, in some embodiments, the longitudinal axis Lv of the valve member 160 need not be coincident with the longitudinal axis Lp of the valve pocket 138. For example, in some embodiments, the longitudinal axis of the valve member can be offset from and parallel to the longitudinal axis of the valve pocket. In other embodiments, the longitudinal axis of the valve can be disposed at an angle to the longitudinal axis of the valve pocket.

As illustrated, the longitudinal axis Lv of the tapered portion 162 is coincident with the longitudinal axis of the valve member. Accordingly, throughout the specification, the longitudinal axis of the tapered portion may be referred to as the longitudinal axis of the valve member and vice versa. In some embodiments, however, the longitudinal axis of the tapered portion can be offset from the longitudinal axis of the valve member. For example, in some embodiments, the first stem portion and/or the second stem portion as described below can be angularly offset from the tapered portion such that the longitudinal axis of the valve member is offset from the longitudinal axis of the tapered portion.

Although the cylinder head assembly 130 is illustrated as having a first configuration (i.e., an opened configuration) in which the flow passages 168 are in fluid communication with an area 137 outside of the cylinder head 132 and second configuration (i.e., a closed configuration) in which the flow passages 168 are fluidically isolated from the area 137 outside of the cylinder head 132, in some embodiments the first configuration can be the closed configuration and the second configuration can be the opened configuration. In other embodiments, the cylinder head assembly 130 can have more than two configurations. For example, in some embodiments, a cylinder head assembly can have multiple open configurations, such as, for example, a partially opened configuration and a fully opened configuration.

Figure 3:
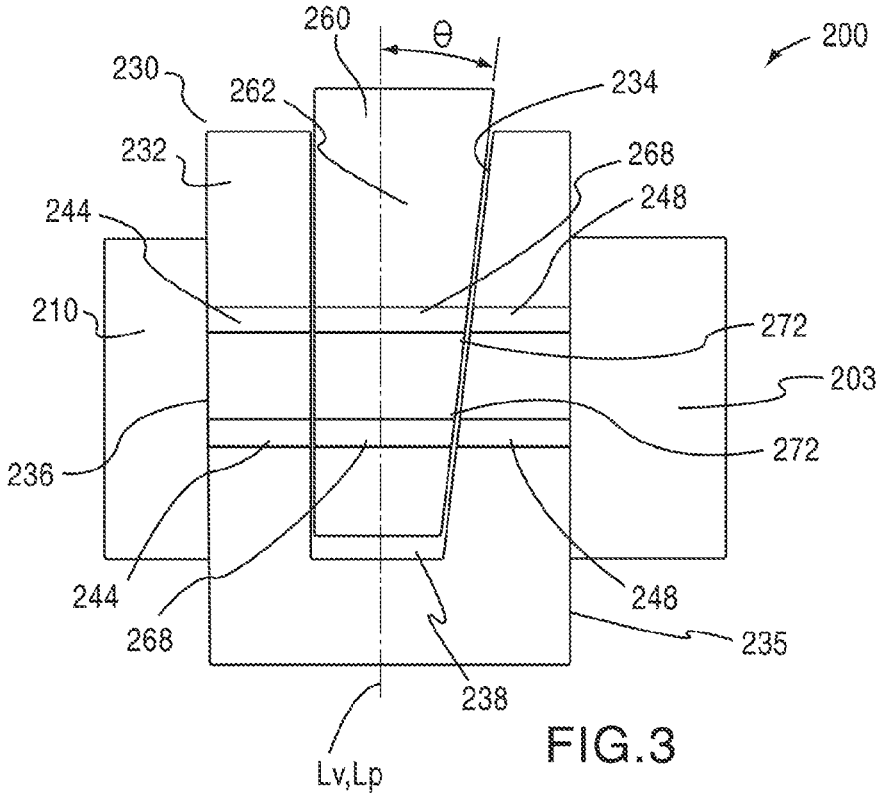
FIGS. 3 and 4 are schematics illustrating a cylinder head assembly according to an embodiment in a first configuration and a second configuration, respectively.
Figure 4:
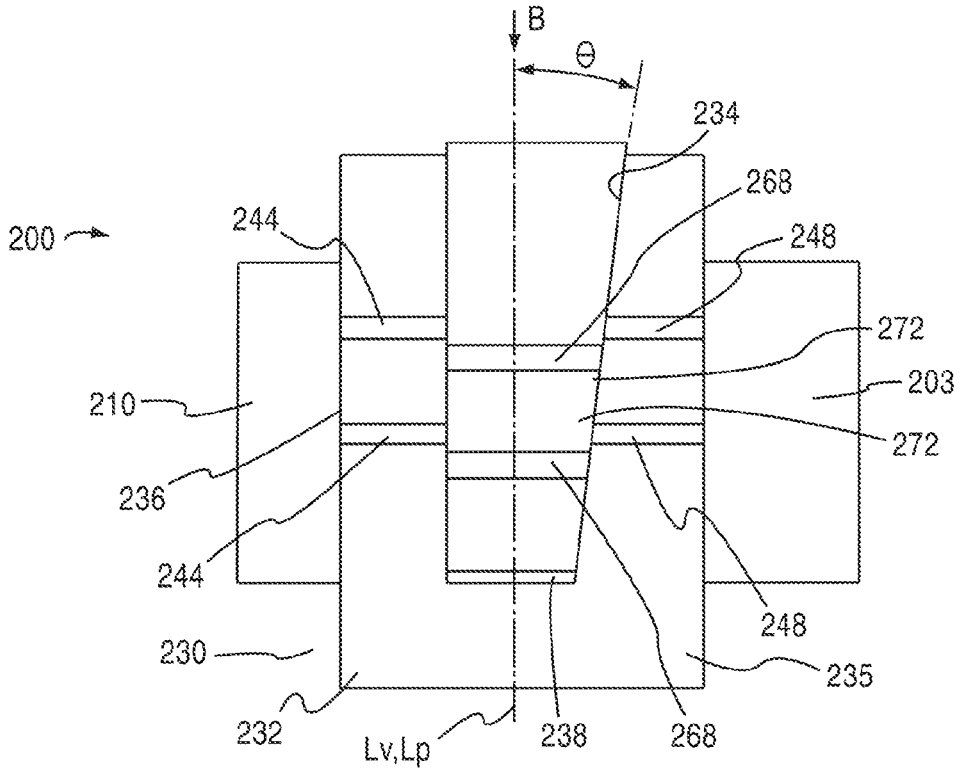

FIGS. 3 and 4 are schematic illustrations of a portion of an engine 200 according to an embodiment in a first and second configuration, respectively. The engine 200 includes a cylinder head assembly 230, a cylinder 203 and a gas manifold 210. The cylinder 203 is coupled to a first surface 235 of the cylinder head assembly 230 and can be, for example, a combustion cylinder defined by an engine block (not shown). The gas manifold 210 is coupled to a second surface 236 of the cylinder head assembly 230 and can be, for example an intake manifold or an exhaust manifold. Although the first surface 235 and the second surface 236 are shown as being parallel to and disposed on opposite sides of the cylinder head 232 from each other, in other embodiments, the first surface and the second surface can be adjacent each other. In yet other embodiments, the gas manifold and the cylinder can be coupled to the same surface of the cylinder head.

The cylinder head assembly 230 includes a cylinder head 232 and a valve member 260. The cylinder head 232 has an interior surface 234 that defines a valve pocket 238 having a longitudinal axis Lp. The cylinder head 232 also defines two cylinder flow passages 248 and two gas manifold flow passages 244. Each of the cylinder flow passages 248 is in fluid communication with the cylinder 203 and the valve pocket 238. Similarly, each of the gas manifold flow passages 244 is in fluid communication with the gas manifold 210 and the valve pocket 238. Although each of the cylinder flow passages 248 is shown as being fluidically isolated from the other cylinder flow passage 248, in other embodiments, the cylinder flow passages 248 can be in fluid communication with each other. Similarly, although each of the gas manifold flow passages 244 is shown as being fluidically isolated from the other gas manifold flow passage 244, in other embodiments, the gas manifold flow passages 244 can be in fluid communication with each other.

The valve member 260 has a tapered portion 262 having a longitudinal axis Lv and a taper angle Θ with respect to the longitudinal axis Lv. The tapered portion 262 defines two flow passages 268 and includes two sealing portions 272, each of which is disposed adjacent one of the flow passages 268. Although shown as being an asymmetrical taper in a single dimension, in some embodiments the tapered portion can be symmetrically tapered about the longitudinal axis Lv. In other embodiments, as discussed in more detail herein, the tapered portion can be tapered in two dimensions about the longitudinal axis Lv.

The valve member 260 is disposed within the valve pocket 238 such that the tapered portion 262 of the valve member 260 can be moved along its longitudinal axis Lv within the valve pocket 238. In use, the engine 200 can be placed in a first configuration (FIG. 3) and a second configuration (FIG. 4). As illustrated in FIG. 3, when in the first configuration, the valve member 260 is in a first position in which each flow passage 268 is in fluid communication with one of the cylinder flow passages 248 and one of the gas manifold flow passages 244. In this manner, the gas manifold 210 is in fluid communication with the cylinder 203. Although the flow passages 268 are shown as being aligned with the cylinder flow passages 248 and the gas manifold flow passages 244 when the engine is in the first configuration, in other embodiments the flow passages 268 need not be directly aligned. In other words, the flow passages 268, 248, 24 may be offset when the engine 200 is in the first configuration, but the gas manifold 210 is still in fluid communication with the cylinder 203.

As illustrated in FIG. 4, when the engine 200 is in the second configuration, the valve member 260 is in a second position, axially offset from the first position in the direction indicated by the arrow labeled B. In the second configuration, the sealing portions 272 are in contact with a portion of the interior surface 234 of the cylinder head 232 such that each flow passage 268 is fluidically isolated from the cylinder flow passages 248. In this manner, the cylinder 203 is fluidically isolated from the gas manifold 210.

Figure 5:
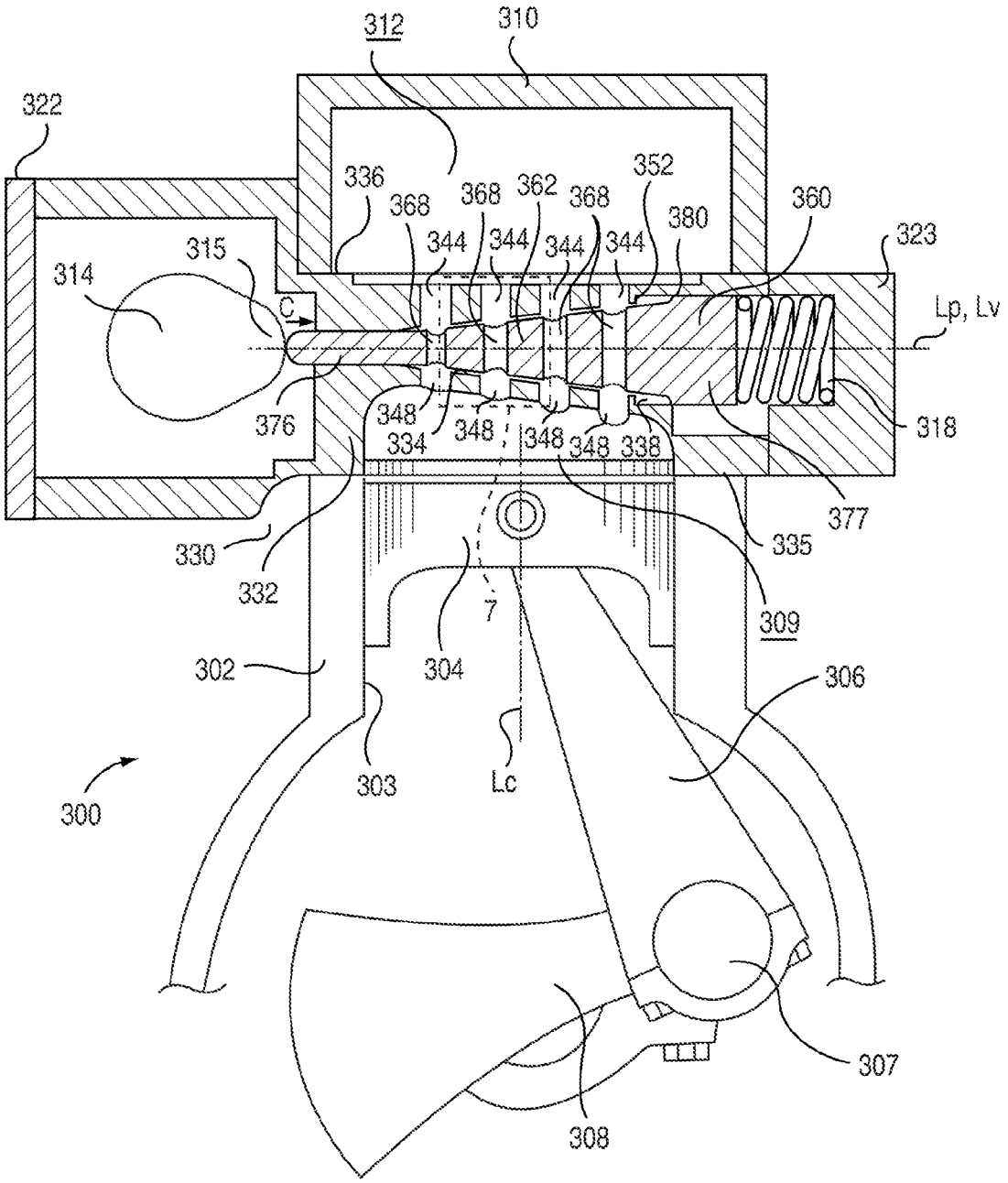
FIG. 5 is a cross-sectional front view of a portion of an engine including a cylinder head assembly according to an embodiment in a first configuration.
Figure 6:
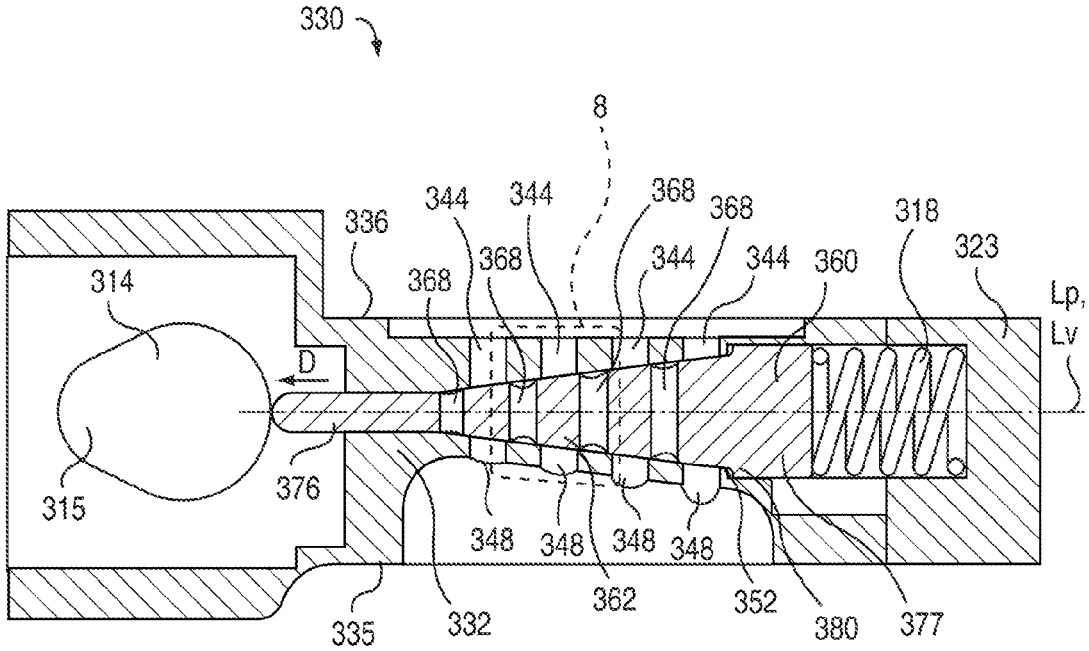
FIG. 6 is a cross-sectional front view of the cylinder head assembly illustrated in FIG. 5 in a second configuration

FIG. 5 is a cross-sectional front view of a portion of an engine 300 including a cylinder head assembly 330 in a first configuration according to an embodiment. FIG. 6 is a cross-sectional front view of the cylinder head assembly 330 in a second configuration. The engine 300 includes an engine block 302 and a cylinder head assembly 330 coupled to the engine block 302. The engine block 302 defines a cylinder 303 having a longitudinal axis Lc. A piston 304 is disposed within the cylinder 303 such that it can reciprocate along the longitudinal axis Lc of the cylinder 303. The piston 304 is coupled by a connecting rod 306 to a crankshaft 308 having an offset throw 307 such that as the piston reciprocates within the cylinder 303, the crankshaft 308 is rotated about its longitudinal axis (not shown). In this manner, the reciprocating motion of the piston 304 can be converted into a rotational motion.

A first surface 335 of the cylinder head assembly 330 is coupled to the engine block 302 such that a portion of the first surface 335 covers the upper portion of the cylinder 303 thereby forming a combustion chamber 309. Although the portion of the first surface 335 covering the cylinder 303 is shown as being curved and angularly offset from the top surface of the piston, in some embodiments, because the cylinder head assembly 330 does not include valves that protrude into the combustion chamber, the surface of the cylinder head assembly forming part of the combustion chamber can have any suitable geometric design. For example, in some embodiments, the surface of the cylinder head assembly forming part of the combustion chamber can be flat and parallel to the top surface of the piston. In other embodiments, the surface of the cylinder head assembly forming part of the combustion chamber can be curved to form a hemispherical combustion chamber, a pent-roof combustion chamber or the like.

A gas manifold 310 defining an interior area 312 is coupled to a second surface 336 of the cylinder head assembly 330 such that the interior area 312 of the gas manifold 310 is in fluid communication with a portion of the second surface 336. As described in detail herein, this arrangement allows a gas, such as, for example air or combustion by-products, to be transported into or out of the cylinder 303 via the cylinder head assembly 330 and the gas manifold 310. Although shown as including a single gas manifold 310, in some embodiments, an engine can include two or more gas manifolds. For example, in some embodiments an engine can include an intake manifold configured to supply air and/or an air-fuel mixture to the cylinder head and an exhaust manifold configured to transport exhaust gases away from the cylinder head.

Moreover, as shown, in some embodiments the first surface 335 can be opposite the second surface 336, such that the flow of gas into and/or out of the cylinder 303 can occur along a substantially straight line. In such an arrangement, a fuel injector (not shown) can be disposed in an intake manifold (not shown) directly above the cylinder flow passages 348. In this manner, the injected fuel can be conveyed into the cylinder 303 without being subjected to a series of bends. Eliminating bends along the fuel path can reduce fuel impingement and/or wall wetting, thereby leading to more efficient engine performance, such as, for example, improved transient response.

Figure 7:
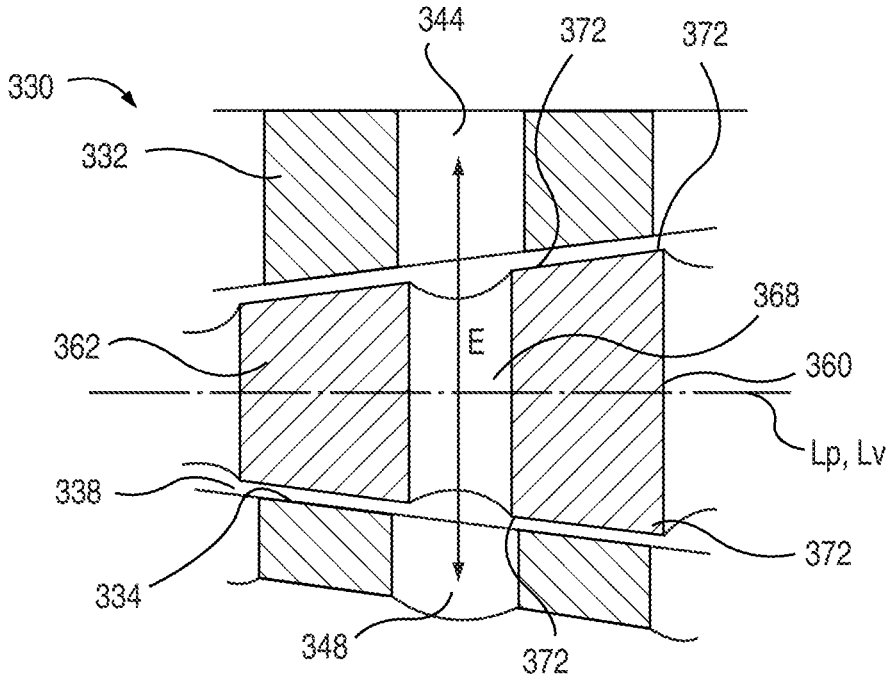
FIG. 7 is a cross-sectional front view of the portion of the cylinder head assembly labeled "7" in FIG. 5.

The cylinder head assembly 330 includes a cylinder head 332 and a valve member 360. The cylinder head 332 has an interior surface 334 that defines a valve pocket 338 having a longitudinal axis Lp. The cylinder head 332 also defines four cylinder flow passages 348 and four gas manifold flow passages 344. Each of the cylinder flow passages 348 is adjacent the first surface 335 of the cylinder head 332 and is in fluid communication with the cylinder 303 and the valve pocket 338. Similarly, each of the gas manifold flow passages 344 is adjacent the second surface 336 of the cylinder head 332 and is in fluid communication with the gas manifold 310 and the valve pocket 338. Each of the cylinder flow passages 348 is aligned with a corresponding gas manifold flow passage 344. In this arrangement, when the cylinder head assembly 330 is in the first (or opened) configuration (see, e.g., FIGS. 5 and 7), the gas manifold 310 is in fluid communication with the cylinder 303. Conversely, when the cylinder head assembly 330 is in a second (or closed) configuration (see, e.g., FIGS. 6 and 8), the gas manifold 310 is fluidically isolated from the cylinder 303.

The valve member 360 has tapered portion 362, a first stem portion 376 and a second stem portion 377. The first stem portion 376 is coupled to an end of the tapered portion 362 of the valve member 360 and is configured to engage a valve lobe 315 of a camshaft 314. The second stem portion 377 is coupled to an end of the tapered portion 362 opposite from the first stem portion 376 and is configured to engage a spring 318. A portion of the spring 318 is contained within an end plate 323, which is removably coupled to the cylinder head 332 such that it compresses the spring 318 against the second stem portion 377 thereby biasing the valve member 360 in a direction indicated by the arrow D in FIG. 6.

The tapered portion 362 of the valve member 360 defines four flow passages 368 therethrough. The tapered portion includes eight sealing portions 372 (see, e.g., FIGS. 10, 11 and 13), each of which is disposed adjacent one of the flow passages 368 and extends continuously around the perimeter of an outer surface 363 of the tapered portion 362. The valve member 360 is disposed within the valve pocket 338 such that the tapered portion 362 of the valve member 360 can be moved along a longitudinal axis Lv of the valve member 360 within the valve pocket 338. In some embodiments, the valve pocket 338 includes a surface 352 configured to engage a corresponding surface 380 on the valve member 360 to limit the range of motion of the valve member 360 within the valve pocket 338.

In use, when the camshaft 314 is rotated such that the eccentric portion of the valve lobe 315 is in contact with the first stem 376 of the valve member 360, the force exerted by the valve lobe 315 on the valve member 360 is sufficient to overcome the force exerted by the spring 318 on the valve member 360. Accordingly, as shown in FIG. 5, the valve member 360 is moved along its longitudinal axis Lv within the valve pocket 338 in the direction of the arrow C, into a first position, thereby placing the cylinder head assembly 330 in the opened configuration. When in the opened configuration, the valve member 360 is positioned within the valve pocket 338 such that each flow passage 368 is aligned with and in fluid communication with one of the cylinder flow passages 348 and one of the gas manifold flow passages 344. In this manner, the gas manifold 310 is in fluid communication with the cylinder 303, along the flow path indicated by the arrow labeled E in FIG. 7.

Figure 8:
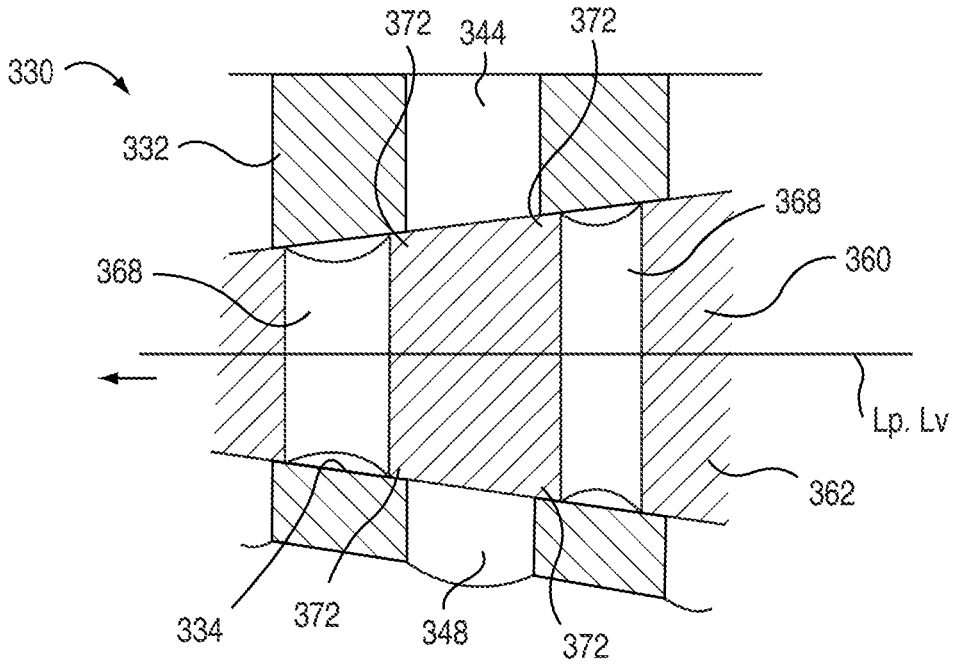
FIG. 8 is a cross-sectional front view of the portion of the cylinder head assembly labeled "8" in FIG. 6.

When the camshaft 314 is rotated such that the eccentric portion of the camshaft lobe 315 is not in contact with the first stem 376 of the valve member 360, the force exerted by the spring 318 is sufficient to move the valve member 360 in the direction of the arrow D, into a second position, axially offset from the first position, thereby placing the cylinder head assembly 330 in the closed configuration (see FIG. 6). When in the closed configuration, each flow passage 368 is offset from the corresponding cylinder flow passage 348 and gas manifold flow passage 344. Moreover, as shown in FIG. 8, when in the closed configuration, each of the sealing portions 372 is in contact with a portion of the interior surface 334 of the cylinder head 332 such that each flow passage 368 is fluidically isolated from the cylinder flow passages 348. In this manner, the cylinder 303 is fluidically isolated from the gas manifold 310.

Although the cylinder head assembly 330 is described as being configured to fluidically isolate the flow passages 368 from the cylinder flow passages 348 when in the closed configuration, in some embodiments, the sealing portions 372 can be configured to contact a portion of the interior surface 334 of the cylinder head 332 such that each flow passage 368 is fluidically isolated from the cylinder head flow passages 348 and the gas manifold flow passages 344. In other embodiments, the sealing portions 372 can be configured to contact a portion of the interior surface 334 of the cylinder head 332 such that each flow passage 368 is fluidically isolated only from the gas manifold flow passages 344.

Although each of the cylinder flow passages 348 is shown being fluidically isolated from the other cylinder flow passage 348, in some embodiments, the cylinder flow passages 348 can be in fluid communication with each other. Similarly, although each of the gas manifold flow passages 344 is shown being fluidically isolated from the other gas manifold flow passages 344, in other embodiments, the gas manifold flow passages 344 can be in fluid communication with each other.

Although the longitudinal axis Lc of the cylinder 303 is shown as being substantially normal to the longitudinal axis Lp of the valve pocket 338 and the longitudinal axis Lv of the valve 360, in some embodiments, the longitudinal axis of the cylinder can be offset from the longitudinal axis of the valve pocket and/or the longitudinal axis of the valve member by an angle other than 90 degrees. In yet other embodiments, the longitudinal axis of the cylinder can be substantially parallel to the longitudinal axis of the valve pocket and/or the longitudinal axis of the valve member. Similarly, as described above, the longitudinal axis Lv of the valve member 360 need not be coincident with or parallel to the longitudinal axis Lp of the valve pocket 338.

In some embodiments, the camshaft 314 is disposed within a portion of the cylinder head 332. An end plate 322 is removably coupled to the cylinder head 332 to allow access to the camshaft 314 and the first stem portion 376 for assembly, repair and/or adjustment. In other embodiments, the camshaft is disposed within a separate cam box (not shown) that is removably coupled to the cylinder head. Similarly, the end plate 323 is removably coupled to the cylinder head 332 to allow access to the spring 318 and/or the valve member 360 for assembly, repair, replacement and/or adjustment.

In some embodiments, the spring 318 is a coil spring configured to exert a force on the valve member 360 thereby ensuring that the sealing portions 372 remain in contact with the interior surface 334 when the cylinder head assembly 330 is in the closed configuration. The spring 318 can be constructed from any suitable material, such as, for example, a stainless steel spring wire, and can be fabricated to produce a suitable biasing force. In some embodiments, however, a cylinder head assembly can include any suitable biasing member to ensure that that the sealing portions 372 remain in contact with the interior surface 334 when the cylinder head assembly 330 is in the closed configuration. For example, in some embodiments, a cylinder head assembly can include a cantilever spring, a Belleville spring, a leaf spring and the like. In other embodiments, a cylinder head assembly can include an elastic member configured to exert a biasing force on the valve member. In yet other embodiments, a cylinder head assembly can include an actuator, such as a pneumatic actuator, a hydraulic actuator, an electronic actuator and/or the like, configured to exert a biasing force on the valve member.

Although the first stem portion 376 is shown and described as being in direct contact with the valve lobe 315 of the camshaft 314, in some embodiments, an engine and/or cylinder head assembly can include a member configured to maintain a predetermined valve lash setting, such as for example, an adjustable tappet, disposed between the camshaft and the first stem portion. In other embodiments, an engine and/or cylinder head assembly can include a hydraulic lifter disposed between the camshaft and the first stem portion to ensure that the valve member is in constant contact with the camshaft. In yet other embodiments, an engine and/or a cylinder head assembly can include a follower member, such as for example, a roller follower disposed between the first stem portion. Similarly, in some embodiments, an engine can include one or more components disposed adjacent the spring. For example, in some embodiments, the second stem portion can include a spring retainer, such as for example, a pocket, a clip, or the like. In other embodiments, a valve rotator can be disposed adjacent the spring.

Although the cylinder head 332 is shown and described as being a separate component coupled to the engine block 302, in some embodiments, the cylinder head 332 and the engine block 302 can be monolithically fabricated, thereby eliminating the need for a cylinder head gasket and cylinder head mounting bolts. In some embodiments, for example, the engine block and the cylinder head can be cast using a single mold and subsequently machined to include the cylinders, valve pockets and the like. Moreover, as described above, the valve members can be installed and/or serviced by removing the end plate.

Although the engine 300 is shown and described as including a single cylinder, in some embodiments, an engine can include any number of cylinders in any arrangement. For example, in some embodiments, an engine can include any number of cylinders in an in-line arrangement. In other embodiments, any number of cylinders can be arranged in a vee configuration, an opposed configuration or a radial configuration.

Similarly, the engine 300 can employ any suitable thermodynamic cycle. Such engine types can include, for example, Diesel engines, spark ignition engines, homogeneous charge compression ignition (HCCI) engines, two-stroke engines and/or four stroke engines. Moreover, the engine 300 can include any suitable type of fuel injection system, such as, for example, multi-port fuel injection, direct injection into the cylinder, carburetion, and the like.

Although the cylinder head assembly 330 is shown and described above as being devoid of mounting holes, a spark plug, and the like, in some embodiments, a cylinder head assembly includes mounting holes, spark plugs, cooling passages, oil drillings and the like.

Figure 9:
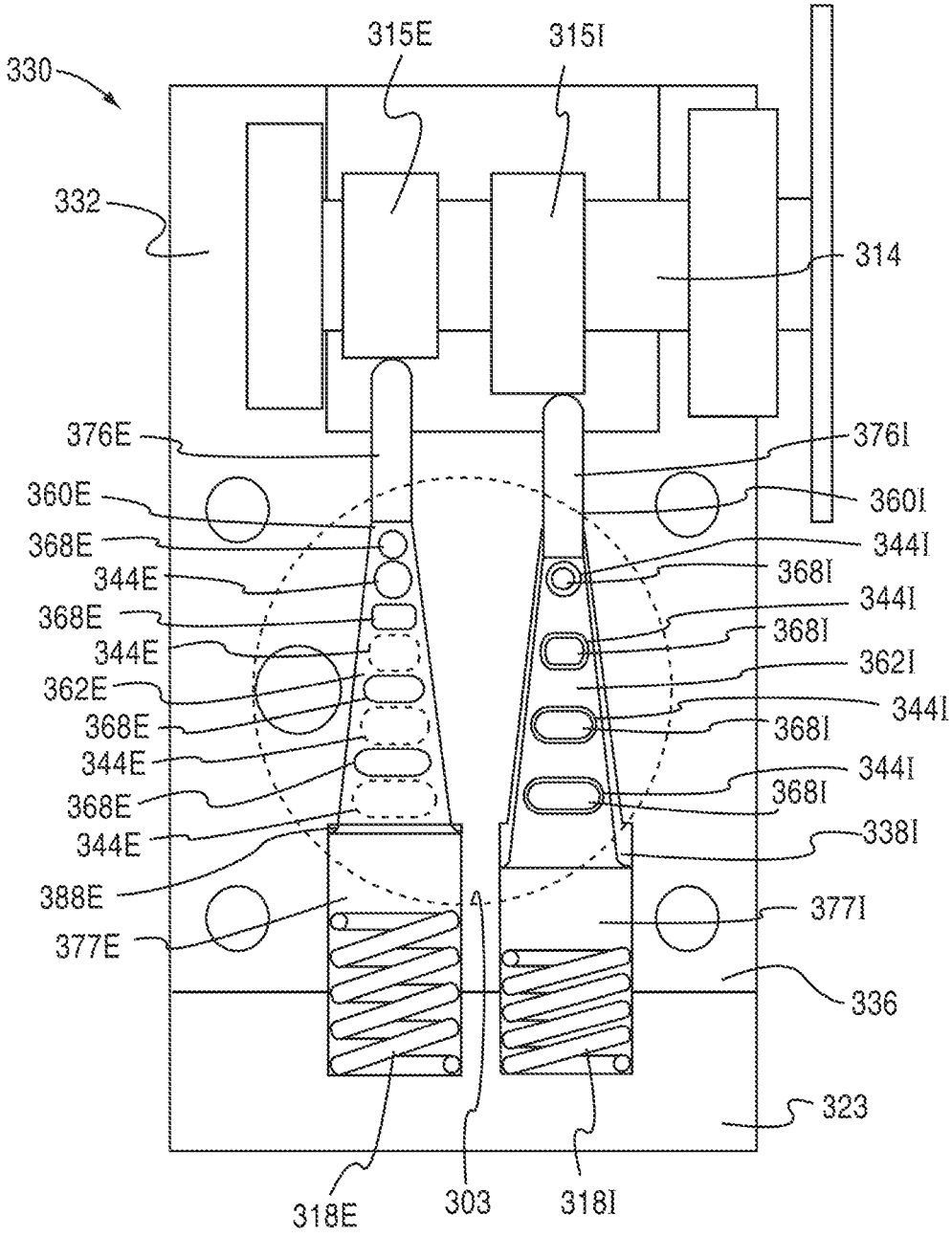
FIG. 9 is a top view of a portion of cylinder head assembly according to an embodiment.

Although the cylinder head assembly 330 is shown and described above with reference to a single valve 360 and a single gas manifold 310, in some embodiments, a cylinder head assembly includes multiple valves and gas manifolds. For example, FIG. 9 illustrates a top view of the cylinder head assembly 330 including an intake valve member 360I and an exhaust valve member 360E. As illustrated, the cylinder head 332 defines an intake valve pocket 338I, within which the intake valve member 360I is disposed, and an exhaust valve pocket 338E, within which the exhaust valve member 360E is disposed. Similar to the arrangement described above, the cylinder head 332 also defines four intake manifold flow passages 344I, four exhaust manifold flow passages 344E and the corresponding cylinder flow passages (not shown in FIG. 9). Each of the intake manifold flow passages 344I is adjacent the second surface 336 of the cylinder head 332 and is in fluid communication with an intake manifold (not shown) and the intake valve pocket 338I. Similarly, each of the exhaust manifold flow passages 344E is adjacent the second surface 336 of the cylinder head 332 and is in fluid communication with an exhaust manifold (not shown) and the exhaust valve pocket 338E.

The operation of the intake valve member 360I and the exhaust valve member 360E is similar to that of the valve member 360 described above in that each has a first (or opened) position and a second (or closed) position. In FIG. 9, the intake valve member 360I is shown in the opened position, in which each flow passage 368I defined by the tapered portion 362I of the intake valve member 360I is aligned with its corresponding intake manifold flow passage 344I and cylinder flow passage (not shown). In this manner, the intake manifold (not shown) is in fluid communication with the cylinder 303, thereby allowing a charge of air to be conveyed from the intake manifold into the cylinder 303. Conversely, the exhaust valve member 360E is shown in the closed position in which each flow passage 368E defined by the tapered portion 362E of the exhaust valve member 360E is offset from its corresponding exhaust manifold flow passage 344E and cylinder flow passage (not shown). Moreover, each sealing portion (not shown in FIG. 9) defined by the exhaust valve member 360E is in contact with a portion of the interior surface of the exhaust valve pocket 338E such that each flow passage 368E is fluidically isolated from the cylinder flow passages (not shown). In this manner, the cylinder 303 is fluidically isolated from the exhaust manifold (not shown).

The cylinder head assembly 330 can have many different configurations corresponding to the various combinations of the positions of the valve members 360I, 360E as they move between their respective first and second positions. One possible configuration includes an intake configuration in which, as shown in FIG. 9, the intake valve member 360I is in the opened position and the exhaust valve member 360E is in the closed position. Another possible configuration includes a combustion configuration in which both valves are in their closed positions. Yet another possible configuration includes an exhaust configuration in which the intake valve member 360I is in the closed position and the exhaust valve member 360E is in the opened position. Yet another possible configuration is an overlap configuration in which both valves are in their opened positions.

Similar to the operation described above, the intake valve member 360I and the exhaust valve member 360E are moved by a camshaft 314 that includes an intake valve lobe 315I and an exhaust valve lobe 315E. As shown, the intake valve member 360I and the exhaust valve member 360E are each biased in the closed position by springs 318I, 318E, respectively. Although the intake valve lobe 315I and the exhaust valve lobe 315E are illustrated as being disposed on a single camshaft 314, in some embodiments, an engine can include separate camshafts to move the intake and exhaust valve members. In other embodiments, as discussed herein, the intake valve member 360I and/or the exhaust valve member 360E can be moved by an suitable means, such as, for example, an electronic solenoid, a stepper motor, a hydraulic actuator, a pneumatic actuator, a piezo-electric actuator or the like. In yet other embodiments, the intake valve member 360I and/or the exhaust valve member 360E are not maintained in the closed position by a spring, but rather include mechanisms similar to those described above for moving the valve. For example, in some embodiments, a first stem of a valve member can engage a camshaft valve lobe and the second stem of the valve member can engage a solenoid configured to bias the valve member.

FIGS. 10-13 show a top view, a front view, a side cross-sectional view and a perspective view of the valve member 360, respectively. As described above, the valve member has tapered portion 362, a first stem portion 376 and a second stem portion 377. The tapered portion 362 of the valve member 360 defines four flow passages 368. Each flow passage 368 extends through the tapered portion 362 and includes a first opening 369 and a second opening 370. In the illustrated embodiment, the flow passages 368 are spaced apart by a distance S along the longitudinal axis Lv of the tapered portion 362. The distance S corresponds to the distance that the tapered portion 362 moves within the valve pocket 338 when transitioning from the first (opened configuration) to the second (closed) configuration. Accordingly, the travel (or stroke) of the valve member can be reduced by spacing the flow passages 368 closer together. In some embodiments, the distance S can be between 2.3 mm and 4.2 mm (0.090 in. and 0.166 in.). In other embodiments, the distance S can be less than 2.3 mm (0.090 in.) or greater than 4.2 mm (0.166 in.). Although illustrated as having a constant spacing S, in some embodiments, the flow passages are each separated by a different distance. As discussed in more detail herein, reducing the stroke of the valve member can result in several improvements in engine performance, such as, for example, reduced parasitic losses, allowing the use of weaker valve springs, and the like.

Although the tapered portion 362 is shown as defining four flow passages having a long, narrow shape, in some embodiments a valve member can define any number of flow passages having any suitable shape and size. For example, in some embodiments, a valve member can include eight flow passages configured to have approximately the same cumulative flow area (as taken along a plane normal to the longitudinal axis Lf of the flow passages) as that of a valve member having four larger flow passages. In such an embodiment, the flow passages can be arranged such that the spacing between the flow passages of the "eight passage valve member" is approximately half that of the of the spacing between the flow passages of the "four passage valve member." As such, the stroke of the "eight passage valve member" is approximately half that of the "four passage valve member," thereby resulting in an arrangement that provides substantially the same flow area while requiring the valve member to move only approximately half the distance.

Each flow passage 368 need not have the same shape and/or size as the other flow passages 368. Rather, as shown, the size of the flow passages can decrease with the taper of the tapered portion 362 of the valve member 360. In this manner, the valve member 360 can be configured to maximize the cumulative flow area, thereby resulting in more efficient engine operation. Moreover, in some embodiments, the shape and/or size of the flow passages 368 can vary along the longitudinal axis Lf. For example, in some embodiments, the flow passages can have a lead-in chamfer or taper along the longitudinal axis Lf.

Similarly, each of the manifold flow passages 344 and each of the cylinder flow passages 348 need not have the same shape and/or size as the other manifold flow passages 344 and each of the cylinder flow passages 348, respectively. Moreover, in some embodiments, the shape and/or size of the manifold flow passages 344 and/or the cylinder flow passages 348 can vary along their respective longitudinal axes. For example, in some embodiments, the manifold flow passages can have a lead in chamfer or taper along their longitudinal axes. In other embodiments, the cylinder flow passages can have a lead-in chamfer or taper along their longitudinal axes.

Figure 12:
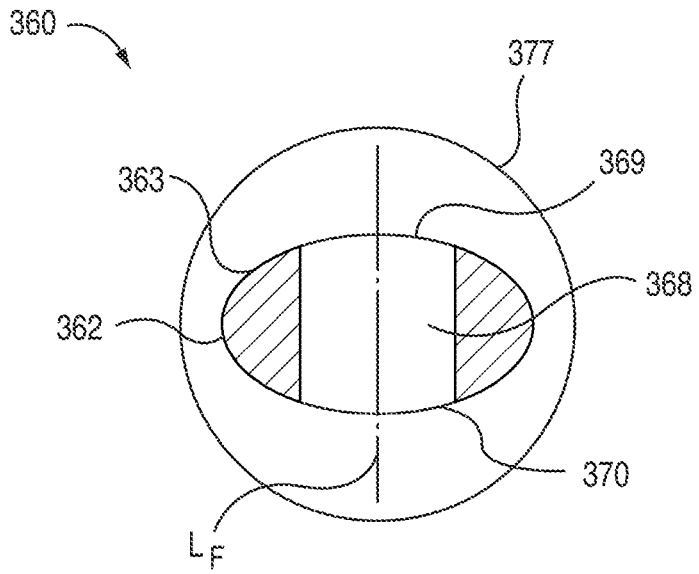
FIG. 12 is a cross-sectional view of the valve member illustrated in FIG. 11 taken along line 12-12.

Although the longitudinal axis Lf of the flow passages 368 is shown in FIG. 12 as being substantially normal to the longitudinal axis Lv of the valve member 360, in some embodiments the longitudinal axis Lf of the flow passages 368 can be angularly offset from the longitudinal axis Lv of the valve member 360 by an angle other than 90 degrees. Moreover, as discussed in more detail herein, in some embodiments, the longitudinal axis and/or the centerline of one flow passage need not be parallel to the longitudinal axis of another flow passage.

Figure 37:
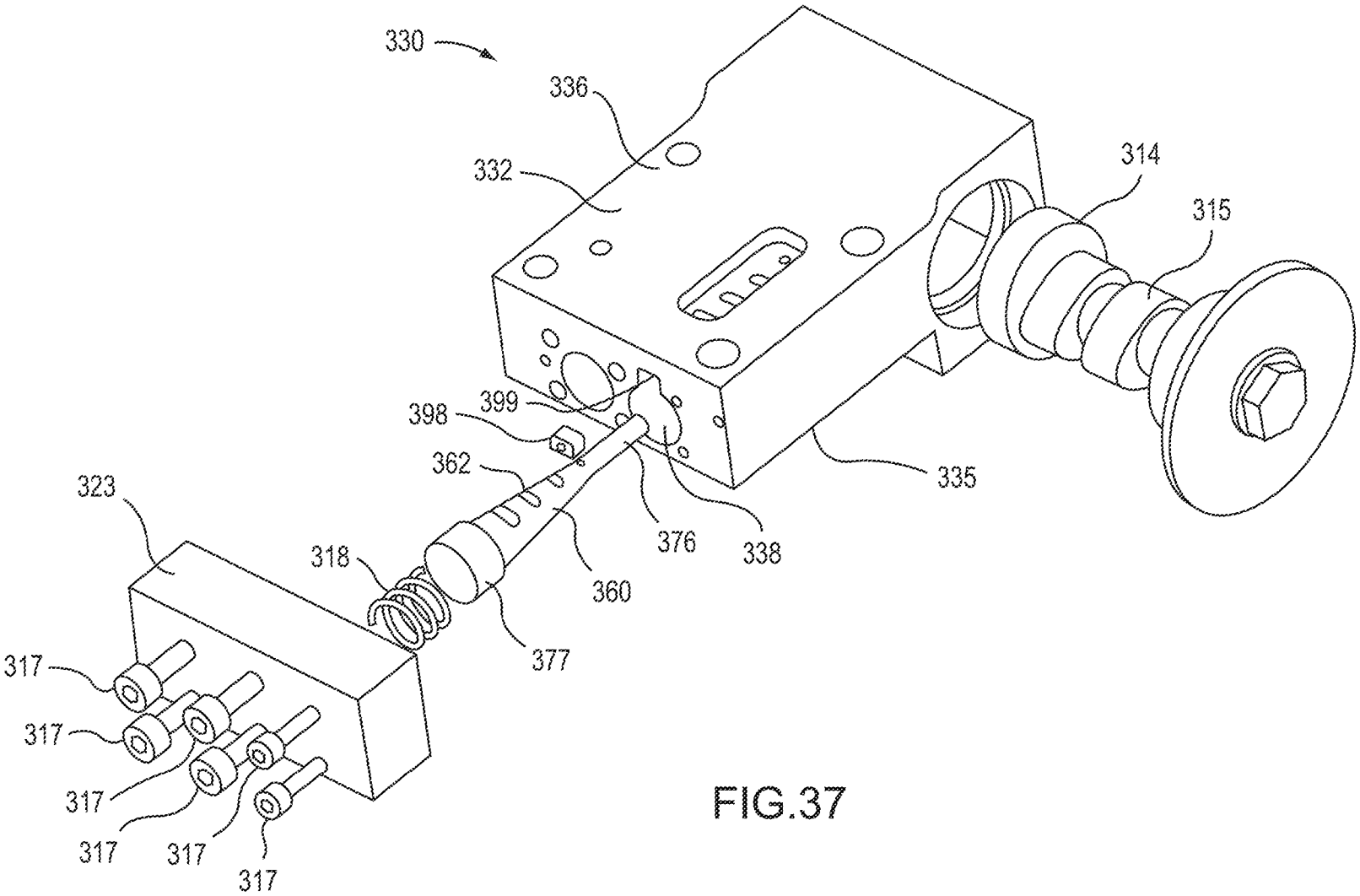
FIG. 37 is a perspective exploded view of the cylinder head assembly shown in FIG. 5.

As previously discussed with reference to FIG. 5, the valve member 360 includes a surface 380 configured to engage a corresponding surface 352 within the valve pocket 338 to limit the range of motion of the valve member 360 within the valve pocket 338. Although the surface 380 is illustrated as being a shoulder-like surface disposed adjacent the second stem portion 377, in some embodiments, the surface 380 can have any suitable geometry and can be disposed anywhere along the valve member 360. For example, in some embodiments, a valve member can have a surface disposed on the first stem portion, the surface being configured to limit the longitudinal motion of the valve member. In other embodiments, a valve member can have a flattened surface disposed on one of the stem portions, the flattened surface being configured to limit the rotational motion of the valve member. In yet other embodiments, as illustrated in FIG. 37, the valve member 360 can be aligned using an alignment key 398 configured to be disposed within a mating keyway 399.

Figure 10:
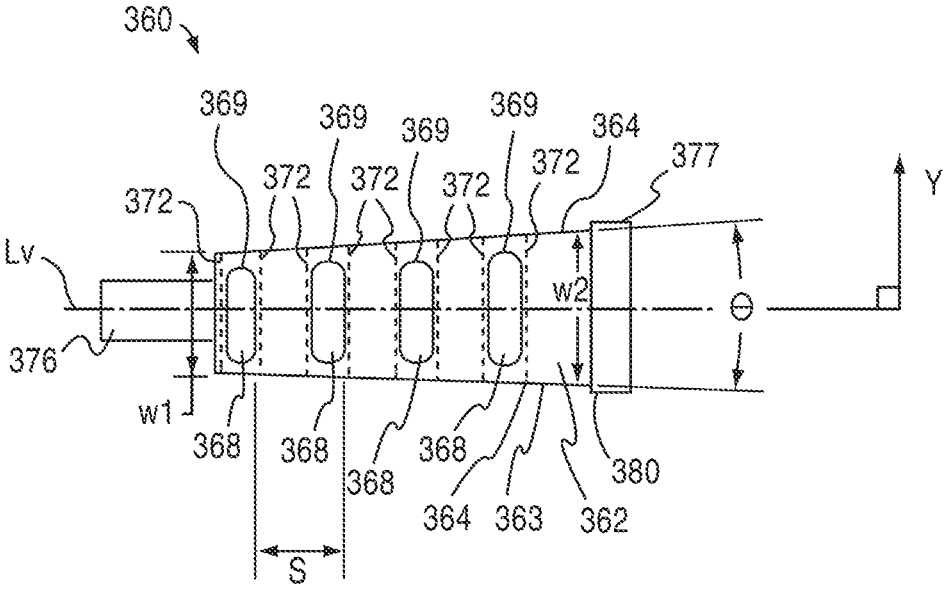
FIGS. 10 and 11 are top and front views, respectively, of the valve member illustrated in FIG. 5.
Figure 11:
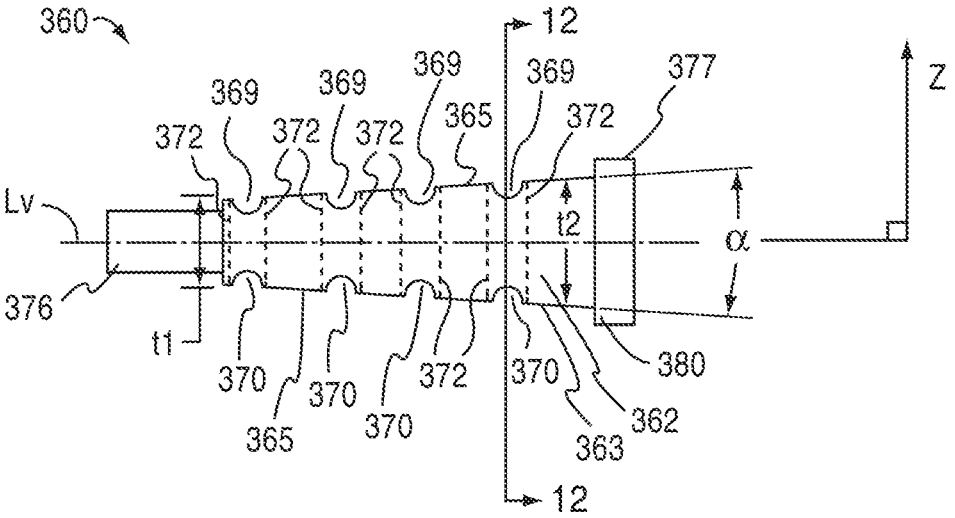

As shown in FIG. 10, which illustrates a top view of the valve member 360, the first opposing side surfaces 364 of the tapered portion 362 are angularly offset from each other by a first taper angle Θ. Similarly, as shown in FIG. 11, which presents a front view of the valve member 360, the second opposing side surfaces 365 of the tapered portion 362 are angularly offset from each other by an angle α. In this manner, the tapered portion 362 of the valve member 360 is tapered in two dimensions.

Said another way, the tapered portion 362 of the valve member 360 has a width W measured along a first axis Y that is normal to the longitudinal axis Lv. Similarly, the tapered portion 362 has a thickness T (not to be confused with the wall thickness of any portion of the valve member) measured along a second axis Z that is normal to both the longitudinal axis Lv and the first axis Y. The tapered portion 362 has a two-dimensional taper characterized by a linear change in the width W and a linear change in the thickness T. As shown in FIG. 10, the width of the tapered portion 362 increases from a value of W1 at one end of the tapered portion 362 to a value of W2 at the opposite end of the tapered portion 362. The change in width along the longitudinal axis Lv defines the first taper angle Θ. Similarly, as illustrated in FIG. 11, the thickness of the tapered portion 362 increases from a value of T1 at one end of the tapered portion 362 to a value of T2 at the opposite end of the tapered portion 362. The change in thickness along the longitudinal axis Lv defines the second taper angle α.

In the illustrated embodiment, the first taper angle Θ and the second taper angle α are each between 2 and 10 degrees. In some embodiments, the first taper angle Θ is the same as the second taper angle α. In other embodiments, the first taper angle Θ is different from the second taper angle α. Selection of the taper angles can affect the size of the valve member and the nature of the seal formed by the sealing portions 372 and the interior surface 334 of the cylinder head 332. In some embodiments, for example, the taper angles Θ, α can be as high as 90 degrees. In other embodiments, the taper angles Θ, α can be as low as 1 degree. In yet other embodiments, as discussed in more detail herein, a valve member can be devoid of a tapered portion (i.e., a taper angle of zero degrees).

Although the tapered portion 362 is shown and described as having a single, linear taper, in some embodiments a valve member can include a tapered portion having a curved taper. In other embodiments, as discussed in more detail herein, a valve member can have a tapered portion having multiple tapers. Moreover, although the side surfaces 164, 165 are shown as being angularly offset substantially symmetrical to the longitudinal axis Lv, in some embodiments, the side surfaces can be angularly offset in an asymmetrical fashion.

Figure 13:
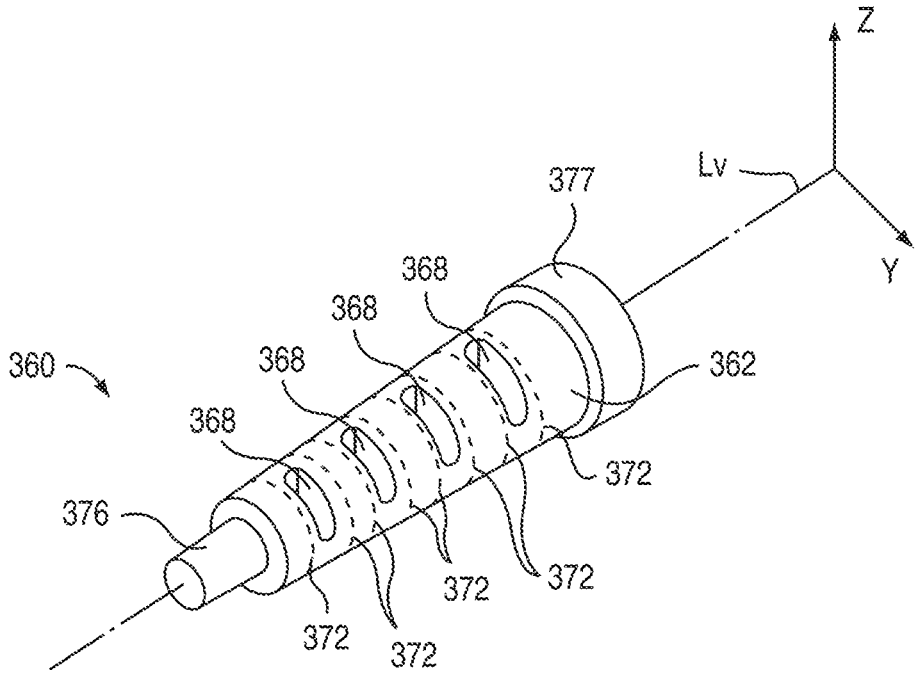
FIG. 13 is a perspective view of the valve member illustrated in FIGS. 10-12.

As shown in FIGS. 10, 11 and 13, the tapered portion 362 includes eight sealing portions 372, each extending continuously around the perimeter of the outer surface 363 of the tapered portion 362. The sealing portions 372 are arranged such that two of the sealing portions 372 are disposed adjacent each flow passage 368. In this manner, as shown in FIG. 8, when the cylinder head assembly 330 is in the closed position each of the sealing portions 372 is in contact with a portion of the interior surface 334 of the cylinder head 332 such that each flow passage 368 is fluidically isolated from the each cylinder flow passage 348 and/or each gas manifold flow passage 344. Conversely, when the cylinder head assembly 330 is in the opened position each of the sealing portions 372 is disposed apart from the interior surface 334 of the cylinder head 332 such that each flow passage 368 is in fluid communication with the corresponding cylinder flow passages 348 and the corresponding gas manifold flow passages 344.

Although the sealing portions 372 are shown and described as extending around the perimeter of the outer surface 363 substantially normal to the longitudinal axis Lv of the valve member 360, in some embodiments, the sealing portions can be at any angular relation to the longitudinal axis Lv. Moreover, in some embodiments, the sealing portions 372 can be angularly offset from each other.

Figure 14:
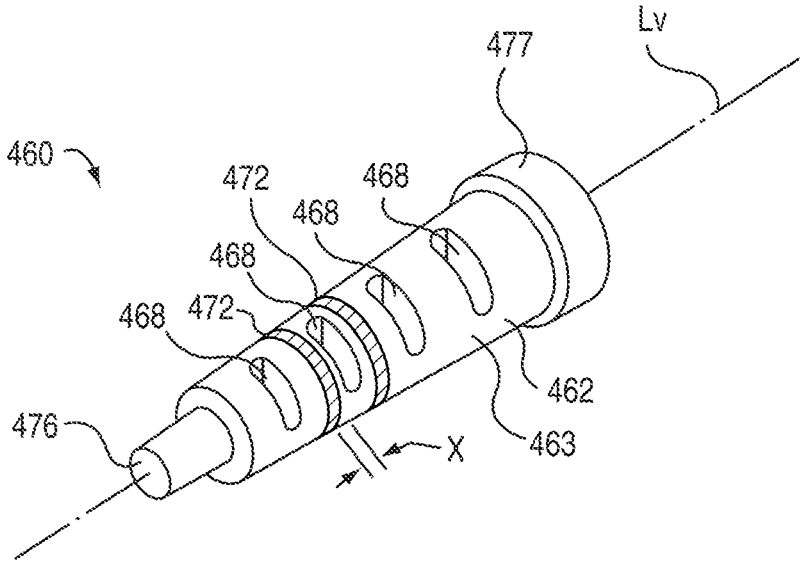
FIG. 14 is a perspective view of a valve member according to an embodiment.

Although the sealing portions 372 are shown and described as being a locus of points continuously extending around the perimeter of the outer surface 363 of the tapered portion 362 in a linear fashion when viewed in a plane parallel to the longitudinal axis Lv and the first axis Y (i.e., FIG. 10), in some embodiments, the sealing portions can continuously extend around the outer surface in a non-linear fashion. For example, in some embodiments, the sealing portions, when viewed in a plane parallel to the longitudinal axis Lv and the first axis Y, can be curved. In other embodiments, for example, as shown in FIG. 14, the sealing portions can be two-dimensional. FIG. 14 shows a valve member 460 having a tapered portion 472, a first stem portion 476 and a second stem portion 477. As described above, the tapered portion includes four flow passages 468 therethrough. The tapered portion also includes two sealing portions 472 disposed about each flow passage 468 and extending continuously around the perimeter of the outer surface 463 of the tapered portion 462 (for clarity, only two sealing portions 472 are shown). In contrast to the sealing portions 372 described above, the sealing portions 472 have a width X as measured along the longitudinal axis Lv of the valve member 460.

As illustrated in FIG. 12, the tapered portion 362 has an elliptical cross-section, which can allow for both a sufficient taper and flow passages of sufficient size. In other embodiments, however, the tapered portion can have any suitable cross-sectional shape, such as, for example, a circular cross-section, a rectangular cross-section and the like.

As shown in FIGS. 10-13, the valve member 360 is monolithically formed to include the first stem portion 376, the second stem portion 377 and the tapered portion 362. In other embodiments, however, the valve member includes separate components coupled together to form the first stem portion, the second stem portion and the tapered portion. In yet other embodiments, the valve member does not include a first stem portion and/or a second stem portion. For example, in some embodiments, a cylinder head assembly includes a separate component disposed within the valve pocket and configured to engage a valve lobe of a camshaft and a portion of a valve member such that a force can be directly transmitted from the camshaft to the valve member. Similarly, in some embodiments, a cylinder head assembly includes a separate component disposed within the valve pocket and configured to engage a spring and a portion of a valve member such that a force can be transmitted from the spring to the valve member.

Although the sealing portions 372 and the outer surface 363 are shown and described as being monolithically constructed, in some embodiments, the sealing portions can be separate components coupled to the outer surface of the tapered portion. For example, in some embodiments, the sealing portions can be sealing rings that are held into mating grooves on the outer surface of the tapered portion by a friction fit. In other embodiments, the sealing portions are separate components that are bonded to the outer surface of the tapered portion by any suitable means, such as, for example, chemical bonding, thermal bonding and the like. In yet other embodiments, the sealing portions include a coating applied to the outer surface of the tapered portion by any suitable manner, such as for example, electrostatic spray deposition, chemical vapor deposition, physical vapor deposition, ionic exchange coating, and the like.

The valve member 360 can be fabricated from any suitable material or combination of materials. For example, in some embodiments, the tapered portion can be fabricated from a first material, the stem portions can be fabricated from a second material different from the first material and the sealing portions, to the extent that they are separately formed, can be fabricated from a third material different from the first two materials. In this manner, each portion of the valve member can be constructed from a material that is best suited for its intended function. For example, in some embodiments, the sealing portions can be fabricated from a relatively soft stainless steel, such as for example, unhardened 430FR stainless steel, so that the sealing portions will readily wear when contacting the interior surface of the cylinder head. In this manner, the valve member can be continuously lapped during use, thereby ensuring a fluid-tight seal. In some embodiments, for example, the tapered portion can be fabricated from a relatively hard material having high strength, such as for example, hardened 440 stainless steel. Such a material can provide the necessary strength and/or hardness to resist failure that may result from repeated exposure to high temperature exhaust gas. In some embodiments, for example, one or both stem portions can be fabricated from a ceramic material configured to have high compressive strength.

In some embodiments, the cylinder head 332, including the interior surface 334 that defines the valve pocket 338, is monolithically constructed from a single material, such as, for example, cast iron. In some monolithic embodiments, for example, the interior surface 334 defining the valve pocket 338 can be machined to provide a suitable surface for engaging the sealing portions 372 of the valve member 360 such that a fluid-tight seal can be formed. In other embodiments, however, the cylinder head can be fabricated from any suitable combination of materials. As discussed in more detail herein, in some embodiments, a cylinder head can include one or more valve inserts disposed within the valve pocket. In this manner, the portion of the interior surface configured to contact the sealing portions of the valve member can be constructed from a material and/or in a manner conducive to providing a fluid-tight seal.

Figure 15:
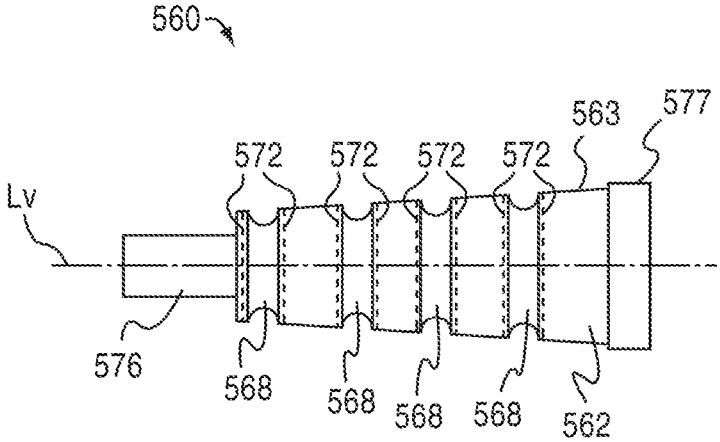
FIGS. 15 and 16 are top and front views, respectively, of a valve member according to an embodiment.
Figure 16:
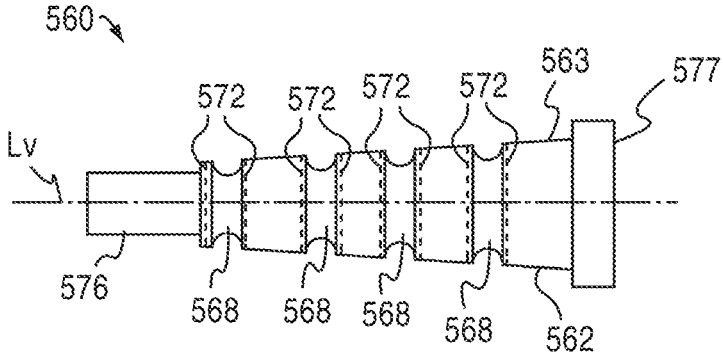

Although the flow passages 368 are shown and described as extending through the tapered portion 362 of the valve member 360 and having a first opening 369 and a second opening 370, in other embodiments, the flow passages do not extend through the valve member. FIGS. 15 and 16 show a top view and a front view, respectively, of a valve member 560 according to an embodiment in which the flow passages 568 extend around an outer surface 563 of the valve member 560. Similar to the valve member 360 described above, the valve member 560 includes a first stem portion 576, a second stem portion 577 and a tapered portion 562. The tapered portion 562 defines four flow passages 568 and eight sealing portions 572, each disposed adjacent to the edges of the flow passages 568. Rather than extending through the tapered portion 562, the illustrated flow passages 568 are recesses in the outer surface 563 that extend continuously around the outer surface 563 of the tapered portion 562.

Figure 24:
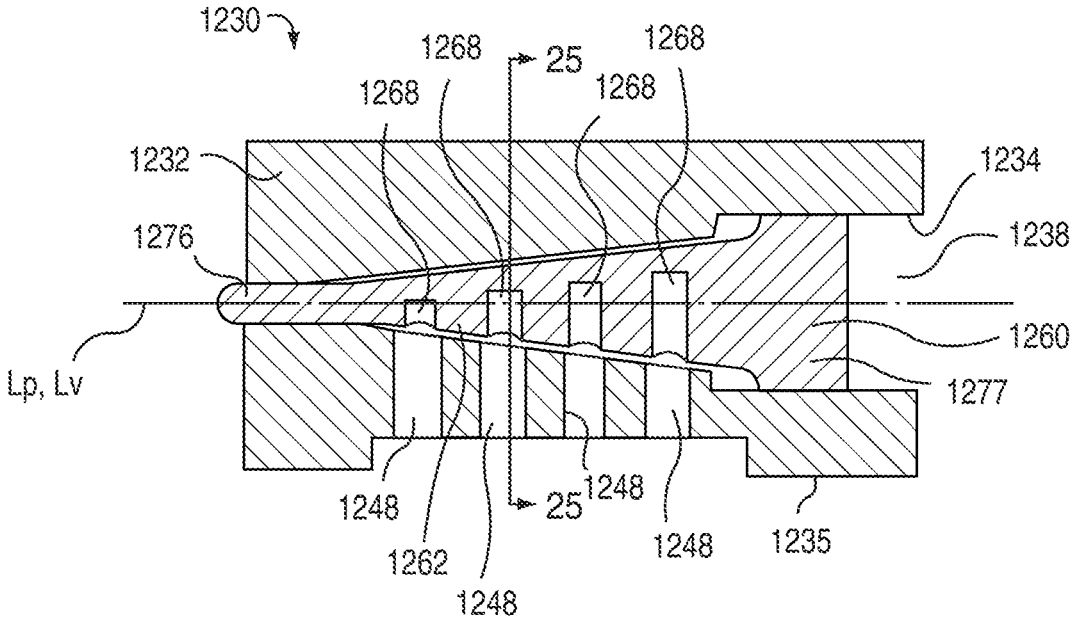
FIGS. 24 and 25 are front cross-sectional and side cross-sectional views, respectively, of a cylinder head assembly according to an embodiment.
Figure 25:
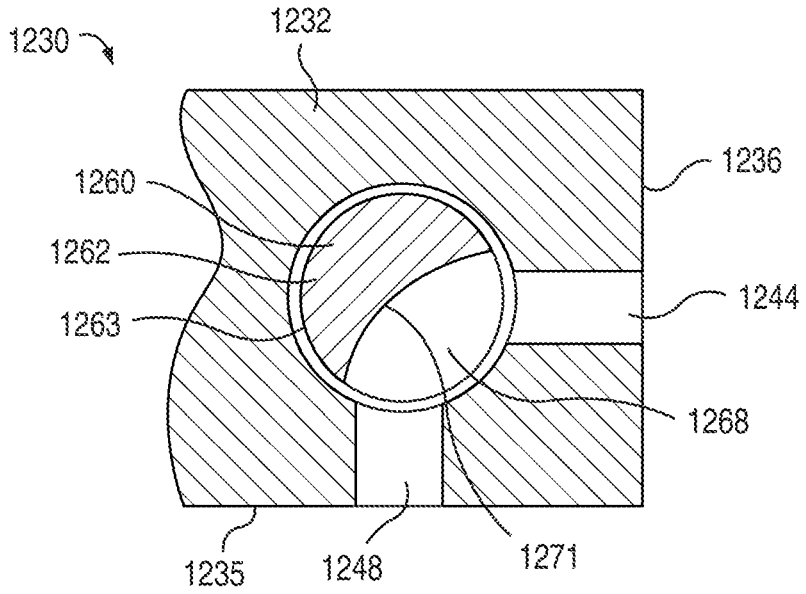

In other embodiments, the flow passages can be recesses that extend only partially around the outer surface of the tapered portion (see FIGS. 24 and 25, discussed in more detail herein). In yet other embodiments, the tapered portion can include any suitable combination of flow passage configurations. For example, in some embodiments, some of the flow passages can be configured to extend through the tapered portion while other flow passages can be configured to extend around the outer surface of the tapered portion.

Figure 17:
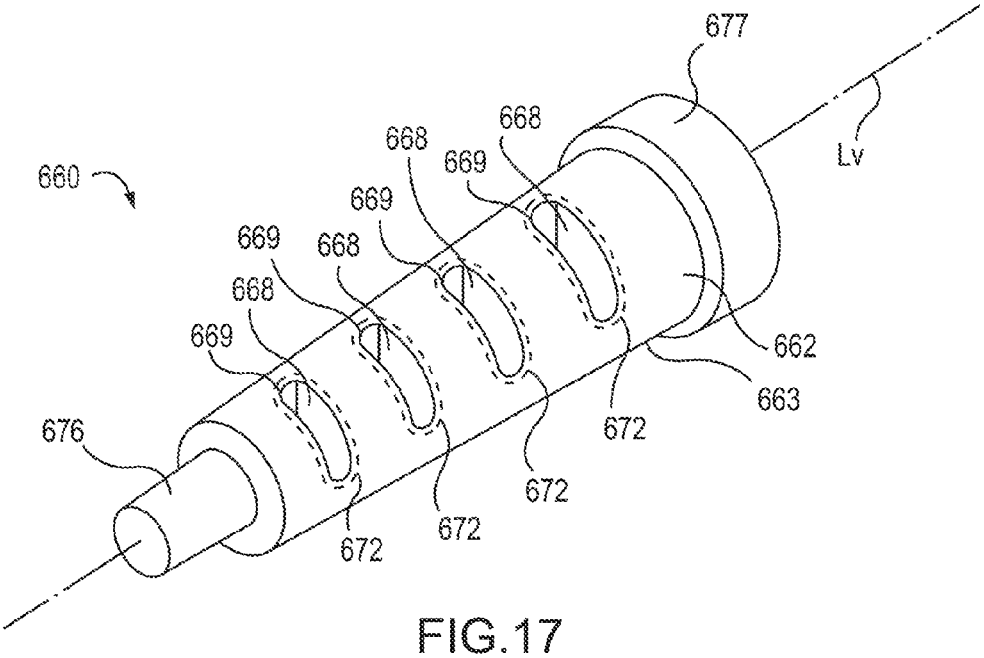
FIG. 17 is a perspective view of a valve member according to an embodiment.

Although the valve members are shown and described above as including multiple sealing portions that extend around the perimeter of the tapered portion, in other embodiments, the sealing portion does not extend around the perimeter of the tapered portion. For example, FIG. 17 shows a perspective view of a valve member 660 according to an embodiment in which the sealing portions 672 extend continuously around the openings 669 of the flow passages 668. Similar to the valve members described above, the valve member 660 includes a first stem portion 676, a second stem portion 677 and a tapered portion 662. The tapered portion 662 defines four flow passages 668 extending therethrough. Each flow passage 668 includes a first opening 669 and a second opening (not shown) disposed opposite the first opening. As described above, the first opening and the second opening of each flow passage 668 are configured to align with corresponding gas manifold flow passages and cylinder flow passages, respectively, defined by the cylinder head (not shown).

The tapered portion 662 includes four sealing portions 672 disposed on the outer surface 663 of the tapered portion 662. Each sealing portion 672 includes a locus of points that extends continuously around a first opening 669. In this arrangement, when the cylinder head assembly is in the closed configuration, the sealing portion 672 contacts a portion of the interior surface (not shown) of the cylinder head (not shown) such that the first opening 669 is fluidically isolated from its corresponding gas manifold flow passage (not shown). Although shown as including four sealing portions 672, each extending continuously around a first opening 669, in some embodiments, the sealing portions can extend continuously around the second opening 670, thereby fluidically isolating the second opening from the corresponding cylinder flow passage when the cylinder head assembly is in the closed configuration. In other embodiments, a valve member can include sealing portions extending around both the first opening 669 and the second opening 670.

Figure 18:
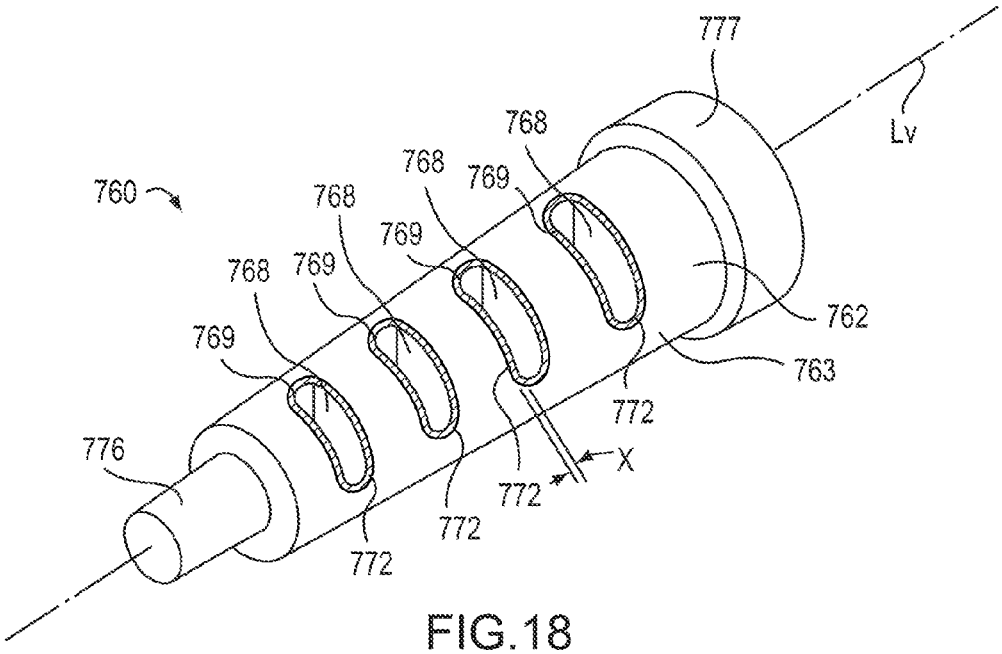
FIG. 18 is a perspective view of a valve member according to an embodiment.

FIG. 18 shows a perspective view of a valve member 760 according to an embodiment in which the sealing portions 772 are two-dimensional. As illustrated, the valve member 760 includes a tapered portion 772, a first stem portion 776 and a second stem portion 777. As described above, the tapered portion includes four flow passages 768 therethrough. The tapered portion also includes four sealing portions 772 each disposed adjacent each flow passage 768 and extending continuously around a first opening 769 of the flow passages 768. The sealing portions 772 differ from the sealing portions 672 described above, in that the sealing portions 772 have a width X as measured along the longitudinal axis Lv of the valve member 760.

Figure 19:
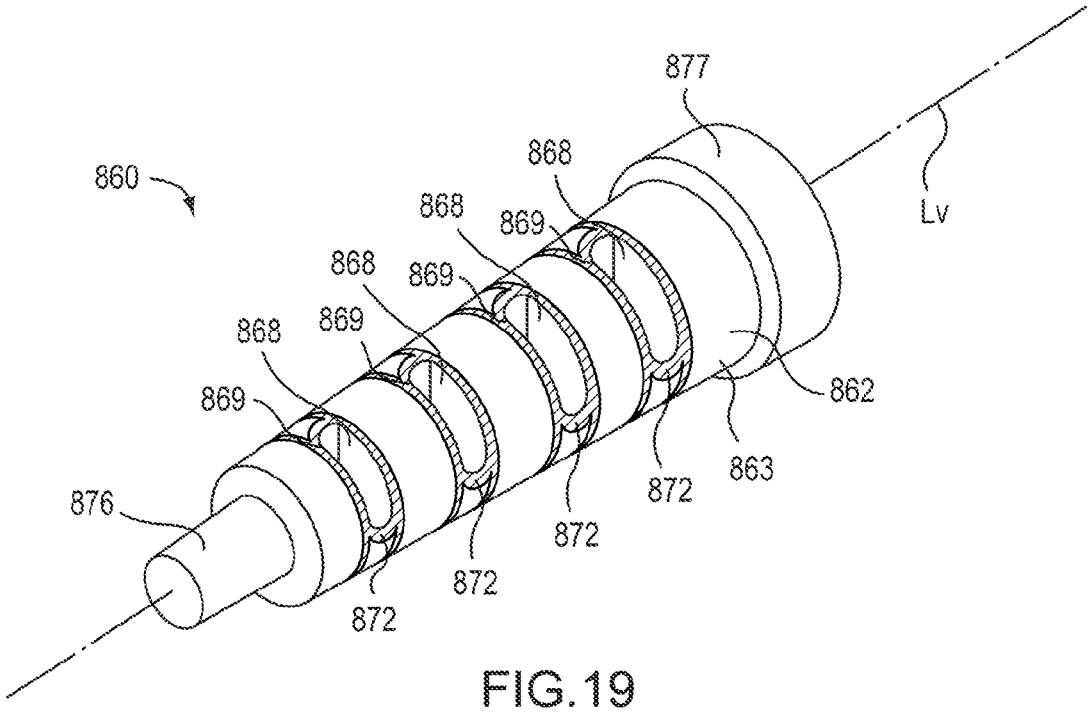
FIG. 19 is a perspective view of a valve member according to an embodiment.

FIG. 19 shows a perspective view of a valve member 860 according to an embodiment in which the sealing portions 872 extend around the perimeter of the tapered portion 862 and extend around the first openings 869. Similar to the valve members described above, the valve member 860 includes a first stem portion 876, a second stem portion 877 and a tapered portion 862. The tapered portion 862 defines four flow passages 868 extending therethrough. Each flow passage 868 includes a first opening 869 and a second opening (not shown) disposed opposite the first opening. The tapered portion 862 includes sealing portions 872 disposed on the outer surface 863 of the tapered portion 862. As shown, each sealing portion 872 extends around the perimeter of the tapered portion 862 and extends around the first openings 869. In some embodiments, the sealing portions can comprise the entire space between adjacent openings.

Figure 20:
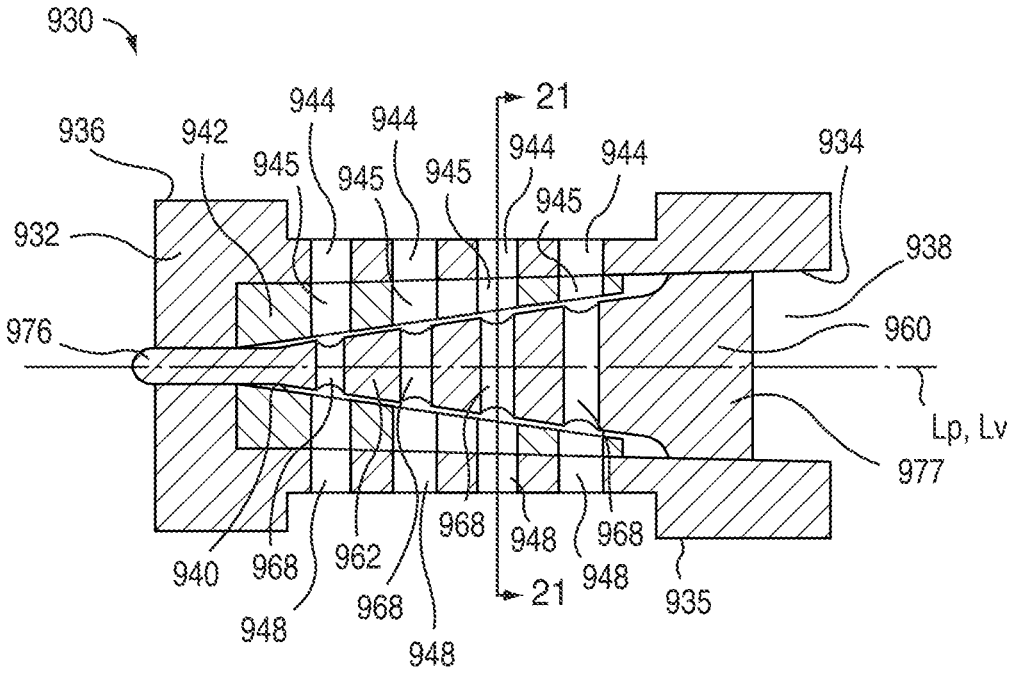
FIGS. 20 and 21 are front cross-sectional and side cross-sectional views, respectively, of a cylinder head assembly according to an embodiment.
Figure 21:
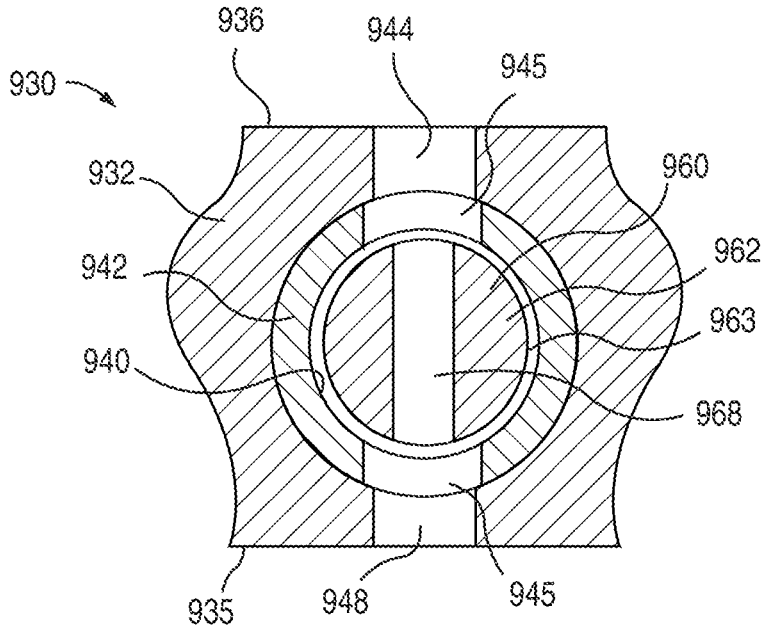

As discussed above, in some embodiments, a cylinder head can include one or more valve inserts disposed within the valve pocket. For example, FIGS. 20 and 21 show a portion of a cylinder head assembly 930 having a valve insert 942 disposed within the valve pocket 938. The illustrated cylinder head assembly 930 includes a cylinder head 932 and a valve member 960. The cylinder head 932 has a first exterior surface 935 configured to be coupled to a cylinder (not shown) and a second exterior surface 936 configured to be coupled to a gas manifold (not shown). The cylinder head 932 has an interior surface 934 that defines a valve pocket 938 having a longitudinal axis Lp. The cylinder head 932 also defines four cylinder flow passages 948 and four gas manifold flow passages 944, configured in a manner similar to those described above.

The valve insert 942 includes a sealing portion 940 and defines four insert flow passages 945 that extend through the valve insert. The valve insert 942 is disposed within the valve pocket 938 such that a first portion of each insert flow passage 945 is aligned with one of the gas manifold flow passages 944 and a second portion of each insert flow passage 945 is aligned with one of the cylinder flow passages 948.

The valve member 960 has a tapered portion 962, a first stem portion 976 and a second stem portion 977. The tapered portion 962 has an outer surface 963 and defines four flow passages 968 extending therethrough, as described above. The tapered portion 962 also includes multiple sealing portions (not shown) each of which is disposed adjacent one of the flow passages 968. The sealing portions can be of any type discussed above. The valve member 960 is disposed within the valve pocket 938 such that the tapered portion 962 of the valve member 960 can be moved along a longitudinal axis Lv of the valve member 960 within the valve pocket 938 between an opened position (FIGS. 20 and 21) and a closed position (not shown). When in the opened position, the valve member 960 is positioned within the valve pocket 938 such that each flow passage 968 is aligned with and in fluid communication with one of the insert flow passages 945, one of the cylinder flow passages 948 and one of the gas manifold flow passages 944. Conversely, when in the closed position, the valve member 960 is positioned within the valve pocket 938 such that the sealing portions are in contact with the sealing portion 940 of the valve insert 942. In this manner, the flow passages 968 are fluidically isolated from the cylinder flow passages 948 and/or the gas manifold flow passages 944.

As shown in FIG. 21, the valve pocket 938, the valve insert 942 and the valve member 960 all have a circular cross-sectional shape. In other embodiments, the valve pocket can have a non-circular cross-sectional shape. For example, in some embodiments, the valve pocket can include an alignment surface configured to mate with a corresponding alignment surface on the valve insert. Such an arrangement may be used, for example, to ensure that the valve insert is properly aligned (i.e., that the insert flow passages 945 are rotationally aligned to be in fluid communication with the gas manifold flow passages 944 and the cylinder flow passages 948) when the valve insert 942 is installed into the valve pocket 938. In other embodiments, the valve pocket, the valve insert and/or the valve member can have any suitable cross-sectional shape.

The valve insert 942 can be coupled within the valve pocket 938 using any suitable method. For example, in some embodiments, the valve insert can have an interference fit with the valve pocket. In other embodiments, the valve insert can be secured within the valve pocket by a weld, by a threaded coupling arrangement, by peening a surface of the valve pocket to secure the valve insert, or the like.

Figure 22:
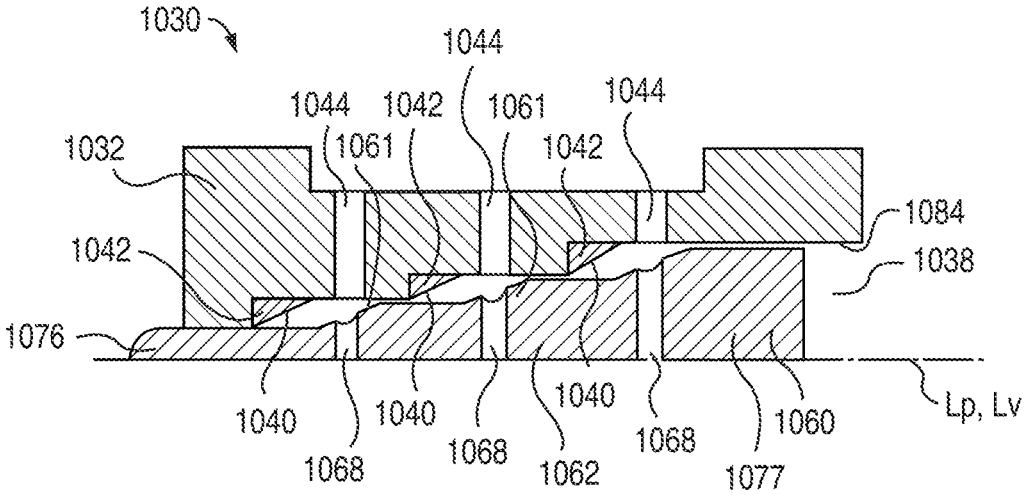
FIG. 22 is a front cross-sectional view of a portion of a cylinder head assembly according to an embodiment.

FIG. 22 shows a cross-sectional view of a portion of a cylinder head assembly 1030 according to an embodiment that includes multiple valve inserts 1042. Although FIG. 22 only shows one half of the cylinder head assembly 1030, one skilled in the art should recognize that the cylinder head assembly is generally symmetrical about the longitudinal axis Lp of the valve pocket, and is similar to the cylinder head assemblies shown and described above. The illustrated cylinder head assembly 1030 includes a cylinder head 1032 and a valve member 1060. As described above, the cylinder head 1032 can be coupled to at least one cylinder and at least one gas manifold. The cylinder head 1032 has an interior surface 1034 that defines a valve pocket 1038 having a longitudinal axis Lp. The cylinder head 1032 also defines three cylinder flow passages (not shown) and three gas manifold flow passages 1044.

As shown, the valve pocket 1038 includes several discontinuous, stepped portions. Each stepped portion includes a surface substantially parallel to the longitudinal axis Lp, through which one of the gas manifold passages 1044 extends. A valve insert 1042 is disposed within each discontinuous, stepped portion of the valve pocket 1038 such that a sealing portion 1040 of the valve insert 1042 is adjacent the tapered portions 1061 of the valve member 1060. In this arrangement, the valve inserts 1042 are not disposed about the gas manifold flow passages 1044 and therefore do not have an insert flow passage of the type described above.

The valve member 1060 has a central portion 1062, a first stem portion 1076 and a second stem portion 1077. The central portion 1062 includes three tapered portions 1061, each disposed adjacent a surface that is substantially parallel to the longitudinal axis of the valve member Lv. The central portion 1062 defines three flow passages 1068 extending therethrough and having an opening disposed on one of the tapered portions 1061. Each tapered portion 1061 includes one or more sealing portions of any type discussed above. The valve member 1060 is disposed within the valve pocket 1038 such that the central portion 1062 of the valve member 1060 can be moved along a longitudinal axis Lv of the valve member 1060 within the valve pocket 1038 between an opened position (shown in FIG. 22) and a closed position (not shown). When in the opened position, the valve member 1060 is positioned within the valve pocket 1038 such that each flow passage 1068 is aligned with and in fluid communication with one of the cylinder flow passages (not shown) and one of the gas manifold flow passages 1044. Conversely, when in the closed position, the valve member 1060 is positioned within the valve pocket 1038 such that the sealing portions on the tapered portions 1061 are in contact with the sealing portion 1040 of the corresponding valve insert 1042. In this manner, the flow passages 1068 are fluidically isolated from the gas manifold flow passages 1044 and/or the cylinder flow passages (not shown).

Figure 23:
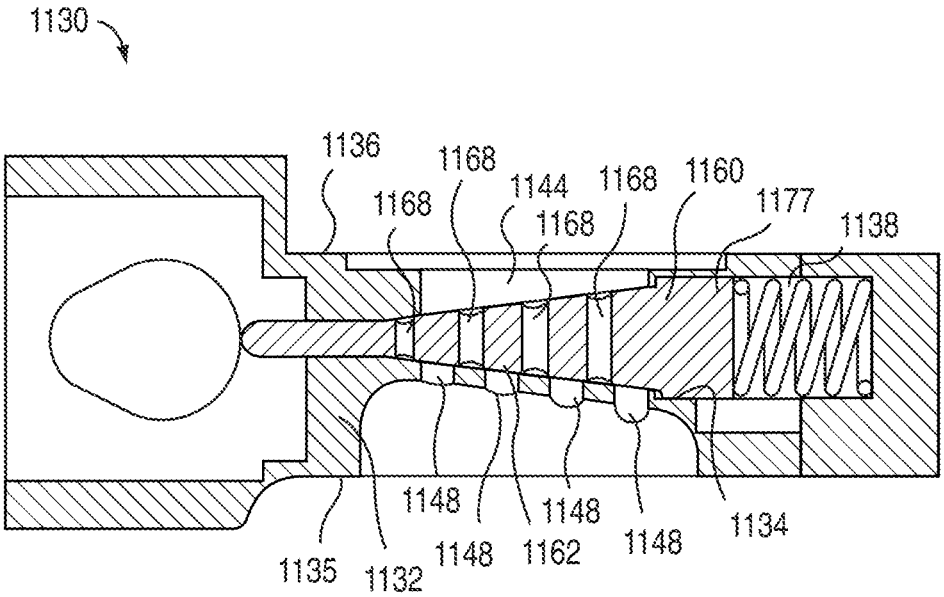
FIG. 23 is a front cross-sectional view of a cylinder head assembly according to an embodiment.

Although the cylinder heads are shown and described above as having the same number of gas manifold flow passages and cylinder flow passages, in some embodiments, a cylinder head can have fewer gas manifold flow passages than cylinder flow passages or vice versa. For example, FIG. 23 shows a cylinder head assembly 1160 according to an embodiment that includes a four cylinder flow passages 1148 by only one gas manifold flow passage 1144. The illustrated cylinder head assembly 1130 includes a cylinder head 1132 and a valve member 1160. The cylinder head 1132 has a first exterior surface 1135 configured to be coupled to a cylinder (not shown) and a second exterior surface 1136 configured to be coupled to a gas manifold (not shown). The cylinder head 1132 has an interior surface 1134 that defines a valve pocket 1138 within which the valve member 1160 is disposed. As shown, the cylinder head 1132 defines four cylinder flow passages 1148 and one gas manifold flow passage 1144, configured similar to those described above.

The valve member 1160 has a tapered portion 1162, a first stem portion 1176 and a second stem portion 1177. The tapered portion 1162 defines four flow passages 1168 extending therethrough, as described above. The tapered portion 1162 also includes multiple sealing portions each of which is disposed adjacent one of the flow passages 1168. The sealing portions can be of any type discussed above.

The cylinder head assembly 1130 differs from those described above in that when the cylinder head assembly 1130 is in the closed configuration (see FIG. 23), the flow passages 1168 are not fluidically isolated from the gas manifold flow passage 1144. Rather, the flow passages 1168 are only isolated from the cylinder flow passages 1148, in a manner described above.

Although the engines are shown and described as having a cylinder coupled to a first surface of a cylinder head and a gas manifold coupled to a second surface of a cylinder head, wherein the second surface is opposite the first surface thereby producing a "straight flow" configuration, the cylinder and the gas manifold can be arranged in any suitable configuration. For example, in some instances, it may be desirable for the gas manifold to be coupled to a side surface 1236 of a the cylinder head. FIGS. 24 and 25 show a cylinder head assembly 1230 according to an embodiment in which the cylinder flow passages 1248 are substantially normal to the gas manifold flow passages 1244. In this manner, a gas manifold (not shown) can be mounted on a side surface 1236 of the cylinder head 1232.

The illustrated cylinder head assembly 1230 includes a cylinder head 1232 and a valve member 1260. The cylinder head 1232 has a bottom surface 1235 configured to be coupled to a cylinder (not shown) and a side surface 1236 configured to be coupled to a gas manifold (not shown). The side surface 1236 is disposed adjacent to and substantially normal to the bottom surface 1235. In other embodiments, the side surface can be angularly offset from the bottom surface by an angle other than 90 degrees. The cylinder head 1232 has an interior surface 1234 that defines a valve pocket 1238 having a longitudinal axis Lp. The cylinder head 1232 also defines four cylinder flow passages 1248 and four gas manifold flow passages 1244. The cylinder flow passages 1248 and the gas manifold flow passages 1244 differ from those previously discussed in that the cylinder flow passages 1248 are substantially normal to the gas manifold flow passages 1244.

The valve member 1260 has a tapered portion 1262, a first stem portion 1276 and a second stem portion 1277. The tapered portion 1262 includes an outer surface 1263 and defines four flow passages 1268. The flow passages 1268 are not lumens that extend through the tapered portion 1262, but rather are recesses in the tapered portion 1262 that extend partially around the outer surface 1263 of the tapered portion 1262. The flow passages 1268 include a curved surface 1271 to direct the flow of gas through the valve member 1260 in a manner that minimizes the flow losses. In some embodiments, a surface 1271 of the flow passages 1268 can be configured to produce a desired flow characteristic, such as, for example, a rotational flow pattern in the incoming and/or outgoing flow.

The tapered portion 1262 also includes multiple sealing portions (not shown) each of which is disposed adjacent one of the flow passages 1268. The sealing portions can be of any type discussed above. The valve member 1260 is disposed within the valve pocket 1238 such that the tapered portion 1262 of the valve member 1260 can be moved along a longitudinal axis Lv of the valve member 1260 within the valve pocket 1238 between an opened position (FIGS. 24 and 25) and a closed position (not shown), as described above.

Figure 26:
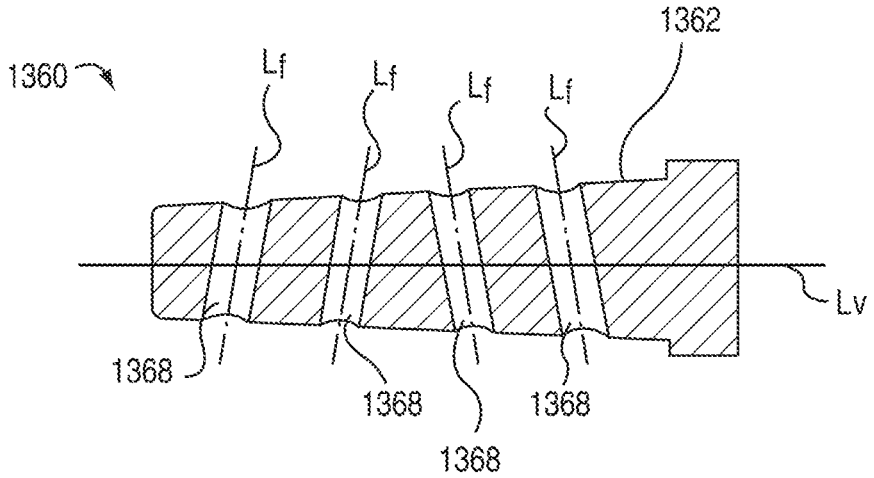
FIG. 26 is a cross-sectional view of a valve member according to an embodiment.

Although the flow passages defined by the valve member have been shown and described as being substantially parallel to each other and substantially normal to the longitudinal axis of the valve member, in some embodiments the flow passages can be angularly offset from each other and/or can be offset from the longitudinal axis of the valve member by an angle other than 90 degrees. Such an offset may be desirable, for example, to produce a desired flow characteristic, such as, for example, swirl or tumble pattern in the incoming and/or outgoing flow. FIG. 26 shows a cross-sectional view of a valve member 1360 according to an embodiment in which the flow passages 1368 are angularly offset from each other and are not normal to the longitudinal axis Lv. Similar to the valve members described above, the valve member 1360 includes a tapered portion 1362 that defines four flow passages 1368 extending therethrough. Each flow passage 1368 has a longitudinal axis Lf. As illustrated, the longitudinal axes Lf are angularly offset from each other. Moreover, the longitudinal axes Lf are offset from the longitudinal axis of the valve member by an angle other than 90 degrees.

Although the flow passages 1368 are shown and described as having a linear shape and defining a longitudinal axis Lf, in other embodiments, the flow passages can have a curved shape characterized by a curved centerline. As described above, flow passages can be configured to have a curved shape to produce a desired flow characteristic in the gas entering and/or exiting the cylinder.

Figure 27:
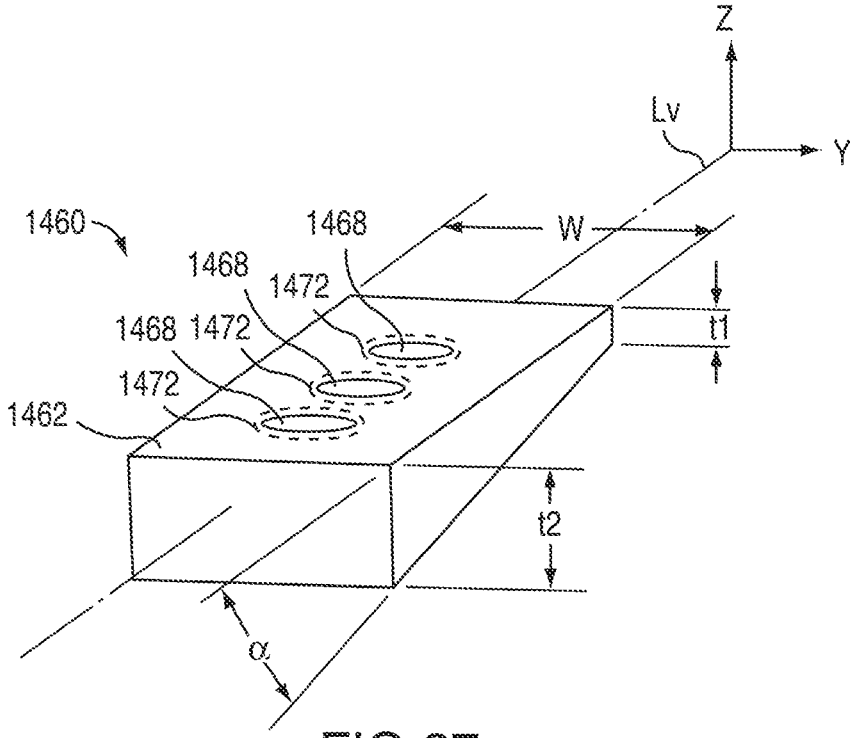
FIG. 27 is a perspective view of a valve member according to an embodiment having a one-dimensional tapered portion.

FIG. 27 is a perspective view of a valve member 1460 according to an embodiment that includes a one-dimensional tapered portion 1462. The illustrated valve member 1460 includes a tapered portion 1462 that defines three flow passages 1468 extending therethrough. The tapered portion includes three sealing portions 1472, each of which is disposed adjacent one of the flow passages 1468 and extends continuously around an opening of the flow passage 1468.

The tapered portion 1462 of the valve member 1460 has a width W measured along a first axis Y that is normal to a longitudinal axis Lv of the tapered portion 1462. Similarly, the tapered portion 1462 has a thickness T measured along a second axis Z that is normal to both the longitudinal axis Lv and the first axis Y. The tapered portion 1462 has a one-dimensional taper characterized by a linear change in the thickness T. Conversely, the width W remains constant along the longitudinal axis Lv. As shown, the thickness of the tapered portion 1462 increases from a value of T1 at one end of the tapered portion 1462 to a value of T2 at the opposite end of the tapered portion 1462. The change in thickness along the longitudinal axis Lv defines a taper angle $\alpha$.

Figure 28:
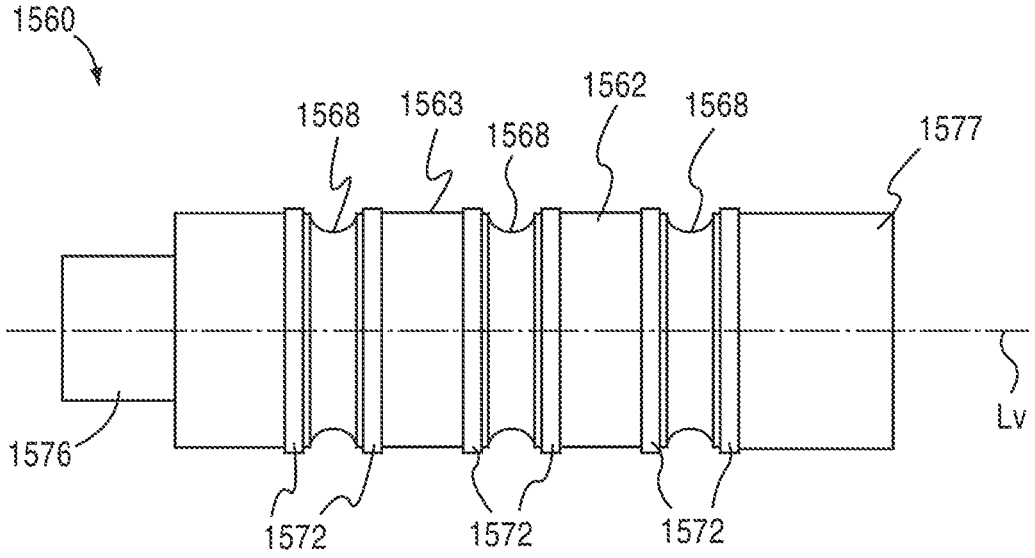
FIG. 28 is a front view of a valve member according to an embodiment.

Although the valve members have been shown and described as including at least one tapered portion that includes one or more sealing portions, in some embodiments, a valve member can include a sealing portion disposed on a non-tapered portion of the valve member. In other embodiments, a valve member can be devoid of a tapered portion. FIG. 28 is a front view of a valve member 1560 that is devoid of a tapered portion. The illustrated valve member 1560 has a central portion 1562, a first stem portion 1576 and a second stem portion 1577. The central portion 1562 has an outer surface 1563 and defines three flow passages 1568 extending continuously around the outer surface 1563 of the central portion 1562, as described above. The central portion 1562 also includes multiple sealing portions 1572 each of which is disposed adjacent one of the flow passages 1568 and extends continuously around the perimeter of the central portion 1562.

In a similar manner as described above, the valve member 1560 is disposed within a valve pocket (not shown) such that the central portion 1562 of the valve member 1560 can be moved along a longitudinal axis Lv of the valve member 1560 within the valve pocket between an opened position and a closed position. When in the opened position, the valve member 1560 is positioned within the valve pocket such that each flow passage 1568 is aligned with and in fluid communication with the corresponding cylinder flow passages and gas manifold flow passages (not shown). Conversely, when in the closed position, the valve member 1560 is positioned within the valve pocket such that the sealing portions 1572 are in contact with a portion of the interior surface of the cylinder head, thereby are fluidically isolating the flow passages 1568.

As described above, the sealing portions 1572 can be, for example, sealing rings that are disposed within a groove defined by the outer surface of the valve member. Such sealing rings can be, for example, spring-loaded rings, which are configured to expand radially, thereby ensuring contact with the interior surface of the cylinder head when the valve member 1560 is in the closed position.

Figure 29:
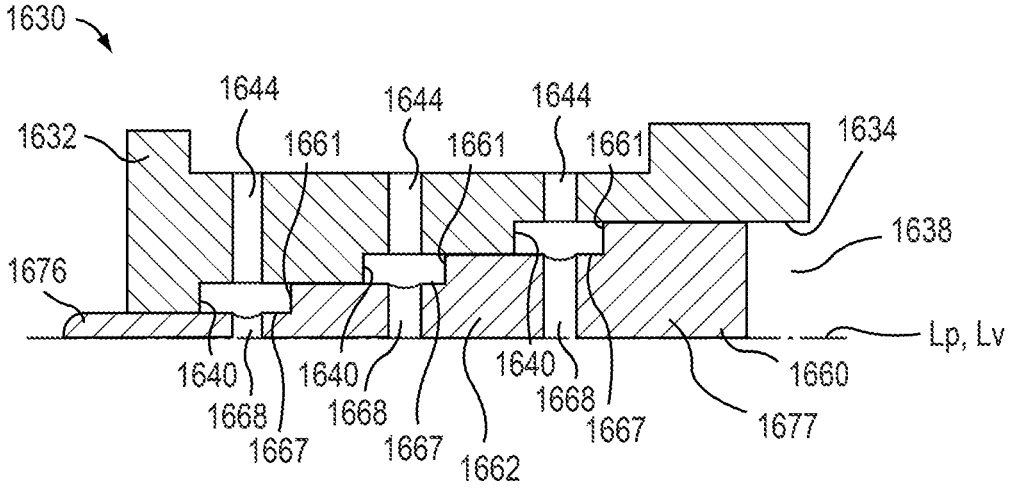
FIGS. 29 and 30 are front cross-sectional views of a portion of a cylinder head assembly according to an embodiment in a first configuration and a second configuration, respectively.
Figure 30:
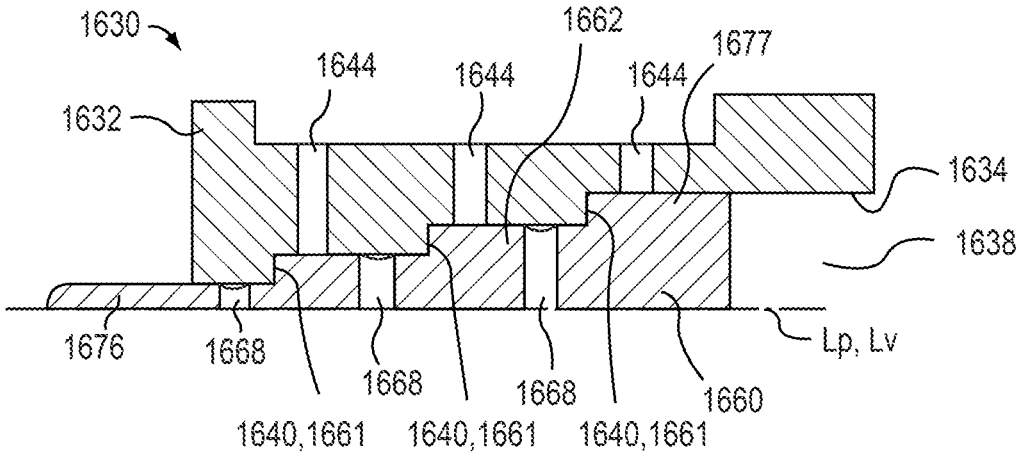

Conversely, FIGS. 29 and 30 show portion of a cylinder head assembly 1630 that includes multiple 90 degree tapered portions 1631 in a first and second configuration, respectively. Although FIGS. 29 and 30 only show one half of the cylinder head assembly 1630, one skilled in the art should recognize that the cylinder head assembly is generally symmetrical about the longitudinal axis Lp of the valve pocket, and is similar to the cylinder head assemblies shown and described above. The illustrated cylinder head assembly 1630 includes a cylinder head 1632 and a valve member 1660. The cylinder head 1632 has an interior surface 1634 that defines a valve pocket 1638 having a longitudinal axis Lp and several discontinuous, stepped portions. The cylinder head 1632 also defines three cylinder flow passages (not shown) and three gas manifold flow passages 1644.

The valve member 1660 has a central portion 1662, a first stem portion 1676 and a second stem portion 1677. The central portion 1662 includes three tapered portions 1661 and three non-tapered portions 1667. The tapered portions 1661 each have a taper angle of 90 degrees (i.e., substantially normal to the longitudinal axis Lv). Each tapered portion 1661 is disposed adjacent one of the non-tapered portions 1667. The central portion 1662 defines three flow passages 1668 extending therethrough and having an opening disposed on one of the non-tapered portions 1667. Each tapered portion 1661 includes a sealing portion that extends around the perimeter of the outer surface of the valve member 1660.

The valve member 1660 is disposed within the valve pocket 1638 such that the central portion 1662 of the valve member 1660 can be moved along a longitudinal axis Lv of the valve member 1660 within the valve pocket 1638 between an opened position (shown in FIG. 29) and a closed position (shown in FIG. 30). When in the opened position, the valve member 1660 is positioned within the valve pocket 1638 such that each flow passage 1668 is aligned with and in fluid communication with one of the cylinder flow passages (not shown) and one of the gas manifold flow passages 1644. Conversely, when in the closed position, the valve member 1660 is positioned within the valve pocket 1638 such that the sealing portions on the tapered portions 1661 are in contact with a corresponding sealing portion 1640 defined by the valve pocket 1638. In this manner, the flow passages 1668 are fluidically isolated from the gas manifold flow passages 1644 and/or the cylinder flow passages (not shown).

Although some of the valve members are shown and described as including a first stem portion configured to engage a camshaft and a second stem portion configured to engage a spring, in some embodiments, a valve member can include a first stem portion configured to engage a biasing member and a second stem portion configured to engage an actuator. In other embodiments, an engine can include two camshafts, each configured to engage one of the stem portions of the valve member. In this manner, the valve member can be biased in the closed position by a valve lobe on the camshaft rather than a spring. In yet other embodiments, an engine can include one camshaft and one actuator, such as, for example, a pneumatic actuator, a hydraulic actuator, an electronic solenoid actuator or the like.

Figure 31:
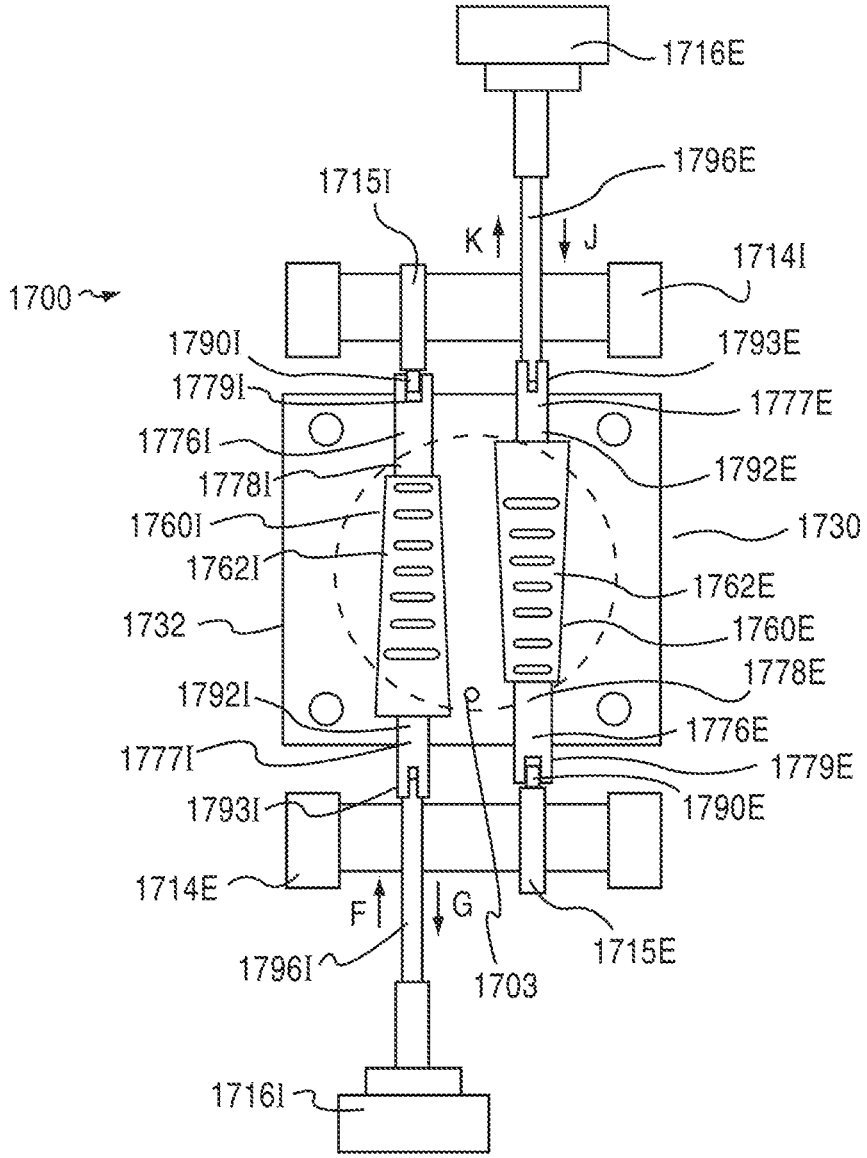
FIG. 31 is a top view of a portion of an engine according to an embodiment.

FIG. 31 is a top view of a portion of an engine 1700 according to an embodiment that includes both camshafts 1714 and solenoid actuators 1716 configured to move the valve member 1760. The engine 1700 includes a cylinder 1703, a cylinder head assembly 1730 and a gas manifold (not shown). The cylinder head assembly 1730 includes a cylinder head 1732, an intake valve member 1760I and an exhaust valve member 1760E. The cylinder head 1732 can include any combination of the features discussed above, such as, for example, an intake valve pocket, an exhaust valve pocket, multiple cylinder flow passages, at least one manifold flow passage and the like.

The intake valve member 1760I has tapered portion 1762I, a first stem portion 1776I and a second stem portion 1777I. The first stem portion 1776I has a first end 1778I and a second end 1779I. Similarly, the second stem portion 1777I has a first end 1792I and a second end 1793I. The first end 1778I of the first stem portion 1776I is coupled to the tapered portion 1762I. The second end 1779I of the first stem portion 1776I includes a roller-type follower 1790I configured to engage an intake valve lobe 1715I of an intake camshaft 1714I. The first end 1792I of the second stem portion 1777I is coupled to the tapered portion 1762I. The second end 1793I of the second stem portion 1777I is coupled to an actuator linkage 1796I, which is coupled a solenoid actuator 1716I.

Similarly, the exhaust valve member 1760E has tapered portion 1762E, a first stem portion 1776E and a second stem portion 1777E. A first end 1778E of the first stem portion 1776E is coupled to the tapered portion 1762E. A second end 1779E of the first stem portion 1776E includes a roller-type follower 1790E configured to engage an exhaust valve lobe 1715E of an exhaust camshaft 1714E. A first end 1792E of the second stem portion 1777E is coupled to the tapered portion 1762E. A second end 1793E of the second stem portion 1777E is coupled to an actuator linkage 1796E, which is coupled a solenoid actuator 1716E.

In this arrangement, the valve members 1760I, 1760E can be moved by the intake valve lobe 1715I and the exhaust valve lobe 1715E, respectively, as described above. Additionally, the solenoid actuators 1716I, 1716E can supply a biasing force to bias the valve members 1760I, 1760E in the closed position, as indicated by the arrows F (intake) and J (exhaust). Moreover, in some embodiments, the solenoid actuators 1716I, 1716E can be used to override the standard valve timing as prescribed by the valve lobes 1715I, 1715E, thereby allowing the valves 1760I, 1760E to remain open for a greater duration (as a function of crank angle and/or time).

Although the engine 1700 is shown and described as including a solenoid actuator 1716 and a camshaft 1714 for controlling the movement of the valve members 1760, in other embodiments, an engine can include only a solenoid actuator for controlling the movement of each valve member. In such an arrangement, the absence of a camshaft allows the valve members to be opened and/or closed in any number of ways to improve engine performance. For example, as discussed in more detail herein, in some embodiments the intake and/or exhaust valve members can be cycled opened and closed multiple times during an engine cycle (i.e., 720 crank degrees for a four stroke engine). In other embodiments, the intake and/or exhaust valve members can be held in a closed position throughout an entire engine cycle.

The cylinder head assemblies shown and described above are particularly well suited for camless actuation and/or actuation at any point in the engine operating cycle. More specifically, as previously discussed, because the valve members shown and described above do not extend into the combustion chamber when in their opened position, they will not contact the piston at any time during engine operation. Accordingly, the intake and/or exhaust valve events (i.e., the point at which the valves open and/or close as a function of the angular position of the crankshaft) can be configured independently from the position of the piston (i.e., without considering valve-to-piston contact as a limiting factor). For example, in some embodiments, the intake valve member and/or the exhaust valve member can be fully opened when the piston is at top dead center (TDC).

Moreover, the valve members shown and described above can be actuated with relatively little power during engine operation, because the opening of the valve members is not opposed by cylinder pressure, the stroke of the valve members is relatively low and/or the valve springs opposing the opening of the valves can have relatively low biasing force. For example, as discussed above, the stroke of the valve members can be reduced by including multiple flow passages therein and reducing the spacing between the flow passages. In some embodiments, the stroke of a valve member can be 2.3 mm (0.090 in.).

In addition to directly reducing the power required to open the valve member, reducing the stroke of the valve member can also indirectly reduce the power requirements by allowing the use of valve springs having a relatively low spring force. In some embodiments, the spring force can be selected to ensure that a portion of the valve member remains in contact with the actuator during valve operation and/or to ensure that the valve member does not repeatedly oscillate along its longitudinal axis when opening and/or closing. Said another way, the magnitude of the spring force can be selected to prevent valve "bounce" during operation. In some embodiments, reducing the stroke of the valve member can allow for the valve member to be opened and/or closed with reduced velocity, acceleration and jerk (i.e., the first derivative of the acceleration) profiles, thereby minimizing the impact forces and/or the tendency for the valve member to bounce during operation. As a result, some embodiments, the valve springs can be configured to have a relatively low spring force. For example, in some embodiments, a valve spring can be configured to exert a spring force of 110 N (50 lbf) when the valve member is both in the closed position and the opened position.

As a result of the reduced power required to actuate the valve members 1760I, 1760E, in some embodiments, the solenoid actuators 1716I, 1716E can be 12 volt actuators requiring relatively low current. For example, in some embodiments, the solenoid actuators can operate on 12 volts with a current draw during valve opening of between 14 and 15 amperes of current. In other embodiments, the solenoid actuators can be 12 volt actuators configured to operate on a high voltage and/or current during the initial valve member opening event and a low voltage and/or current when holding the valve member open. For example, in some embodiments, the solenoid actuators can operate on a "peak and hold" cycle that provides an initial voltage of between 70 and 90 volts during the first 100 microseconds of the valve opening event.

In addition to reducing engine parasitic losses, the reduced power requirements and/or reduced valve member stroke also allow greater flexibility in shaping the valve events. For example, in some embodiments the valve members can be configured to open and/or close such that the flow area through the valve member as a function of the crankshaft position approximates a square wave.

Figure 32:
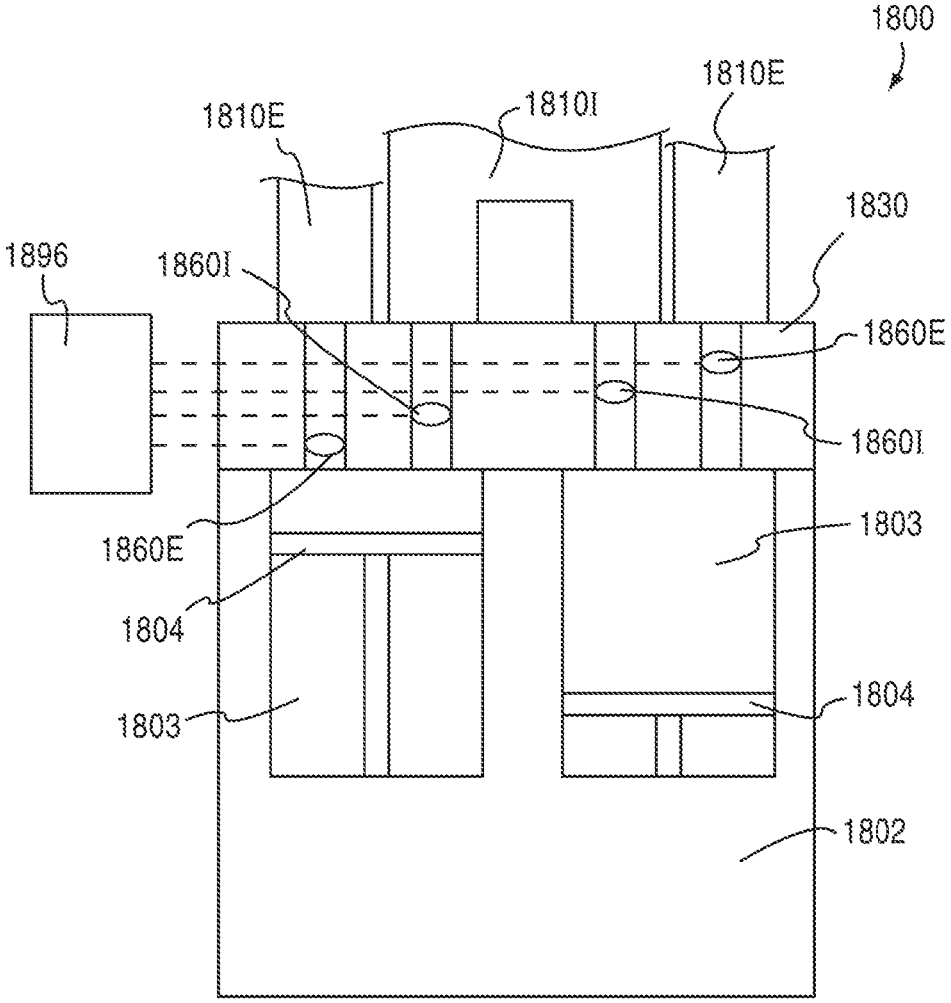
FIG. 32 is a schematic illustrating a portion of an engine according to an embodiment.

As described above, in some embodiments, the intake valve member and/or the exhaust valve member can be held open for longer durations, opened and closed multiple times during an engine cycle and the like. FIG. 32 is a schematic of a portion of an engine 1800 according to an embodiment. The engine 1800 includes an engine block 1802 defining two cylinders 1803. The cylinders 1803 can be, for example, two cylinders of a four cylinder engine. A reciprocating piston 1804 is disposed within each cylinder 1803, as described above. A cylinder head 1830 is coupled to the engine block 1802. Similar to the cylinder head assemblies described above, the cylinder head 1830 includes two electronically actuated intake valves 1860I and two electronically actuated exhaust valves 1860E. The intake valves 1860I are configured to control the flow of gas between an intake manifold 1810I and each cylinder 1803. Similarly, the exhaust valves 1860E control the exchange of gas between an exhaust manifold 1810E and each cylinder.

The engine 1800 includes an electronic control unit (ECU) 1896 in communication with each of the intake valves 1860I and the exhaust valves 1860E. The ECU is processor of the type known in the art configured to receive input from various sensors, determine the desired engine operating conditions and convey signals to various actuators to control the engine accordingly. In the illustrated embodiment, the ECU 1896 is configured determine the appropriate valve events and provide an electronic signal to each of the valves 1860I, 1860E so that the valves open and close as desired.

The ECU 1896 can be, for example, a commercially-available processing device configured to perform one or more specific tasks related to controlling the engine 1800. For example, the ECU 1896 can include a microprocessor and a memory device. The microprocessor can be, for example, an application-specific integrated circuit (ASIC) or a combination of ASICs, which are designed to perform one or more specific functions. In yet other embodiments, the microprocessor can be an analog or digital circuit, or a combination of multiple circuits. The memory device can include, for example, a read only memory (ROM) component, a random access memory (RAM) component, electronically programmable read only memory (EPROM), erasable electronically programmable read only memory (EEPROM), and/or flash memory.

Although the engine 1800 is illustrated and described as including an ECU 1896, in some embodiments, an engine 1800 can include software in the form of processor-readable code instructing a processor to perform the functions described herein. In other embodiments, an engine 1800 can include firmware that performs the functions described herein.

Figure 33:
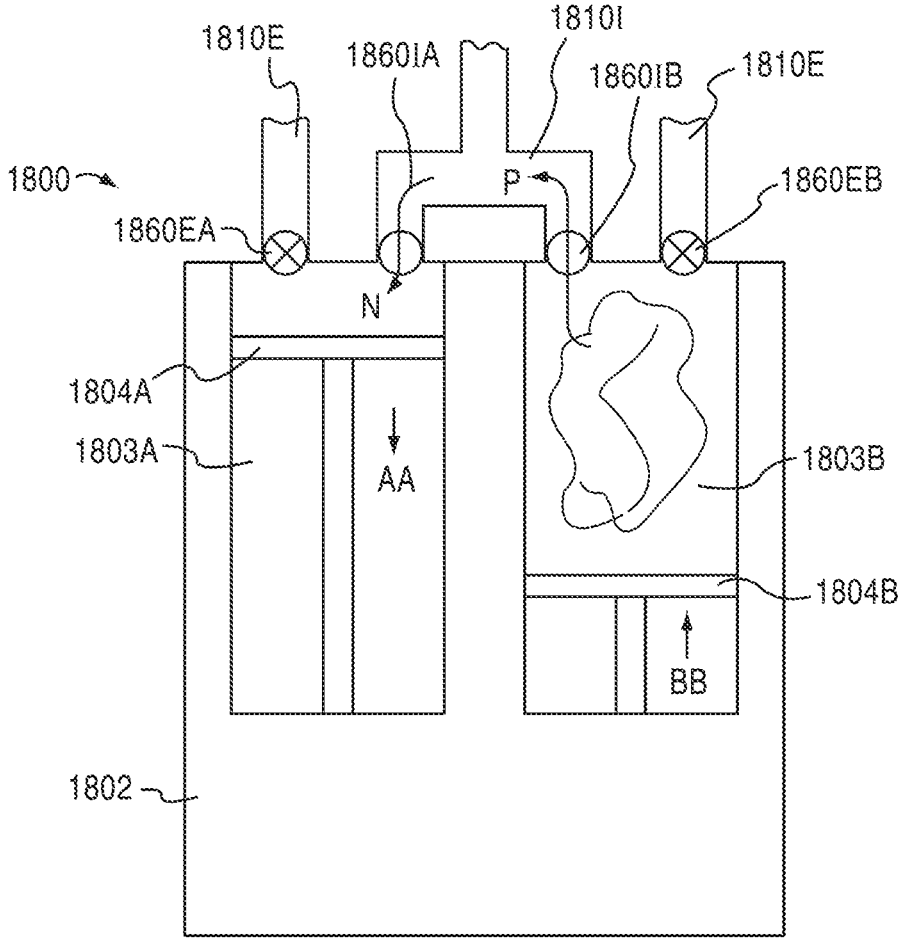
FIG. 33 is a schematic illustrating a portion of the engine shown in FIG. 32 operating in a pumping assist mode.

FIG. 33 is a schematic of a portion of the engine 1800 operating in a "cylinder deactivation" mode. Cylinder deactivation is a method of improving the overall efficiency of an engine by temporarily deactivating the combustion event in one or more cylinders during periods in which the engine is operating at reduced loads (i.e. when the engine is producing a relatively low amount of torque and/or power), such as, for example, when a vehicle is operating at highway speeds. Operating at reduced loads is inherently inefficient due to, among other things, the high pumping losses associated with throttling the intake air. In such instances, the overall engine efficiency can be improved by deactivating the combustion event in one or more cylinders, which requires the remaining cylinders to operate at a higher load and therefore with less throttling of the intake air, thereby reducing the pumping losses.

When the engine 1800 is operating in the cylinder deactivation mode, cylinder 1803A, which can be, for example cylinder #4 of a four cylinder engine, is the firing cylinder, operating on a standard four stroke combustion cycle. Conversely, cylinder 1803B, which can be, for example, cylinder #3 of a four cylinder engine, is the deactivated cylinder. As shown in FIG. 33, the engine 1800 is configured such that the piston 1804A within the firing cylinder 1803A is moving downwardly from top dead center (TDC) towards bottom dead center (BDC) on the intake stroke, as indicated by arrow AA. During the intake stroke, the intake valve 1860IA is opened thereby allowing air or an air/fuel mixture to flow from the intake manifold 1810I into the cylinder 1803A, as indicated by arrow N. The exhaust valve 1860EA is closed, such that the cylinder 1803A is fluidically isolated from the exhaust manifold 1810E.

Conversely, the piston 1804B within the deactivated cylinder 1803B is moving upwardly from BDC towards TDC, as indicated by arrow BB. As illustrated, the intake valve 1860IB is opened thereby allowing air to flow from the cylinder 1803B into the intake manifold 1810I, as indicated by arrow P. The exhaust valve 1860EB is closed such that the cylinder 1803B is fluidically isolated from the exhaust manifold 1810E. In this manner, the engine 1800 is configured so that cylinder 1803B operates to pump air contained therein into the intake manifold 1810I and/or cylinder 1803A. Said another way, cylinder 1803B is configured to act as a supercharger. In this manner, the engine 1800 can operate in a "standard" mode, in which cylinders 1803A and 1803B operate as naturally aspirated cylinders to combust fuel and air, and a "pumping assist" mode, in which cylinder 1803B is deactivated and the cylinder 1803A operates as a boosted cylinder to combust fuel and air.

Although the engine 1800 is shown and described operating in a cylinder deactivation mode in which one cylinder supplies air to another cylinder, in some embodiments, an engine can operate in a cylinder deactivation mode in which both the exhaust valve and the intake valve of the non-firing cylinder remain closed throughout the entire engine cycle. In other embodiments, an engine can operate in a cylinder deactivation mode in which the intake valve and/or exhaust valve of the non-firing cylinder is held open throughout the entire engine cycle, thereby eliminating the parasitic losses associated with pumping air through the non-firing cylinder. In yet other embodiments, an engine can operate in a cylinder deactivation mode in which the non-firing cylinder is configured to absorb power from the vehicle, thereby acting as a vehicle brake. In such embodiments, for example, the exhaust valve of the non-firing cylinder can be configured to open early so that the compressed air contained therein is released without producing any expansion work.

Figure 34:
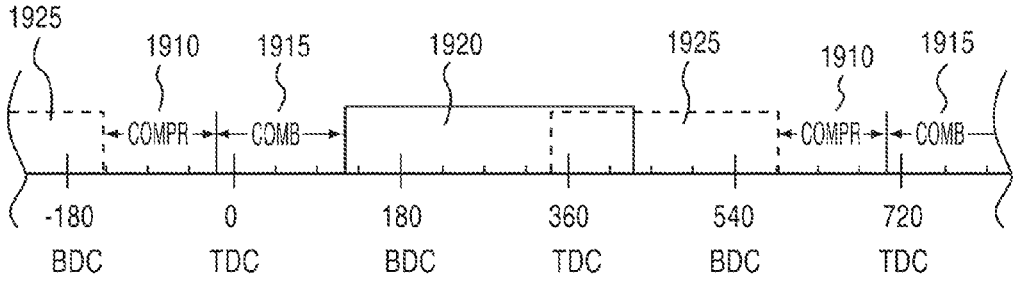
FIGS. 34-36 are graphical representations of the valve events of an engine according to an embodiment operating in a first mode and second mode, respectively.
Figure 35:
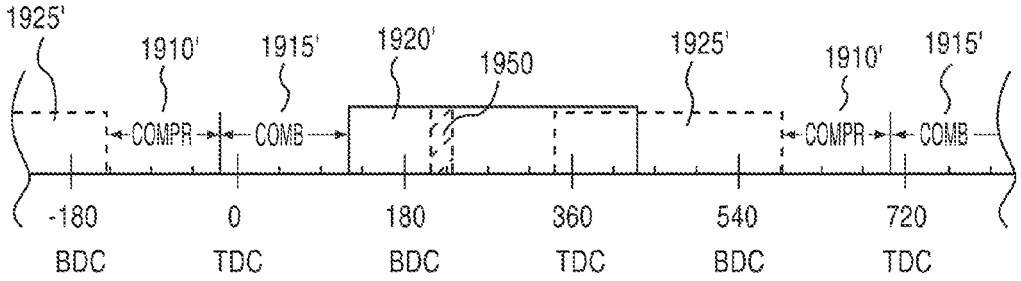
Figure 36:
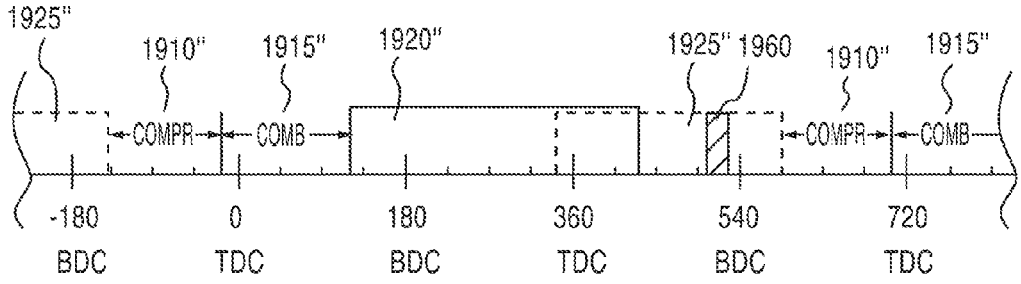

FIGS. 34-36 are graphical representations of the valve events of a cylinder of a multi-cylinder engine operating in a standard four stroke combustion mode, a first exhaust gas recirculation (EGR) mode and a second EGR mode respectively. The longitudinal axes indicate the position of the piston within the cylinder in terms of the rotational position of the crankshaft. For example, the position of 0 degrees occurs when the piston is at top dead center on the firing stroke of the engine, the position of 180 degrees occurs when the piston is at bottom dead center after firing, the position of 360 degrees occurs when the piston is at top dead center on the gas exchange stroke, and so on. The regions bounded by dashed lines represent periods during which an intake valve associated with the cylinder is opened. Similarly, the regions bounded by solid lines represent the periods during which an exhaust valve associated with the cylinder is opened.

As shown in FIG. 34, when the engine is operating in a four stroke combustion mode, the compression event 1910 occurs after the gaseous mixture is drawn into the cylinder. During the compression event 1910, both the intake and exhaust valves are closed as the piston moves upwardly towards TDC, thereby allowing the gaseous mixture contained in the cylinder to be compressed by the motion of the piston. At a suitable point, such as, for example −10 degrees, the combustion event 1915 begins. At a suitable point as the piston moves downwardly, such as, for example, 120 degrees, the exhaust valve open event 1920 begins. In some embodiments, the exhaust valve open event 1920 continues until the piston has reached TDC and has begun moving downwardly. Moreover, as shown in FIG. 34, the intake valve open event 1925 can begin before the exhaust valve open event 1920 ends. In some embodiments, for example, the intake valve open event 1925 can begin at 340 degrees and the exhaust valve open event 1920 can end at 390 degrees, thereby resulting in an overlap duration of 50 degrees. At a suitable point, such as, for example, 600 degrees, the intake valve open event 1925 ends and a new cycle begins.

In some embodiments, a predetermined amount of exhaust gas is conveyed from the exhaust manifold to the intake manifold via an exhaust gas recirculation (EGR) valve. In some embodiments, the EGR valve is controlled to ensure that precise amounts of exhaust gas are conveyed to the intake manifold.

As shown in FIG. 35, when the engine is operating in the first EGR mode, the intake valve associated with the cylinder is configured to convey exhaust gas from the cylinder directly into the intake manifold (not shown in FIG. 35), thereby eliminating the need for a separate EGR valve. As shown, the compression event 1910' occurs after the gaseous mixture is drawn into the cylinder. During the compression event 1910', both the intake and exhaust valves are closed as the piston moves upwardly towards TDC, thereby allowing the gaseous mixture contained in the cylinder to be compressed by the motion of the piston. As described above, at a suitable point, the combustion event 1915' begins. Similarly, at a suitable point the exhaust valve open event 1920' begins. At a suitable point during the exhaust valve event 1920', such as, for example, at 190 degrees, the first intake valve open event 1950 occurs. Because the first intake valve open event 1950 can be configured to occur when the pressure of the exhaust gas within the cylinder is greater than the pressure in the intake manifold, a portion of the exhaust gas will flow from the cylinder into the intake manifold. In this manner, exhaust gas can be conveyed directly into the intake manifold via the intake valve. The amount of exhaust gas flow can be controlled, for example, by varying the duration of the first intake valve open event 1950, adjusting the point at which the first intake valve open event 1950 occurs and/or varying the stroke of the intake valve during the first intake valve open event 1950.

As shown in FIG. 35, the second intake valve open event 1925' can begin before the exhaust valve open event 1920' ends. As described above, at suitable points, the first intake valve open event 1950 ends, the second intake valve open event 1925' ends and a new cycle begins.

As shown in FIG. 36, when the engine is operating in the second EGR mode, the exhaust valve associated with the cylinder is configured to convey exhaust gas from the exhaust manifold (not shown) directly into the cylinder (not shown in FIG. 35), thereby eliminating the need for a separate EGR valve. As shown, the compression event 1910" occurs after the gaseous mixture is drawn into the cylinder. During the compression event 1910", both the intake and exhaust valves are closed as the piston moves upwardly towards TDC, thereby allowing the gaseous mixture contained in the cylinder to be compressed by the motion of the piston. As described above, at a suitable point, the combustion event 1915" begins. Similarly, at a suitable point the first exhaust valve open event 1920" begins.

As described above, the intake valve open event 1925" can begin before the first exhaust valve open event 1920" ends. At a suitable point during the intake valve open event 1925", such as, for example, at 500 degrees, the second exhaust valve open event 1960 occurs. Because the second exhaust valve open event 1960 can be configured to occur when the pressure of the exhaust gas within the exhaust manifold is greater than the pressure in the cylinder, a portion of the exhaust gas will flow from the exhaust manifold into the cylinder. In this manner, exhaust gas can be conveyed directly into the cylinder via the exhaust valve. The amount of exhaust gas flow into the cylinder can be controlled, for example, by varying the duration of the second exhaust valve open event 1960, adjusting the point at which the second exhaust valve open event 1960 occurs and/or varying the stroke of the exhaust valve during the second exhaust valve open event 1960. As described above, at suitable points, the second exhaust valve open event 1970 ends, the intake valve open event 1925" ends and a new cycle begins.

Although the valve events are represented as square waves, in other embodiments, the valve events can have any suitable shape. For example, in some embodiments the valve events can be configured to as sinusoidal waves. In this manner, the acceleration of the valve member can be controlled to minimize the likelihood of valve bounce during the opening and/or closing of the valve.

In addition to allowing improvements in engine performance, the arrangement of the valve members shown and described above also results in improvements in the assembly, repair, replacement and/or adjustment of the valve members. For example, as previously discussed with reference to FIG. 5 and as shown in FIG. 37 the end plate 323 is removably coupled to the cylinder head 332 via cap screws 317, thereby allowing access to the spring 318 and the valve member 360 for assembly, repair, replacement and/or adjustment. Because the valve member 360 does not extend below the first surface 335 of the cylinder head (i.e., the valve member 360 does not protrude into the cylinder 303), the valve member 360 can be installed and/or removed without removing the cylinder head assembly 330 from the cylinder 303. Moreover, because the tapered portion 362 of the valve member 360 is disposed within the valve pocket 338 such that the width and/or thickness of the valve member 360 increases away from the camshaft 314 (e.g., in the direction indicated by arrow C in FIG. 5), the valve member 360 can be removed without removing the camshaft 314 and/or any of the linkages (i.e., tappets) that can be disposed between the camshaft 314 and the valve member 360. Additionally, the valve member 360 can be removed without removing the gas manifold 310. For example, in some embodiments, a user can remove the valve member 360 by moving the end plate 323 such that the valve pocket 338 is exposed, removing the spring 318, removing the alignment key 398 from the keyway 399 and sliding the valve member 360 out of the valve pocket 338. Similar procedures can be followed to replace the spring 318, which may be desirable, for example, to adjust the biasing force applied to the first stem portion 377 of the valve member 360.

Similarly, an end plate 322 (see FIG. 5) is removably coupled to the cylinder head 332 to allow access to the camshaft 314 and the first stem portion 376 for assembly, repair and/or adjustment. For example, as discussed in more detail herein, in some embodiments, a valve member can include an adjustable tappet (not shown) configured to provide a predetermined clearance between the valve lobe of the camshaft and the first stem portion when the cylinder head is in the closed configuration. In such arrangements, a user can remove the end plate 322 to access the tappet for adjustment. In other embodiments, the camshaft is disposed within a separate cam box (not shown) that is removably coupled to the cylinder head.

Figure 38:
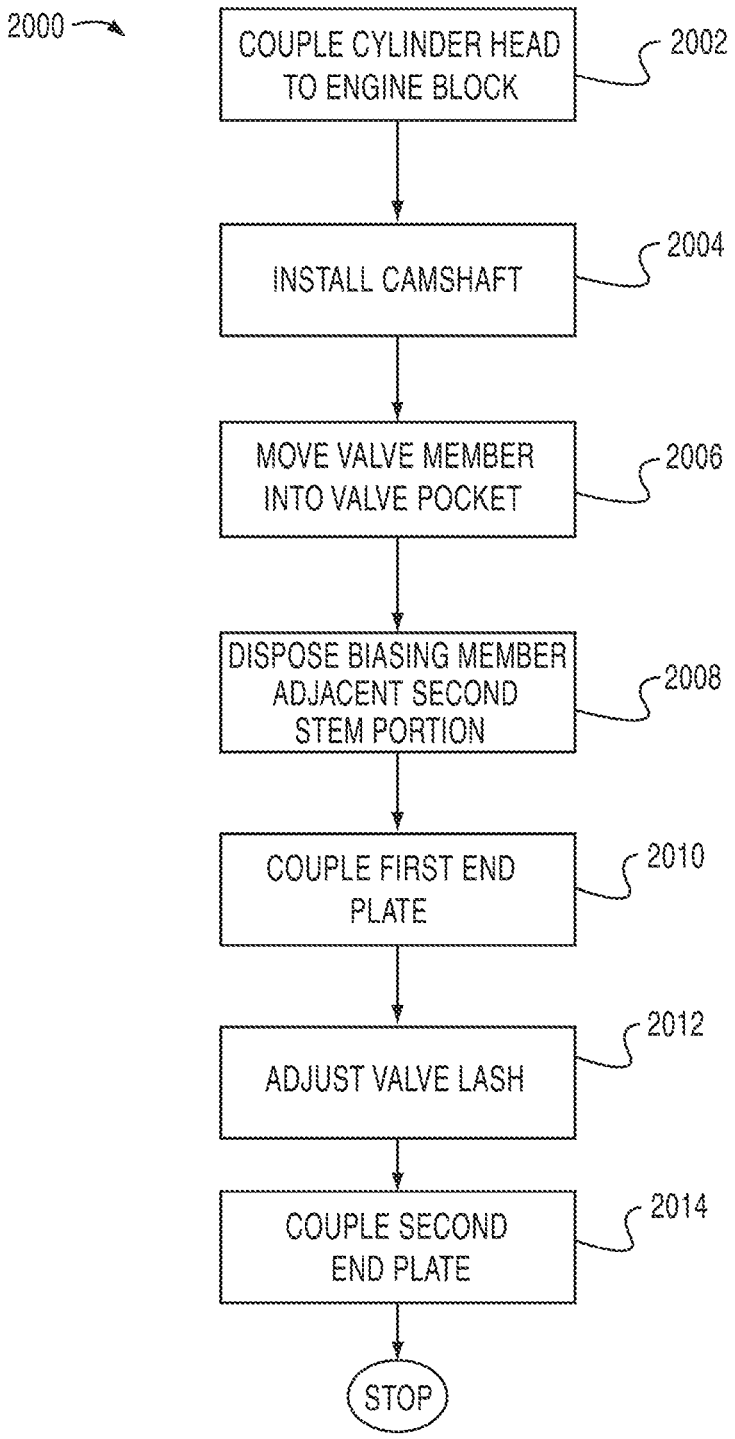
FIG. 38 is a flow chart illustrating a method of assembling an engine according to an embodiment.

FIG. 38 is a flow chart illustrating a method 2000 for assembling an engine according to an embodiment. The illustrated method includes coupling a cylinder head to an engine block, 2002. As described above, in some embodiments, the cylinder head can be coupled to the engine block using cylinder head bolts. In other embodiments, the cylinder head and the engine block can be constructed monolithically. In such embodiments, the cylinder head is coupled to the engine block during the casting process. At 2004, a camshaft is then installed into the engine.

The method then includes moving a valve member, of the type shown and described above, into a valve pocket defined by the cylinder head, 2006. As previously discussed, in some embodiments, the valve member can be installed such that a first stem portion of the valve member is adjacent to and engages a valve lobe of the camshaft. Once the valve member is disposed within the valve pocket, a biasing member is disposed adjacent a second stem portion of the valve member, 2008, and a first end plate is coupled to the cylinder head, such that a portion of the biasing member engages the first end plate, 2010. In this manner, the biasing member is retained in place in a partially compressed (i.e., preloaded) configuration. The amount of biasing member preload can be adjusted by adding and/or removing spacers between the first end plate and the biasing member.

Because the biasing member can be configured to have a relatively low preload force, in some embodiments, the first end plate can be coupled to the cylinder head without using a spring compressor. In other embodiments, the cap screws securing the first end plate to the cylinder head can have a predetermined length such that the first end plate can be coupled to the cylinder without using a spring compressor.

The illustrated method then includes adjusting a valve lash setting, 2012. In some embodiments, the valve lash setting is adjusted by adjusting a tappet disposed between the first stem portion of the valve member and the camshaft. In other embodiments, a method does not include adjusting the valve lash setting. The method then includes coupling a second end plate to the cylinder head, 2014, as described above.

Figure 39:
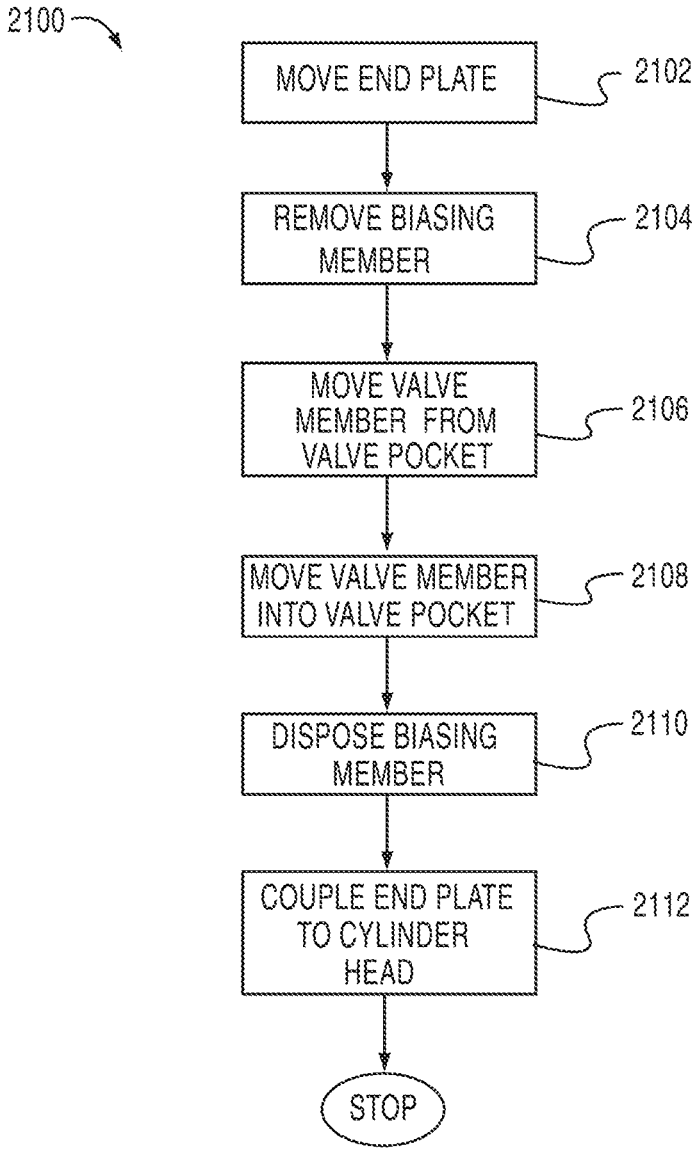
FIG. 39 is a flow chart illustrating a method of repairing an engine according to an embodiment.

FIG. 39 is a flow chart illustrating a method 2100 for replacing a valve member in an engine without removing the cylinder head according to an embodiment. The illustrated method includes moving an end plate to expose a first opening of a valve pocket defined by a cylinder head, 2102. In some embodiments, the end plate can be removed from the cylinder head. In other embodiments, the end plate can be loosened and pivoted such that the first opening is exposed. A biasing member, which is disposed between a second end portion of the valve member and the end plate, is removed, 2104. In this manner, the second end portion of the valve member is exposed. The valve member is then moved from within the valve pocket through the first opening, 2106. In some embodiments, the camshaft can be rotated to assist in moving the valve member through the first opening. A replacement valve member is disposed within the valve pocket, 2108. The biasing member is then replaced, 2110, and the end plate is coupled to the cylinder head 2112, as described above.

FIGS. 40-43 are schematic illustrations of top view of a portion of an engine 3100 having a variable travel valve actuator assembly 3200, according to an embodiment. The engine 3100 includes an engine block (not shown in FIGS. 40-43), a cylinder head 3132, a valve 3160 and an actuator assembly 3200. The engine block defines a cylinder 3103 (shown in dashed lines) within which a piston (not shown in FIGS. 40-43) can be disposed. The cylinder head 3132 is coupled to the engine block such that a portion of the cylinder head 3132 covers the upper portion of the cylinder 3103 thereby forming a combustion chamber. The cylinder head 3132 defines a valve pocket 3138 and four cylinder flow passages (not shown in FIGS. 40-43). The cylinder flow passages are in fluid communication with the valve pocket 3138 and the cylinder 3103. In this manner, as described herein, a gas (e.g., an exhaust gas or an intake gas) can flow between a region outside of the engine 3100 and the cylinder 3103 via the cylinder head 3132.

The valve 3160 has a first end portion 3176 and a second end portion 3177, and defines four flow openings 3168 (only one of the flow openings is labeled in FIGS. 40-43). The flow openings 3168 correspond to the cylinder flow passages of the cylinder head 3132. Although the valve 3160 is shown as defining four flow openings 3168, in other embodiments, the valve 3160 can define any number of flow openings (e.g., one, two, three, or more). In some embodiments, the valve 3160 can be a tapered valve similar to the valve 360 shown and described above.

The valve 3160 is movably disposed within the valve pocket 3138 of the cylinder head 3132. More particularly, the valve 3160 can move within the valve pocket 3138 between a closed position (e.g., FIGS. 40 and 42) and multiple different opened positions (e.g., FIGS. 41 and 43). When the valve 3160 is in the closed position, each flow opening 3168 is offset (or out of alignment with) from the corresponding cylinder flow passages. Moreover, when the valve 3160 is in the closed position, at least a portion of the valve 3160 is in contact with a portion of the interior surface of the cylinder head 3132 that defines the valve pocket 3138 such that the cylinder flow passages are fluidically isolated from the cylinder 3103. In some embodiments, the valve 3160 can include a sealing portion (not shown in FIGS. 40-43), such as for example, a tapered surface, configured to engage a surface of the cylinder head 3132 to fluidically isolate the cylinder 3103 from the region outside of the engine 3100.

Figure 40:
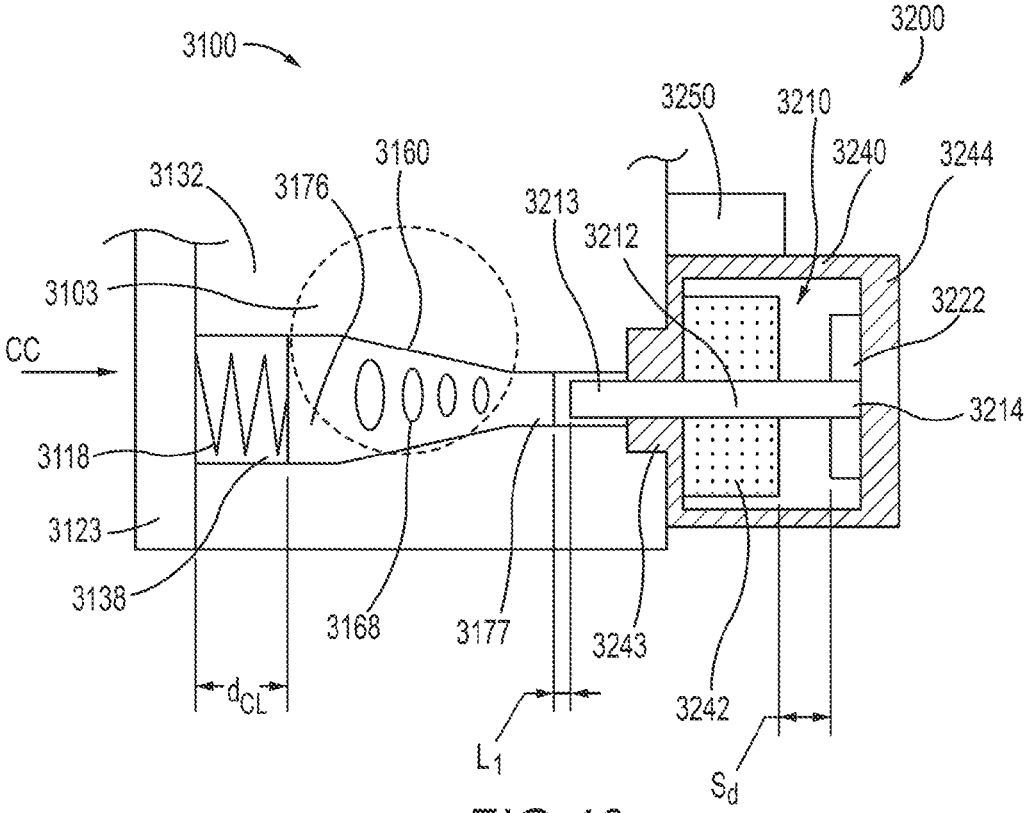
FIGS. 40 and 42 are schematic illustrations of top view of an engine having a variable travel valve actuator assembly in a closed position and in a first configuration and a second configuration, respectively, according to an embodiment.
Figure 42:
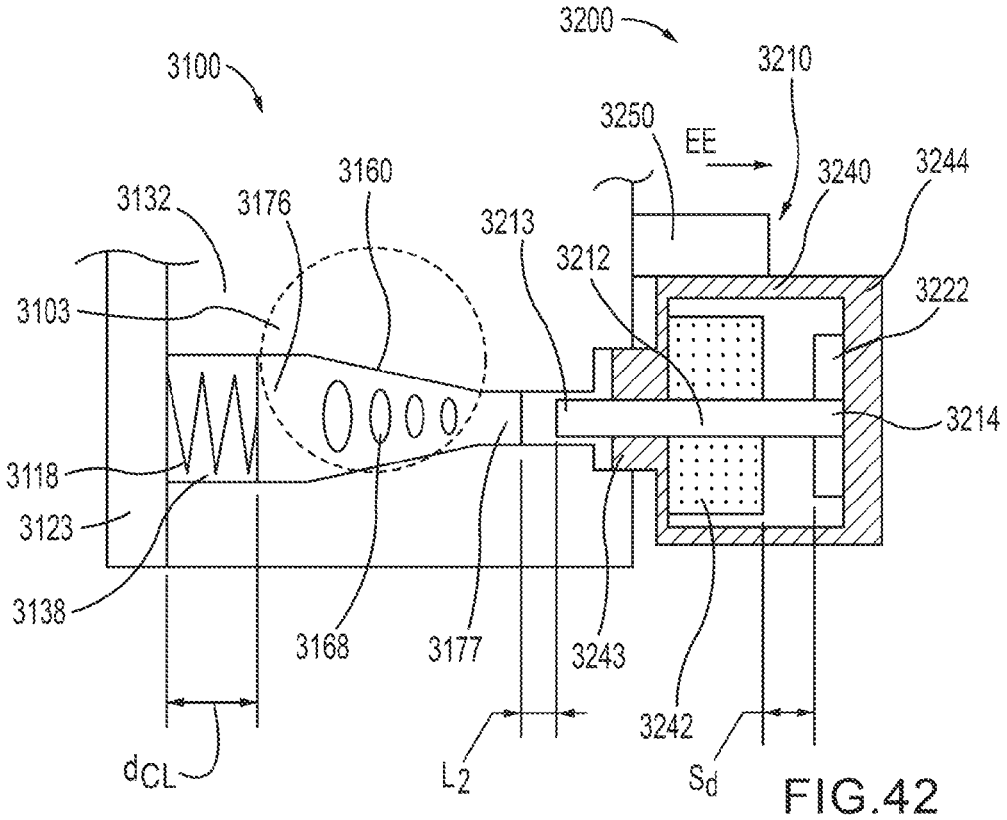

As shown in FIGS. 40 and 42, when the valve 3160 is in the closed position, the first end portion 3176 of the valve is offset from an end plate 3123 by a distance $d_{c1}$. A spring 3118 is disposed between the first end portion 3176 of the valve 3160 and an end plate 3123. The spring 3118 exerts a force on the valve 3160 in the direction shown by the arrow CC in FIG. 40 to bias the valve 3160 in the closed position. When the valve 3160 is in the closed position, the valve 3160 can be prevented from moving further in the direction shown by the arrow CC by any suitable mechanism. Such mechanisms can include, for example, mating tapered surfaces of the valve 3160 and the valve pocket 3138, a mechanical end-stop, a magnetic device or the like.

Figure 41:
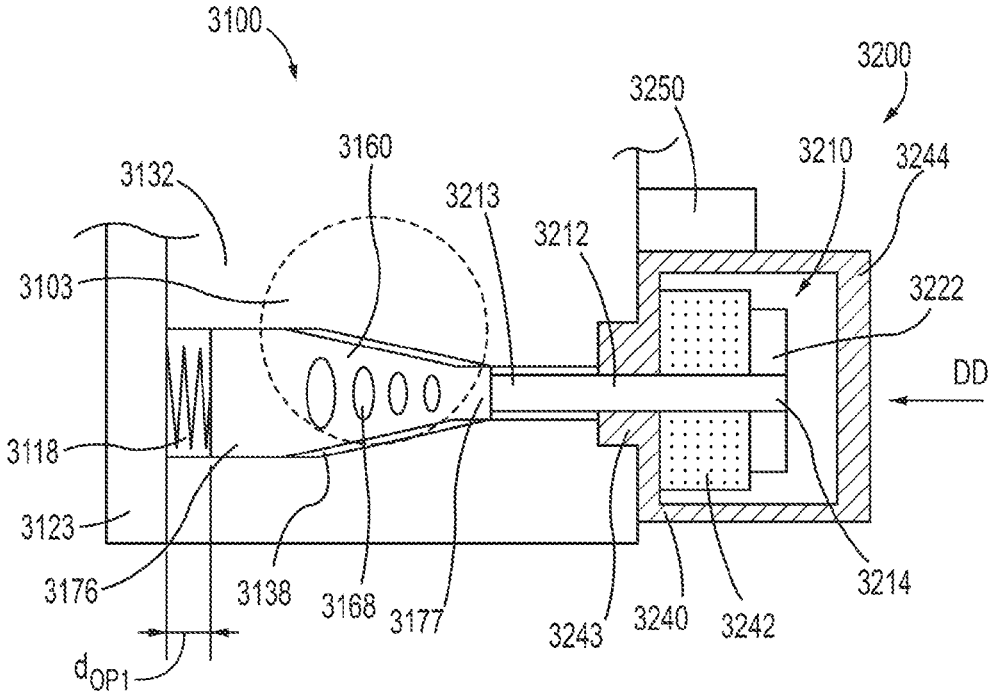
FIGS. 41 and 43 are schematic illustrations of top view of the engine shown in FIGS. 40 and 42 in an opened position and in a first configuration and a second configuration, respectively.
Figure 43:
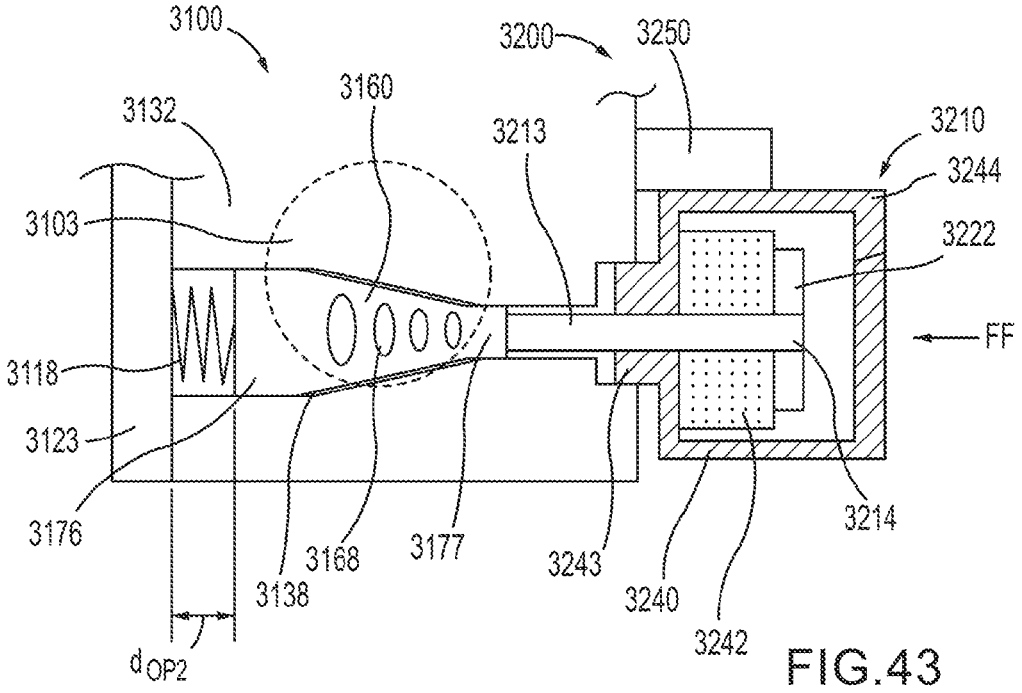

As described in more detail below, the actuator assembly 3200 is configured to selectively vary the distance through which the valve 3160 travels when moving between the closed position and an opened position. Similarly stated, the valve 3160 can be moved between the closed position (FIGS. 40 and 42) and any number of different opened positions. FIG. 41 illustrates the valve 3160 in a fully opened position, or the opened position corresponding to a first configuration of the actuator assembly 3200. FIG. 43 illustrates the valve 3160 in a partially opened position, or the opened position corresponding to a second configuration of the actuator assembly 3200. When the valve 3160 is in an opened position, each flow opening 3168 of the valve 3160 is at least partially aligned with the corresponding cylinder flow passages. Moreover, when the valve 3160 is in an opened position, a portion of the valve 3160 is spaced apart from the interior surface of the cylinder head 3132 that defines the valve pocket 3138 such that the cylinder flow passages are in fluid communication with the cylinder 3103. Thus, when the valve 3160 is in an opened position, a gas (e.g., an exhaust gas or an intake gas) can flow between a region outside of the engine 3100 and the cylinder 3103 via the cylinder head 3132.

As shown in FIG. 41 when the valve is in the first opened position (i.e., the fully opened position), the first end portion 3176 of the valve is offset from the end plate 3123 by a distance $d_{op1}$. Thus, the distance through which the valve 3160 travels when moved from the closed position to the first opened position is represented by equation (1).

$$\text{Travel}_1 = d_{c1} - d_{op1} \quad (1)$$

As shown in FIG. 43 when the valve is in the second opened position (i.e., the partially opened position), the first end portion 3176 of the valve is offset from the end plate 3123 by a distance $d_{op2}$, which is greater than the distance $d_{op1}$. Thus, the distance through which the valve 3160 travels when moved from the closed position to the second opened position is less than the distance through which the valve 3160 travels when moved from the closed position to the first opened position. The distance through which the valve 3160 travels when moved from the closed position to the second opened position is represented by equation (2).

$$\text{Travel}_2 - d_{c1} - d_{op2} \quad (2)$$

The actuator assembly 3200 includes a valve actuator 3210 and a variable travel actuator 3250. The valve actuator 3210 includes a housing 3240, a solenoid coil 3242, a push rod 3212 and an armature 3222. A first end portion 3243 of the housing 3240 is movably coupled to the cylinder head 3132. In this manner, as described in more detail below, the housing 3242 (and therefore the valve actuator 3210) can move relative to the cylinder head 3132. The solenoid coil 3242 is fixedly coupled within the first end portion 3243 of the housing 3240. Similarly stated, the solenoid coil 3242 is disposed within the housing 3240 such that movement of the solenoid coil 3242 relative to the housing 3240 is prevented.

The push rod 3212 has a first end portion 3213 and a second end portion 3214. The second end portion 3214 of the push rod 3212 is disposed within the housing 3240 and is coupled to the armature 3222. More particularly, the second end portion 3214 of the push rod 3212 is coupled to the armature 3222 such that movement of the armature 3222 results in movement of the push rod 3212. A portion of the push rod 3212 is movably disposed within the solenoid coil 3242. In this manner, the armature 3222 and the push rod 3212 can move relative to the solenoid coil 3242. In use, when the solenoid coil 3242 is energized with an electrical current, a magnetic field is produced that exerts a force upon the armature 3222 in a direction shown by the arrows DD and FF in FIGS. 41 and 43, respectively. The magnetic force causes the armature 3222 and the push rod 3212 to move relative to the solenoid coil 3242 (and the housing 3240), as shown by the arrows DD and FF in FIGS. 41 and 43, respectively. The armature 3222 and the push rod 3212 move relative to the solenoid coil 3242 through a distance Sd (i.e., the solenoid stroke) until the armature 3222 contacts the solenoid coil 3242. When the solenoid coil 3242 is de-energized, the armature 3222 can travel in a direction opposite the direction shown by the arrows DD and FF until the armature contacts a second end portion 4244 of the housing 4240. In some embodiments, the valve actuator 4210 includes a biasing member configured to urge the armature 3222 into contact with the second end portion of the housing 4240.

The first end portion 3213 of the push rod 3212 is disposed outside of the housing 3240. More particularly, when the housing 3240 is coupled to the cylinder head 3132, the first end portion 3213 of the push rod 3212 is disposed within the valve pocket 3138 adjacent the second end portion 3177 of the valve 3160. More particularly, as shown in FIGS. 40 and 42, when the valve 3160 is in the closed position and the solenoid coil 3242 is not energized, the first end portion 3213 of the push rod 3212 is spaced apart from the second end portion 3177 of the valve 3160. The distance between the first end portion 3213 of the push rod 3212 and the second end portion 3177 of the valve 3160 is referred to as the valve lash (identified as $L_1$ in FIG. 40 and $L_2$ in FIG. 42). Providing clearance (i.e., valve lash) between the push rod 3212 and the valve 3160 can ensure that the valve 3160 will be operate properly (e.g., be fully seated when in the closed position) regardless of the thermal growth of the valve train components, manufacturing tolerances of the valve train components, and/or the like.

In use, when the solenoid coil 3242 is energized and the push rod 3212 moves as shown by the arrow DD, the first end portion 3213 of the push rod 3212 contacts the second end portion 3177 of the valve 3160. When the force exerted by the push rod 3212 on the valve 3160 is greater than the biasing force exerted by the spring 3118, the valve 3160 is moved from the closed position (e.g., FIG. 40) to an opened position (e.g., FIG. 41). As described above, because the valve actuator 3210 is electrically operated, the valve 3160 can be moved between the closed position and an opened position independently from the rotational position of a camshaft or a crankshaft of the engine 3100.

The variable travel actuator 3250 is configured to move the housing 3240 (and therefore, the valve actuator 3210) relative to the cylinder head 3132. In this manner, as described below, the variable travel actuator 3250 can selectively vary the distance through which the valve 3160 travels when moving between the closed position and an opened position. More particularly, the valve travel is related to the solenoid stroke Sd and the valve lash as indicated by equation (3).

$$\text{Travel} = Sd - L \quad (3)$$

Thus, the valve travel can be adjusted by changing the solenoid stroke Sd and/or the valve lash L.

As shown in FIG. 40, when the actuator assembly 3200 is in the first (or full opening) configuration, the housing 3240 is positioned relative to the cylinder head 3132 such that the valve lash setting has a value of $L_1$. Accordingly, the travel of the valve 3160 when the actuator assembly 3200 is in the first configuration is represented by equation (4).

$$\text{Travel}_1 = Sd - L_1 = d_{c1} - d_{op1} \quad (4)$$

As shown in FIG. 42, when the actuator assembly 3200 is in the second (or partial opening) configuration, the housing 3240 is positioned relative to the cylinder head 3132 such that the valve lash setting has a value of $L_2$, which is greater than $L_1$. Similarly stated, when the actuator assembly 3200 is in the second (or partial opening) configuration, the housing 3240 is moved relative to the cylinder head 3132 as shown by the arrow EE in FIG. 42, thereby increasing the valve lash setting to a value of $L_2$. Accordingly, the travel of the valve 3160 when the actuator assembly 3200 is in the second configuration is represented by equation (5).

$$\text{Travel}_2 = Sd - L_2 = d_{c1} - d_{op2} \quad (5)$$

The variable travel actuator 3250 can include any suitable mechanism for moving the valve actuator 3210 relative to the cylinder head 3132 as shown by the arrow EE in FIG. 42. For example, in some embodiments, the variable travel actuator 3250 can include an electronic actuator that moves the valve actuator 3210 linearly relative to the cylinder head 3132. Similarly stated, in some embodiments, the variable travel actuator 3250 can include an electronic actuator that translates the valve actuator 3210 relative to the cylinder head 3132. For example, in some embodiments, the variable travel actuator 3250 can include a rack and pinion arrangement to translate the valve actuator 3210 relative to the cylinder head 3132. In other embodiments, the variable travel actuator 3250 can rotate the valve actuator 3210 relative to the cylinder head. For example, in some embodiments, the housing 3240 can include a threaded portion configured to mate with a corresponding threaded portion in the cylinder head 3132 such that rotation of the housing 3240 relative to the cylinder head 3132 results in movement as shown by the arrow EE in FIG. 42.

As described above, the variable travel actuator 3250 varies the valve travel by selectively varying the valve lash L while maintaining a constant solenoid stroke Sd. In this manner, the electro-mechanical characteristics of the valve actuator 3210 remain substantially constant when the actuator assembly 3200 is moved between the first configuration and the second configuration. Accordingly, the current to energize the solenoid coil 3242 need not change as a function of the configuration of the actuator assembly 3200.

As shown in FIGS. 40-43, the spring 3118 is disposed adjacent the opposite end of the valve 3160 (i.e., the first end portion 3176) from the actuator assembly 3200. This arrangement allows the variable travel actuator 3250 of the actuator assembly 3200 to move the valve actuator 3210 relative to the cylinder head 3132 without changing the functional characteristics of the spring 3118. More particularly, the variable travel actuator 3250 of the actuator assembly 3200 can move the valve actuator 3210 relative to the cylinder head 3132 without changing the length of the spring 3118 when the valve 3160 is in the closed position (i.e., the initial length of the spring 3118). In the illustrated embodiment, the initial length of the spring 3118 corresponds to the distance dc1 between the end plate 3123 and the first end portion 3176 of the valve 3160. By maintaining a substantially constant initial length of the spring 3118, the variable travel actuator 3250 of the actuator assembly 3200 can move the valve actuator 3210 relative to the cylinder head 3132 without changing the biasing force exerted by the spring 3118 on the valve 3160. Accordingly, the valve 3160 can be actuated in a repeatable and/or precise manner regardless of the configuration of the actuator assembly 3200.

In addition to decreasing the valve travel, selectively increasing the lash (e.g., from L1 to L2) can result in a longer time for the valve 3160 to begin moving after the solenoid 3242 is energized. Accordingly, in some embodiments, the timing of the actuation can be adjusted and/or offset as a function of the valve lash. For example, in some embodiments, the engine 3100 can include an electronic control unit or ECU (not shown) configured to automatically adjust the actuation timing as a function of the change in valve lash (e.g., $L_1$ to $L_2$) when the actuation assembly 3200 is moved between the first configuration and the second configuration. In some embodiments, for example, the ECU can be configured to receive an input corresponding to the valve lash setting of the valve when the actuation assembly is in the first configuration (e.g., the full opening configuration) and adjust the actuation timing as a function of the actual change in valve lash setting. In this manner, the ECU can control the actuation timing for a particular engine, rather than based on nominal values for a general engine design.

Although the actuator assembly 3200 is shown as having only one partial opening configuration (e.g., FIGS. 42 and 43), the actuator assembly 3200 can be moved between the full opening configuration and any number of partial opening configurations. For example, the actuator assembly 3200 can be moved between a full opening configuration, a first partial opening configuration (in which the valve travel is approximately ¾ of the full opening valve travel), a second partial opening configuration (in which the valve travel is approximately ½ of the full opening valve travel) and a third partial opening configuration (in which the valve travel is approximately ¼ of the full opening valve travel). In another example, the actuator assembly 3200 can be moved between the full opening configuration and an infinite number of partial opening configurations. For example in some embodiments, the actuator assembly 3200 can adjust the distance between the closed position and the opened position to any value between approximately zero inches and 0.090 inches. By selectively varying the distance between the opened position and the closed position (e.g., the valve travel), the actuator assembly 3200 can accurately and/or precisely control the amount and/or flow rate of gas flow into and/or out of the cylinder 3103. More particularly, the valve travel can be varied in conjunction with the timing and duration of the valve opening event to provide the desired gas flow characteristics as a function of the engine operating conditions (e.g., low idle, road cruising conditions or the like). In some embodiments, the control afforded by this arrangement allows the engine gas exchange process to be controlled using only the valve 3160 and the actuator assembly 3200, thereby removing the need for a throttle valve upstream of the cylinder head 3132.

Although the top view schematic illustrations shown in FIGS. 40-43 show the valve 3160 moving between the closed position and an opened position in a direction substantially normal to a center line (not shown) of the cylinder 3103, in other embodiments, the valve 3160 can move in any suitable direction relative to the cylinder 3103 and/or the cylinder head 3132. For example, in some embodiments, the valve 3160 can move substantially parallel to a center line of the cylinder 3103. In other embodiments, the valve 3160 can move in a direction non-parallel to and non-normal to a center line of the cylinder 3103.

Figure 44:
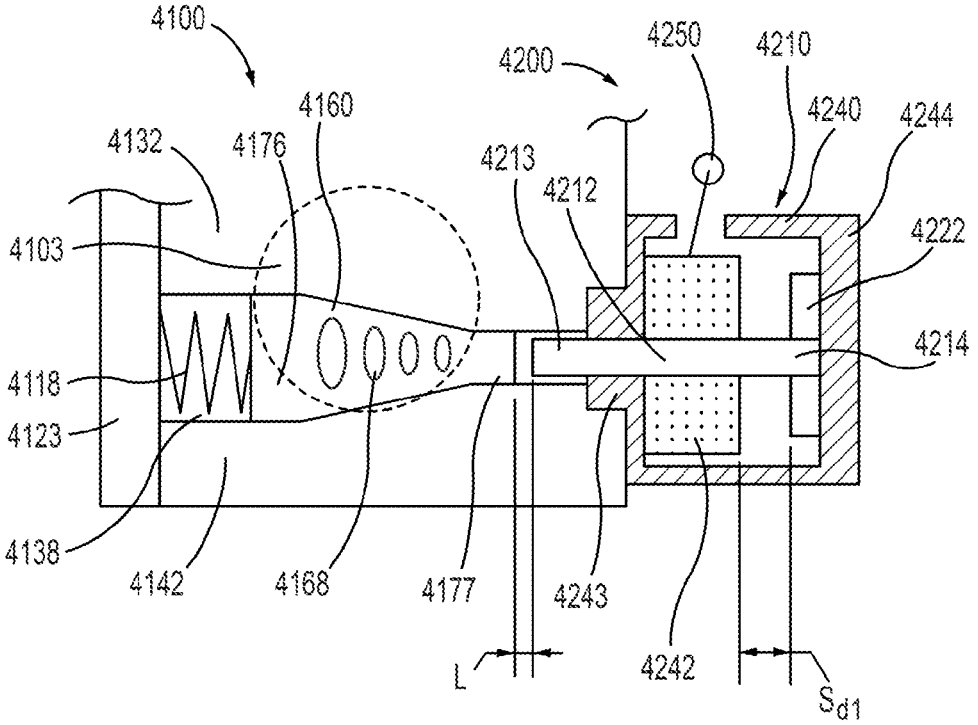
FIGS. 44 and 45 are schematic illustrations of top view of an engine having a variable travel valve actuator assembly in a closed position and in a first configuration and a second configuration, respectively, according to an embodiment.
Figure 45:
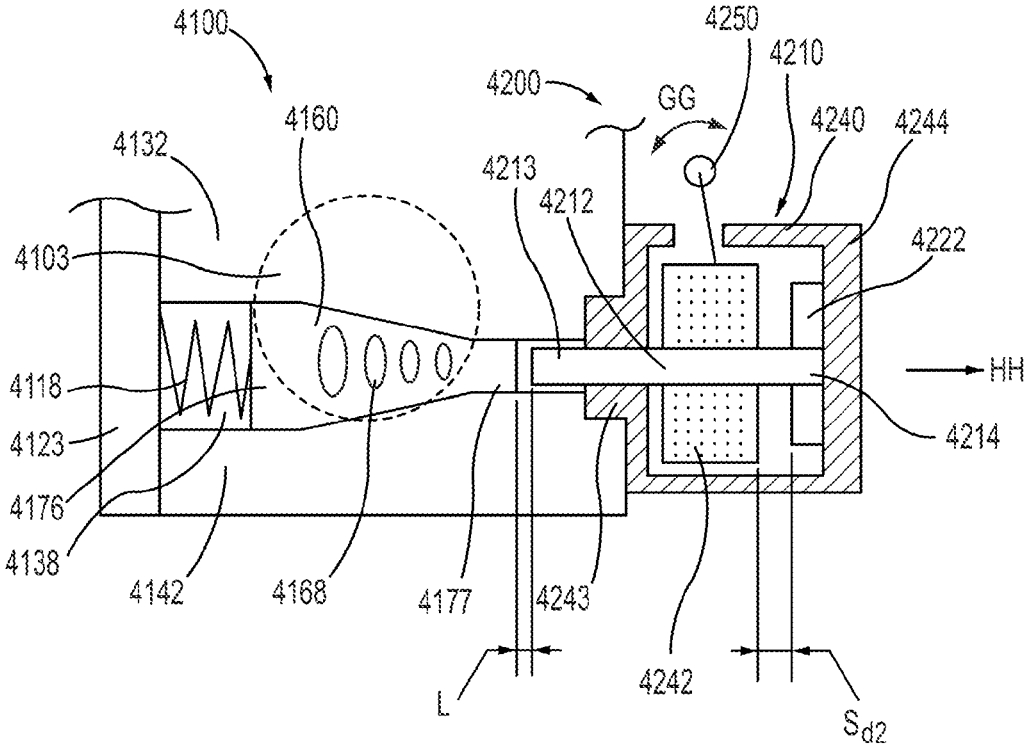

Although the variable travel actuator 3250 is shown and described above as varying the valve travel by selectively varying the valve lash L while maintaining a constant solenoid stroke Sd, in other embodiments, a variable travel actuator can vary the valve travel by selectively varying the solenoid stroke while maintaining a substantially constant valve lash setting. For example, FIGS. 44 and 45 are schematic illustrations of top view of a portion of an engine 4100 having a variable travel valve actuator assembly 4200, according to an embodiment. The engine 4100 includes an engine block (not shown in FIGS. 44 and 45), a cylinder head 4132, a valve 4160 and an actuator assembly 4200. The engine block defines a cylinder 4103 (shown in dashed lines) within which a piston (not shown in FIGS. 44 and 45) can be disposed. The cylinder head 4132 is coupled to the engine block such that a portion of the cylinder head 4132 covers the upper portion of the cylinder 4103 thereby forming a combustion chamber. The cylinder head 4132 defines a valve pocket 4138 and four cylinder flow passages (not shown in FIGS. 44 and 45). The cylinder flow passages are in fluid communication with the valve pocket 4138 and the cylinder 4103. In this manner, as described above, a gas (e.g., an exhaust gas or an intake gas) can flow between a region outside of the engine 4100 and the cylinder 4103 via the cylinder head 4132.

The valve 4160 has a first end portion 4176 and a second end portion 4177, and defines four flow openings 4168 (only one of the flow openings is labeled in FIGS. 44 and 45). The flow openings 4168 correspond to the cylinder flow passages of the cylinder head 4132. Although the valve 4160 is shown as defining four flow openings 4168, in other embodiments, the valve 4160 can define any number of flow openings (e.g., one, two, three, or more). In some embodiments, the valve 4160 can be a tapered valve similar to the valve 360 shown and described above.

The valve 4160 is movably disposed within the valve pocket 4138 of the cylinder head 4132. More particularly, the valve 4160 can move within the valve pocket 4138 between a closed position (as shown in FIGS. 44 and 45) and multiple different opened positions (not shown in FIGS. 44 and 45). When the valve 4160 is in the closed position, the cylinder flow passages are fluidically isolated from the cylinder 4103, as described above. A spring 4118 is disposed between the first end portion 4176 of the valve 4160 and an end plate 4123. The spring 4118 exerts a force on the valve 4160 to bias the valve 4160 in the closed position, as described above. Similar to the arrangement described above with reference to the engine 3100, the valve 4160 can be moved between the closed position (FIGS. 44 and 45) and any number of different opened positions. When the valve 4160 is in an opened position, the cylinder flow passages are in fluid communication with the cylinder 4103. Thus, when the valve 4160 is in an opened position, a gas (e.g., an exhaust gas or an intake gas) can flow between a region outside of the engine 4100 and the cylinder 4103 via the cylinder head 4132.

The actuator assembly 4200 includes a valve actuator 4210 and a variable travel actuator 4250. The valve actuator 4210 includes a housing 4240, a solenoid coil 4242, a push rod 4212 and an armature 4222. A first end portion 4243 of the housing 4240 is fixedly coupled to the cylinder head 4132. The solenoid coil 4242 is movably disposed within the first end portion 4243 of the housing 4240. In this manner, as described in more detail below, the solenoid coil 4242 can be selectively moved to vary the solenoid stroke, and therefore the valve travel.

The push rod 4212 has a first end portion 4213 and a second end portion 4214. The second end portion 4214 of the push rod 4212 is disposed within the housing 4240 and is coupled to the armature 4222. More particularly, the second end portion 4214 of the push rod 4212 is coupled to the armature 4222 such that movement of the armature 4222 results in movement of the push rod 4212. A portion of the push rod 4212 is movably disposed within the solenoid coil 4242. In this manner, the armature 4222 and the push rod 4212 can move relative to the solenoid coil 4242. In use, when the solenoid coil 4242 is energized the armature 4222 and the push rod 4212 are moved relative to the solenoid coil 4242 (and the housing 4240) until the armature 4222 contacts the solenoid coil 4242. Similarly stated, when the solenoid coil 4242 is energized the armature 4222 and the push rod 4212 move relative to the solenoid coil 4242 a distance (i.e., the solenoid stroke). When the solenoid coil 4242 is de-energized, the armature 4222 can move in an opposite direction until the armature contacts a second end portion 4244 of the housing 4240. In some embodiments, the valve actuator 4210 includes a biasing member configured to urge the armature 4222 into contact with the second end portion of the housing 4240.

The first end portion 4213 of the push rod 4212 is disposed outside of the housing 4240. More particularly, when the housing 4240 is coupled to the cylinder head 4132, the first end portion 4213 of the push rod 4212 is disposed within the valve pocket 4138 adjacent the second end portion 4177 of the valve 4160. As shown in FIGS. 44 and 45, when the valve 4160 is in the closed position and the solenoid coil 4242 is not energized, the first end portion 4213 of the push rod 4212 is spaced apart from the second end portion 4177 of the valve 4160 by a distance L (the valve lash). In use, when the solenoid coil 4242 is energized and the push rod 4212 moves, the first end portion 4213 of the push rod 4212 contacts the second end portion 4177 of the valve 4160. When the force exerted by the push rod 4212 on the valve 4160 is greater than the biasing force exerted by the spring 4118, the valve 4160 is moved from the closed position (e.g., FIGS. 44 and 45) to an opened position (not shown).

The variable travel actuator 4250 is configured to move the solenoid coil 4242 within the housing 4240 relative to the armature 4222 and/or the push rod 4212, as shown by the arrow HH in FIG. 45. In this manner, the actuator assembly 4200 can be moved between a first (or full opening) configuration, as shown in FIG. 44, and a second (or partial opening) configuration, as shown in FIG. 45. Although shown as having only one partial opening configuration, the actuator assembly 4200 can have any number of different partial opening configurations, as described above. As shown in FIG. 44, when the actuator assembly 4200 is in the first configuration, the armature 4222 is spaced apart from the solenoid 4242 when the solenoid is de-energized by a distance $S_{d1}$ (i.e., the solenoid stroke when the actuator assembly 4200 is in the first configuration). As shown in FIG. 45, when the actuator assembly 4200 is in the second configuration, the armature 4222 is spaced apart from the solenoid 4242 when the solenoid is de-energized by a distance $S_{d2}$ (i.e., the solenoid stroke when the actuator assembly 4200 is in the second configuration), which is less than the distance $S_{d1}$.

As described above, the valve travel is related to the solenoid stroke and the valve lash. Accordingly, the actuator assembly 4200 can selectively vary the valve travel by adjusting the solenoid stroke. Moreover, because the housing 4240 is fixedly coupled to the cylinder head 4132, the position of the push rod 4212 relative to the valve 4160 when the solenoid 4242 is de-energized remains substantially constant when the actuator assembly 4200 is moved from the first configuration to the second configuration. Similarly stated, the valve lash L remains substantially constant when the actuator assembly 4200 is moved from the first configuration to the second configuration.

As shown in FIGS. 44 and 45, the variable travel actuator 4250 is coupled to the solenoid coil 4242 via a connector 4251. In this manner, movement and/or force produced by the variable travel actuator 4250 can result in movement of the solenoid 4242 within the housing 4240. More particularly, when the variable travel actuator 4250 rotates as shown by the arrow GG in FIG. 45, the solenoid coil 4242 moves within the housing 4240 as shown by the arrow HH in FIG. 45. The connector 4251 can be any suitable connector, such as, for example, a rod, a cable, a belt or the like. Moreover, the variable travel actuator 4250 can include any suitable mechanism for moving the solenoid coil 4242 within the housing 4240, such as, for example, a stepper motor, an electronic actuator, a hydraulic actuator, a pneumatic actuator and/or the like.

Figure 46:
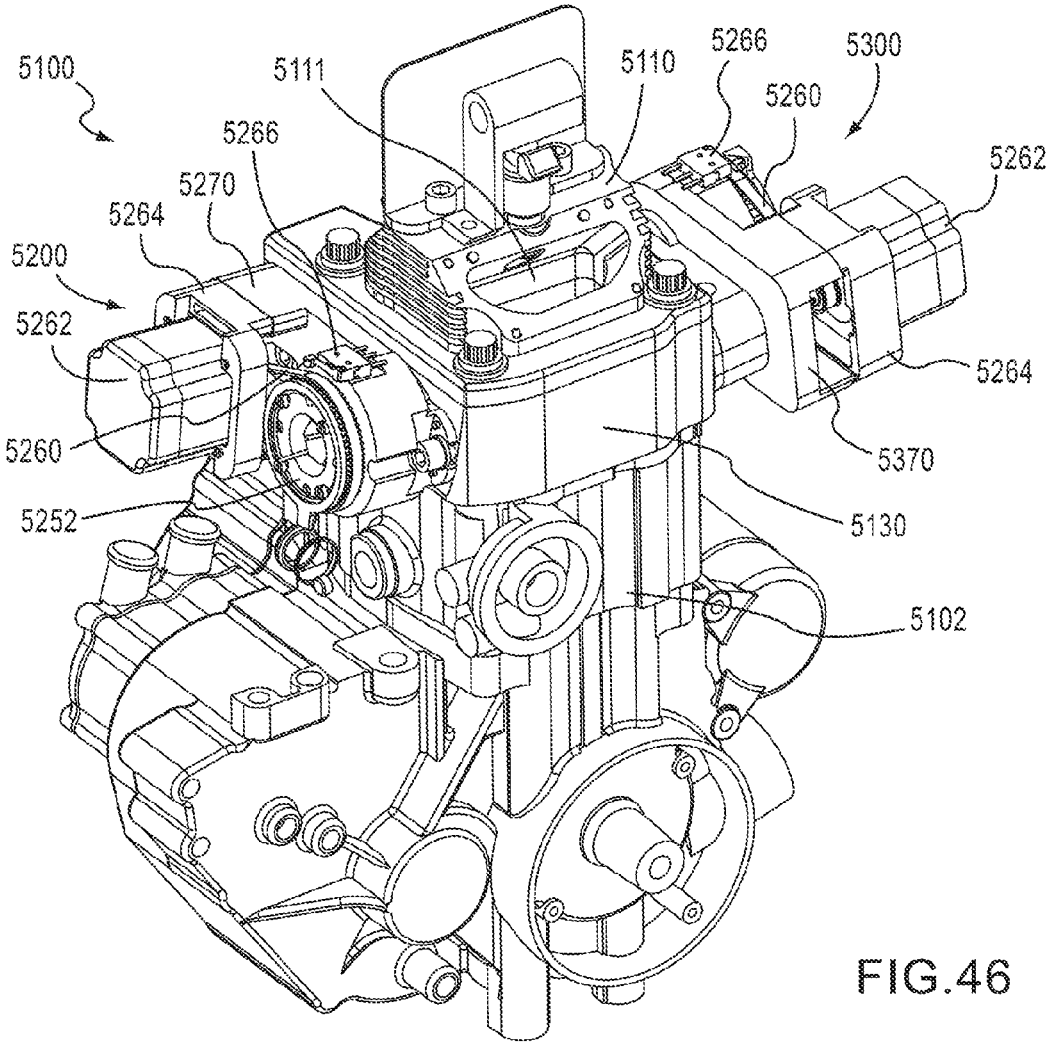
FIGS. 46 and 47 are perspective views of an engine according to an embodiment.
Figure 47:
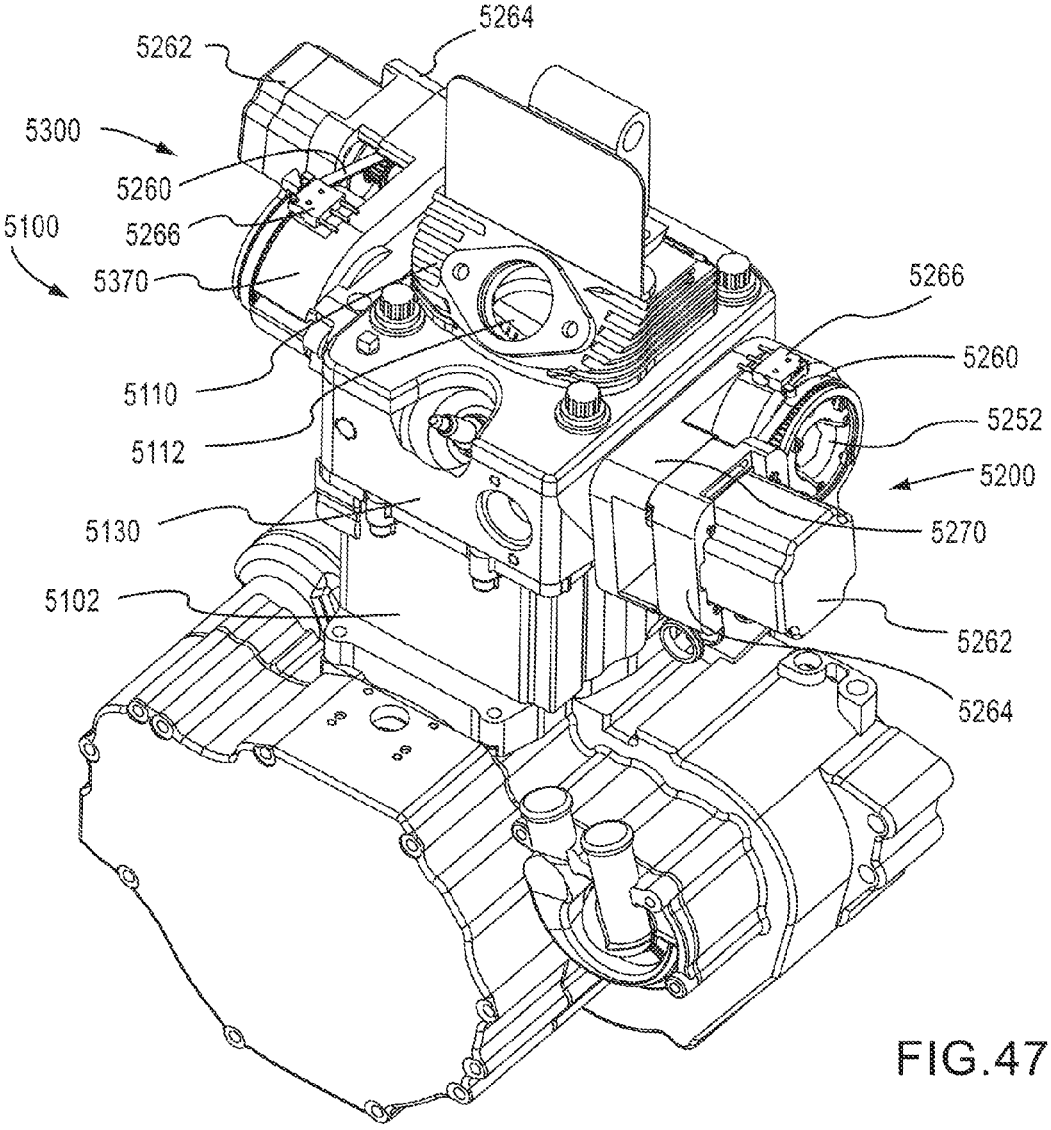
Figure 48:
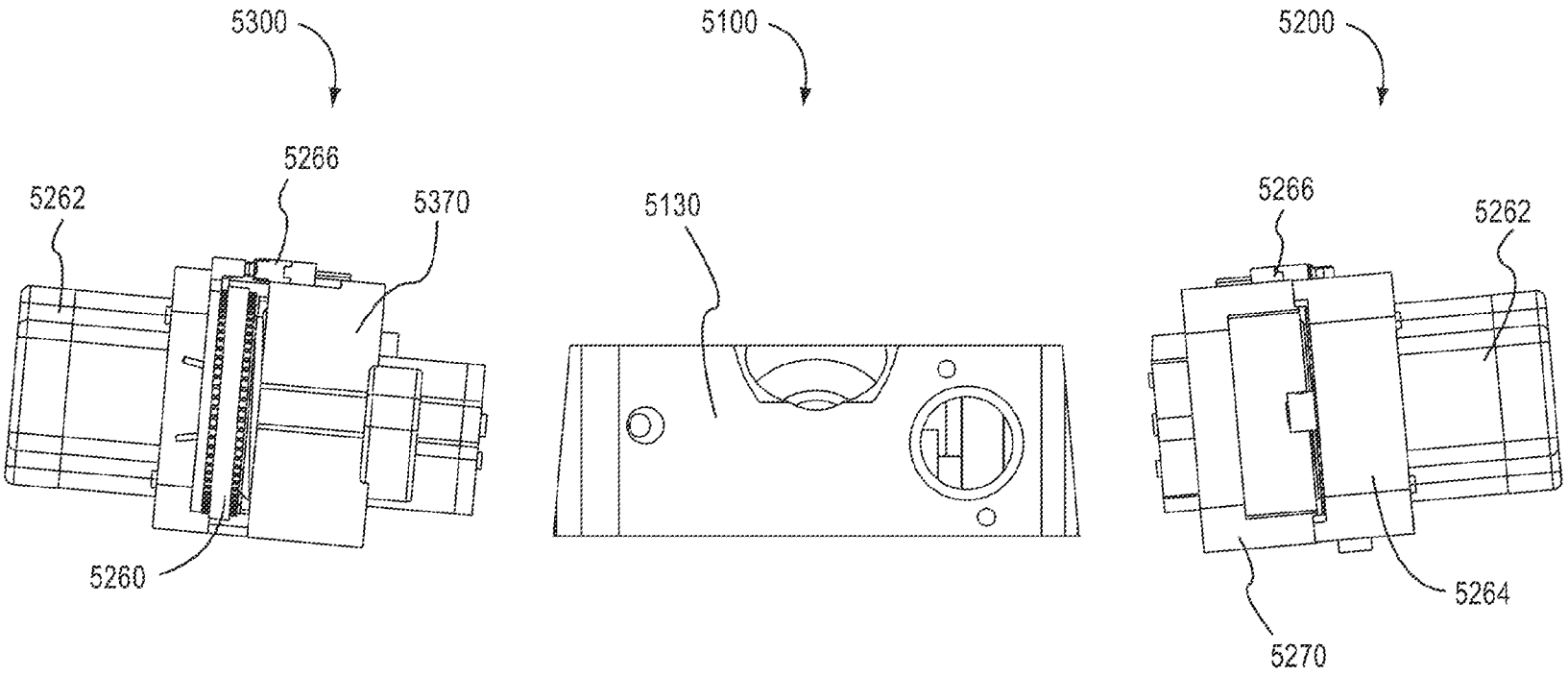
FIG. 48 is a side view of a cylinder head, an intake valve actuator assembly, and an exhaust valve actuator assembly of the engine shown in FIGS. 46 and 47.
Figure 49:
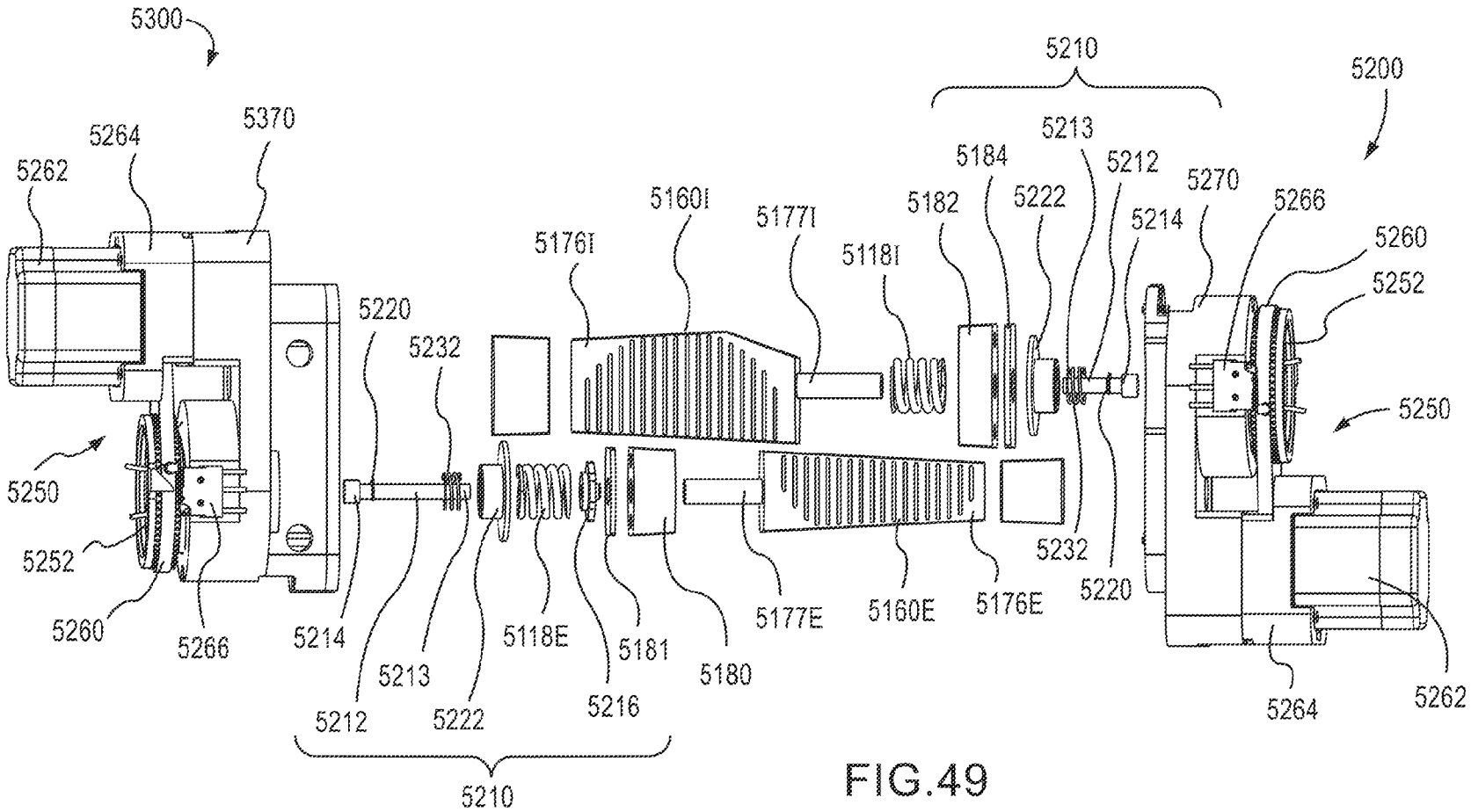
FIG. 49 is a top perspective exploded view of a portion of the engine shown in FIGS. 46 and 47.

FIGS. 46 and 47 are perspective views of an engine 5100 having a variable travel intake valve actuator assembly 5200 and a variable travel exhaust valve actuator assembly 5300, according to an embodiment. The engine 5100 includes an engine block 5102, a cylinder head assembly 5130, an intake valve actuator assembly 5200 and an exhaust valve actuator assembly 5300. The engine block 5102 defines a cylinder 5103 (shown in dashed lines in FIGS. 51, 52, 59 and 60) within which a piston (not shown) can be disposed. The cylinder head assembly 5130 is coupled to the engine block 5102 such that a portion of the cylinder head assembly 5130 covers the upper portion of the cylinder 5103 to form a combustion chamber. A gas manifold 5110 is coupled to an upper surface of the cylinder head assembly 5130. The gas manifold 5110 defines an exhaust gas pathway 5112 and an intake air pathway 5111. In use, exhaust gas can be conveyed from the cylinder 5103 and into the exhaust gas pathway 5112 via the cylinder head assembly 5130. Similarly, intake air (and/or any suitable intake charge) can be conveyed from the intake air pathway 5111 into the cylinder 5103 via the cylinder head assembly 5130.

Figure 51:
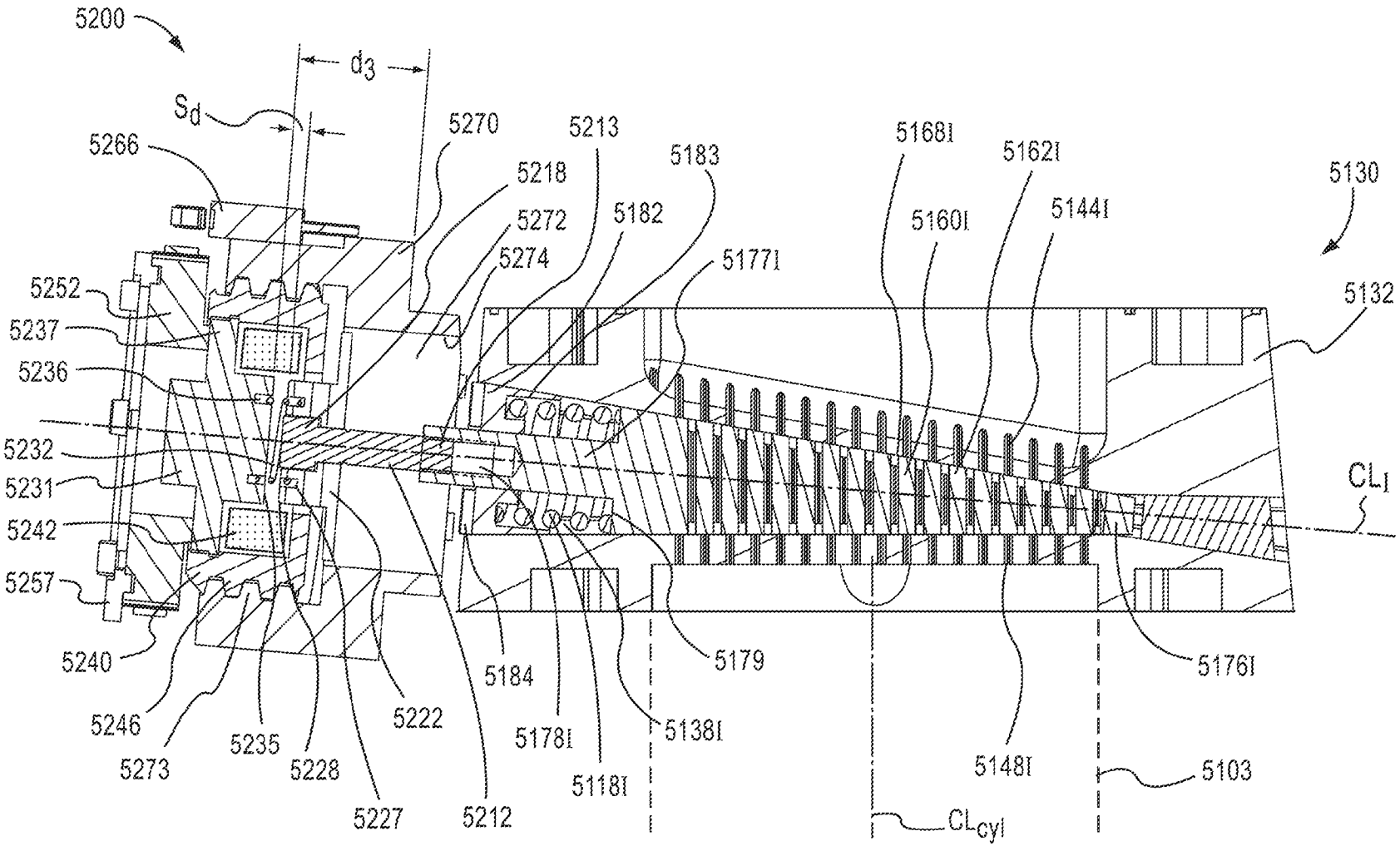
FIGS. 51 and 52 are side cross-sectional views of a portion of the engine shown in FIGS. 46 and 47, with the intake valve in a closed position and a first opened position, respectively.
Figure 52:
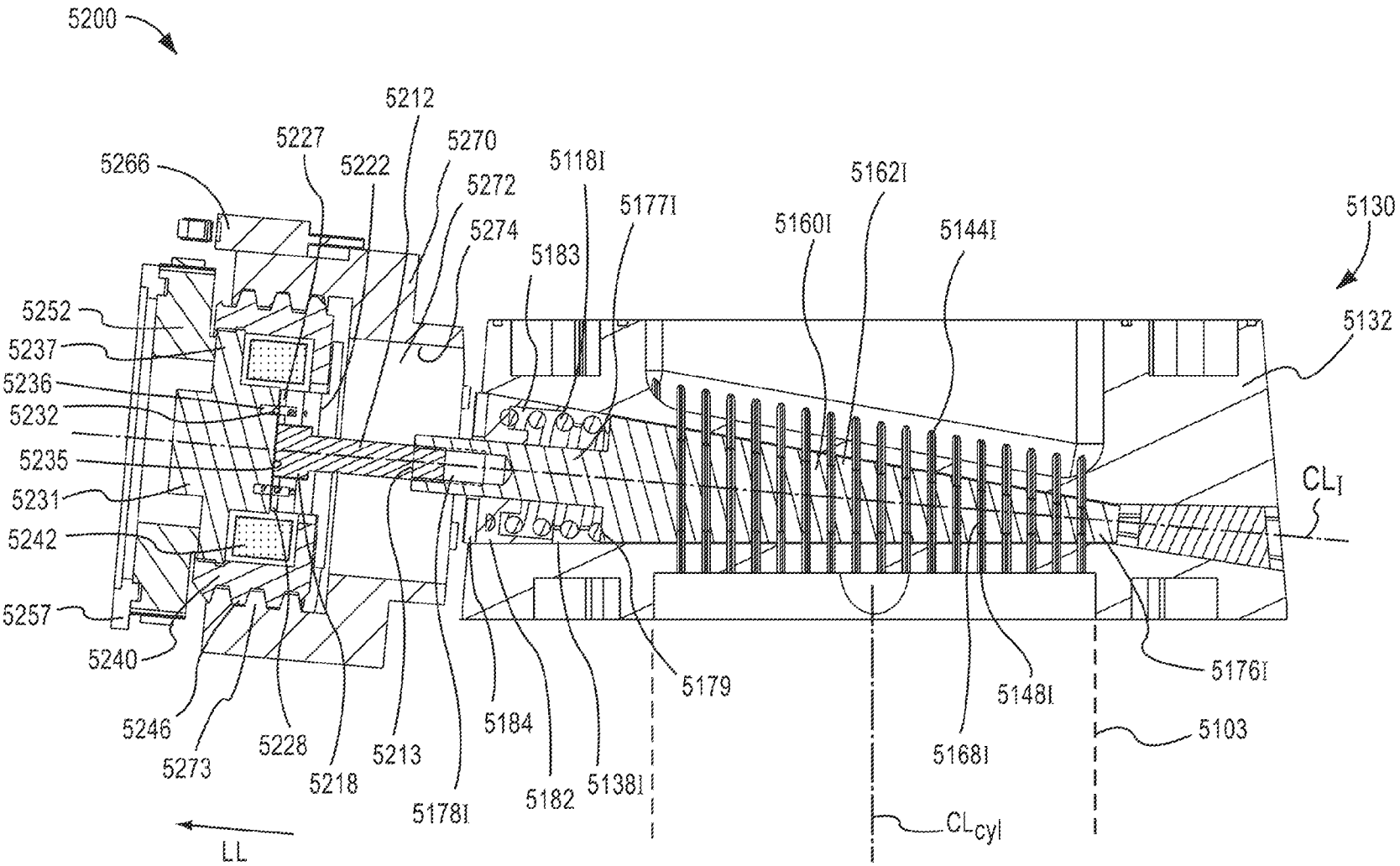
Figure 53:
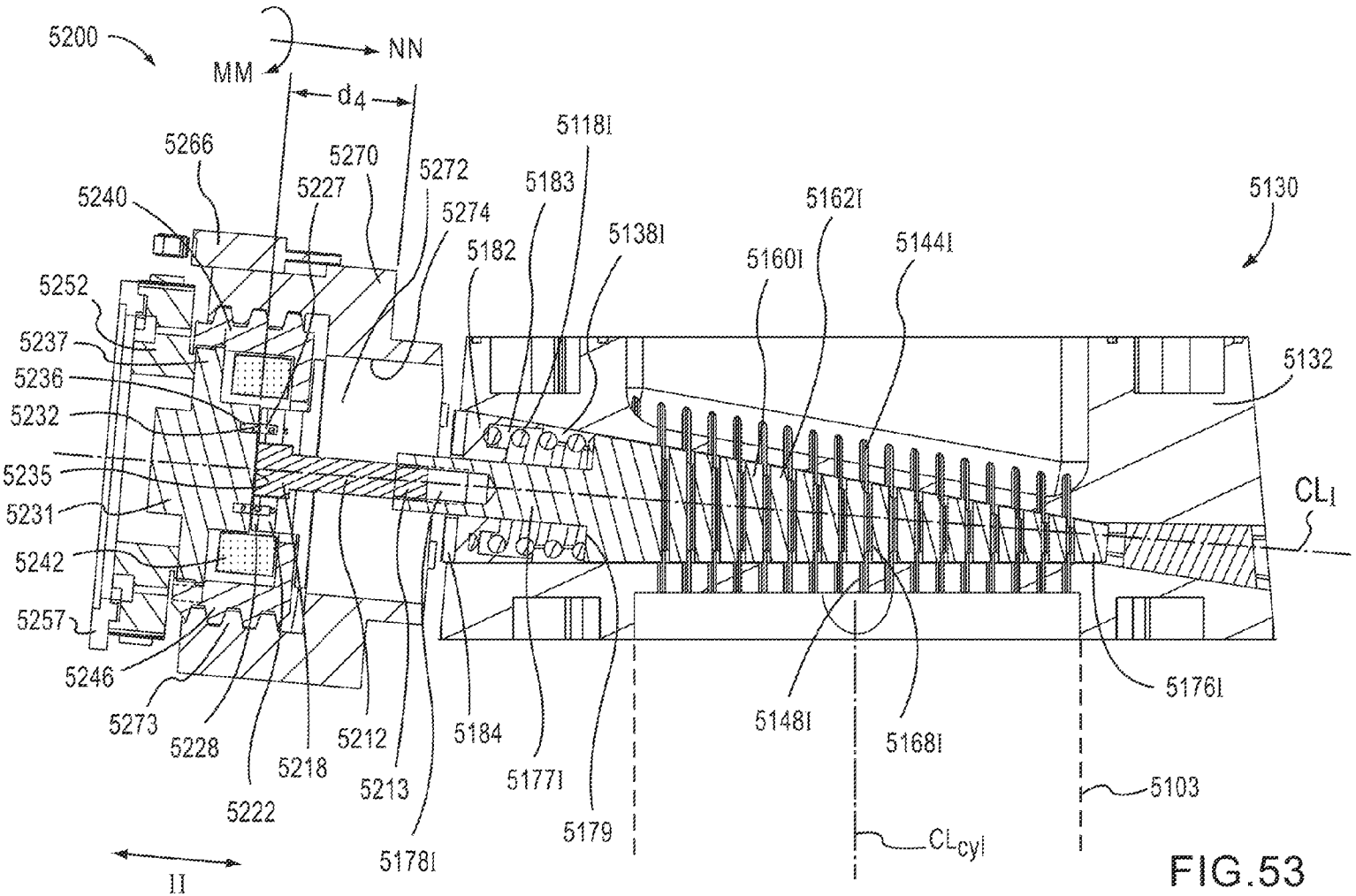
FIG. 53 is a side cross-sectional views of a portion of the engine shown in FIGS. 46 and 47, with the intake valve in a second opened position.

The cylinder head assembly 5130 includes a cylinder head 5132, an intake valve 5160I and an exhaust valve 5160E. Referring to FIGS. 51-53, the cylinder head 5132 defines an intake valve pocket 5138I within which the intake valve 5160I is movably disposed. The cylinder head 5132 defines a set of cylinder flow passages 5148I and a set of intake manifold flow passages 5144I. Each of the cylinder flow passages 5148I is in fluid communication with the cylinder 5103 (shown in dashed lines) and the intake valve pocket 5138I. Similarly, each of the intake manifold flow passages 5144I is in fluid communication with the intake air pathway 5111 of the gas manifold 5110 and the intake valve pocket 5138I of the cylinder head 5132. As described in more detail herein, in this arrangement, when the intake valve 5160I is in the closed position (e.g., FIG. 51), the intake pathway 5111 of the gas manifold 5110 is fluidically isolated from the cylinder 5103. Conversely, when the intake valve 5160I is in an opened position (e.g., FIGS. 52 and 53), the intake pathway 5111 of the gas manifold 5110 is in fluid communication with the cylinder 5103. Accordingly, the timing and/or amount of intake air conveyed into the cylinder 5103 can be controlled by varying the opening and closing events of the intake valve 5160I. Although the intake valve 5160I is shown as having two opened positions (FIGS. 52 and 53), as described in more detail below, the intake valve actuator assembly 5200 can selectively vary the distance through which the intake valve 5160I travels when moved between the closed position and the opened position. In this manner, the intake valve 5160I can be moved between the closed position and any number of different partially opened positions.

Figure 59:
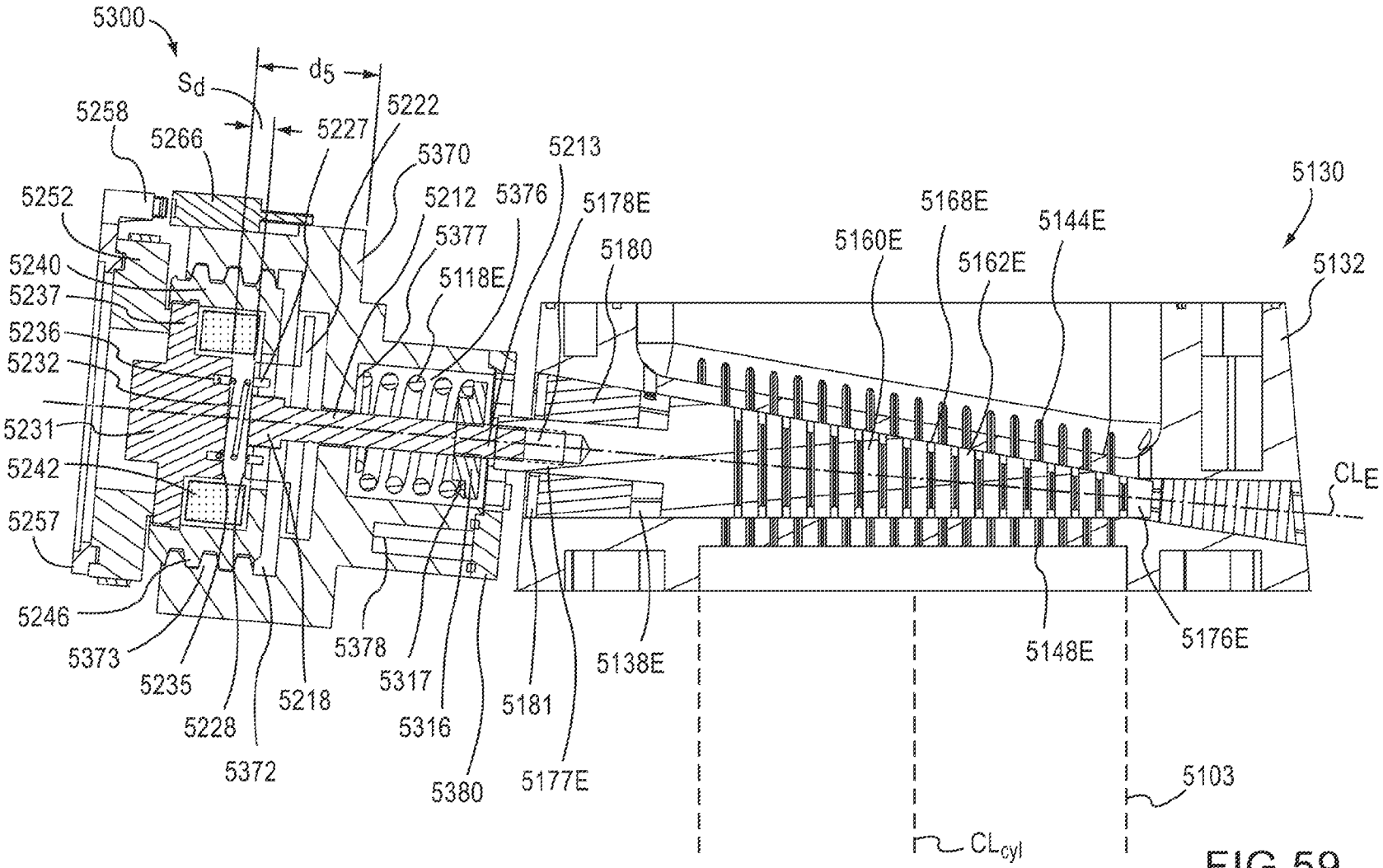
FIGS. 59 and 60 are side cross-sectional views of a portion of the engine shown in FIGS. 46 and 47, with the exhaust valve in a closed position and a first opened position, respectively.
Figure 60:
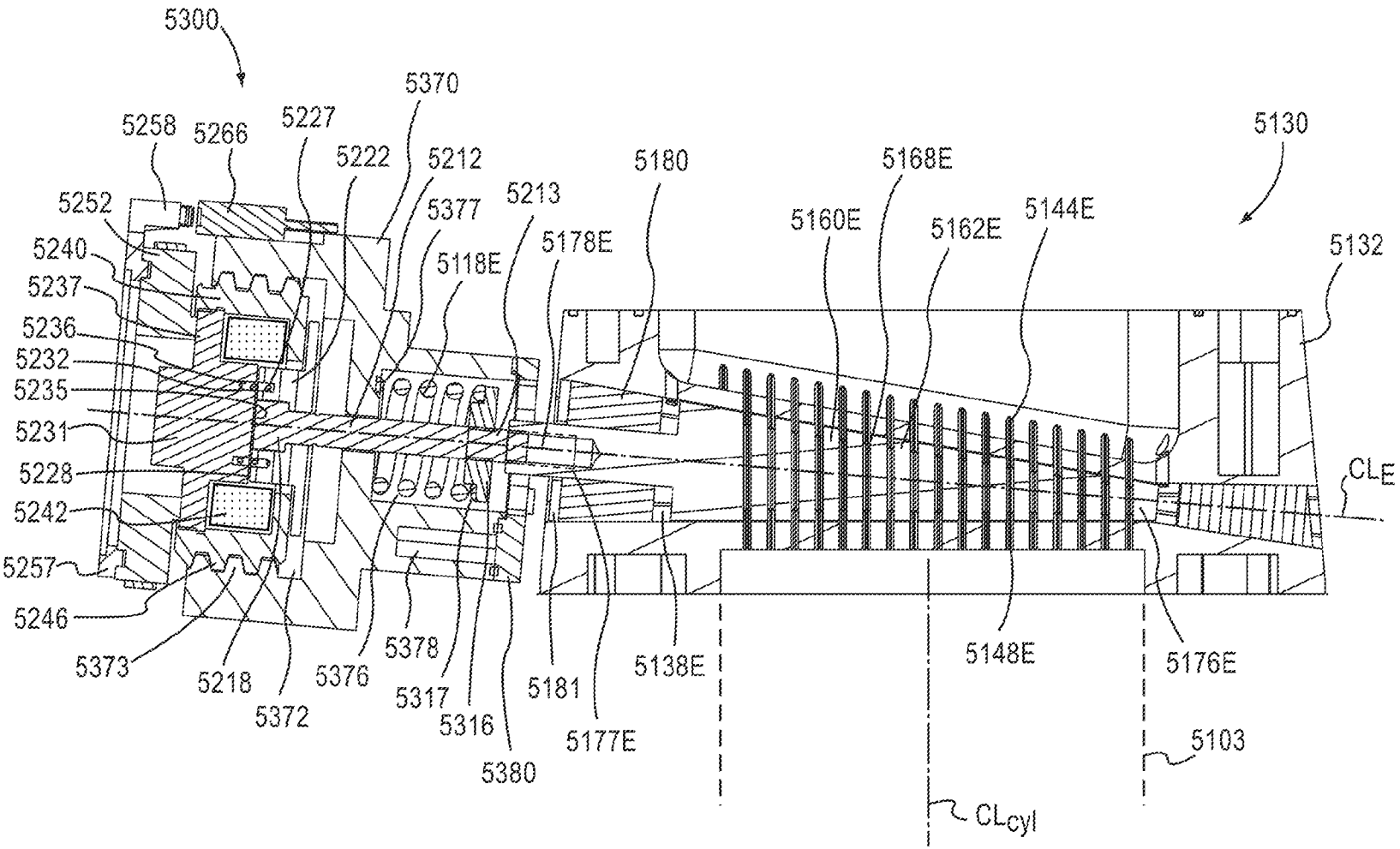
Figure 61:
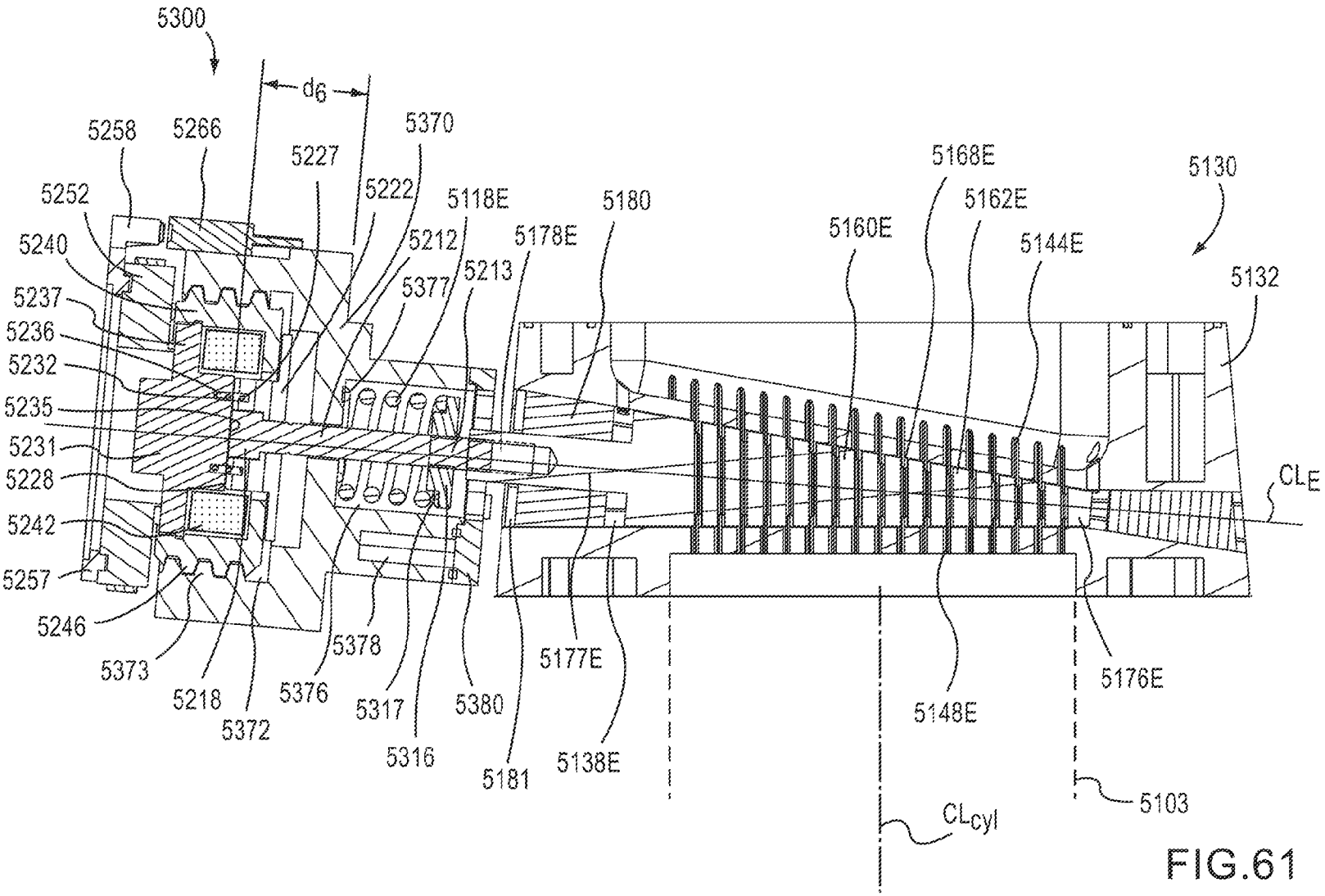
FIG. 61 is a side cross-sectional views of a portion of the engine shown in FIGS. 46 and 47, with the exhaust valve in a second opened position.

Referring to FIGS. 59-61, the cylinder head 5132 defines an exhaust valve pocket 5138E within which the exhaust valve 5160E is movably disposed. The cylinder head 5132 defines a set of cylinder flow passages 5148E and a set of exhaust manifold flow passages 5144E. Each of the cylinder flow passages 5148E is in fluid communication with the cylinder 5103 (shown in dashed lines) and the exhaust valve pocket 5138E. Similarly, each of the exhaust manifold flow passages 5144E is in fluid communication with the exhaust pathway 5112 of the gas manifold 5110 and the exhaust valve pocket 5138E of the cylinder head 5132. As described in more detail herein, in this arrangement, when the exhaust valve 5160E is in the closed position (e.g., FIG. 59), the exhaust pathway 5112 of the gas manifold 5110 is fluidically isolated from the cylinder 5103. Conversely, when the exhaust valve 5160E is in an opened position (e.g., FIGS. 60-61), the exhaust pathway 5112 of the gas manifold 5110 is in fluid communication with the cylinder 5103. Accordingly, timing and/or amount of exhaust gas conveyed out of the cylinder 5103 can be controlled by varying the opening and closing events of the exhaust valve 5160E. Although the exhaust valve 5160E is shown as having only two opened positions (FIGS. 60 and 61), as described in more detail below, the exhaust valve actuator assembly 5300 can selectively vary the distance through which the exhaust valve 5160E travels when moved between the closed position and the opened position. In this manner, the exhaust valve 5160E can be moved between the closed position and any number of different partially opened positions.

Figure 54:
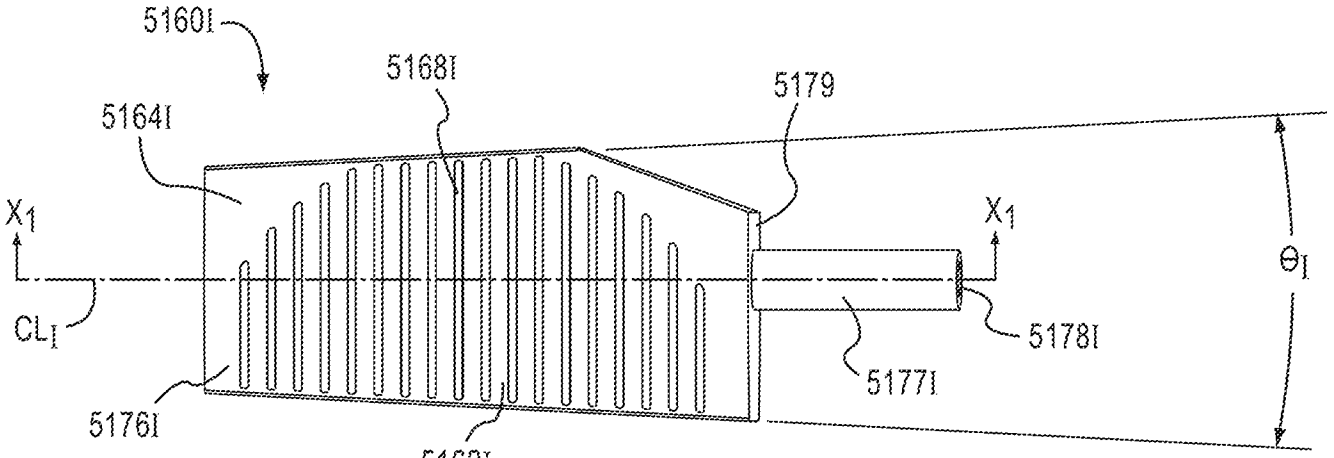
FIG. 54 is a top perspective view of the intake valve of the engine shown in FIG. 49.
Figure 55:
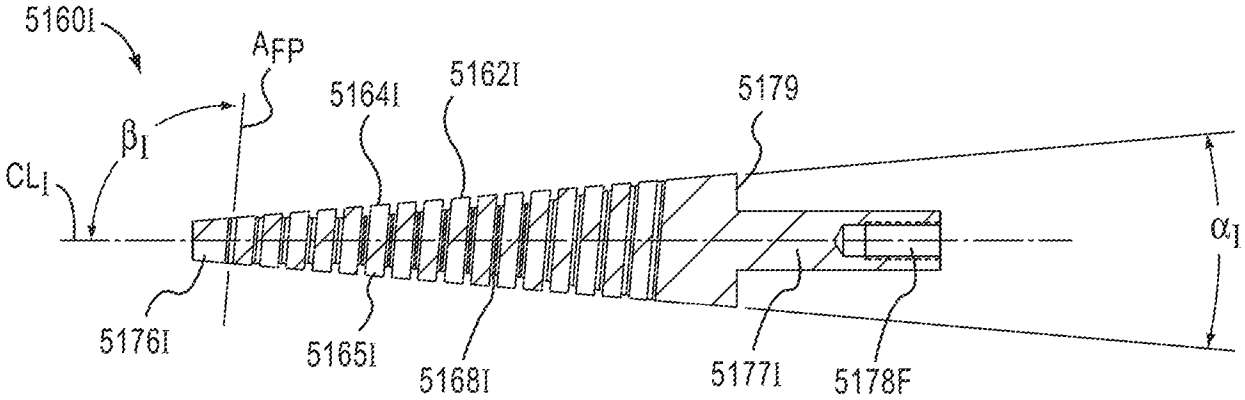
FIG. 55 is a side cross-sectional view of the intake valve shown in FIG. 54 taken along line X1-X1 in FIG. 54.
Figure 56:
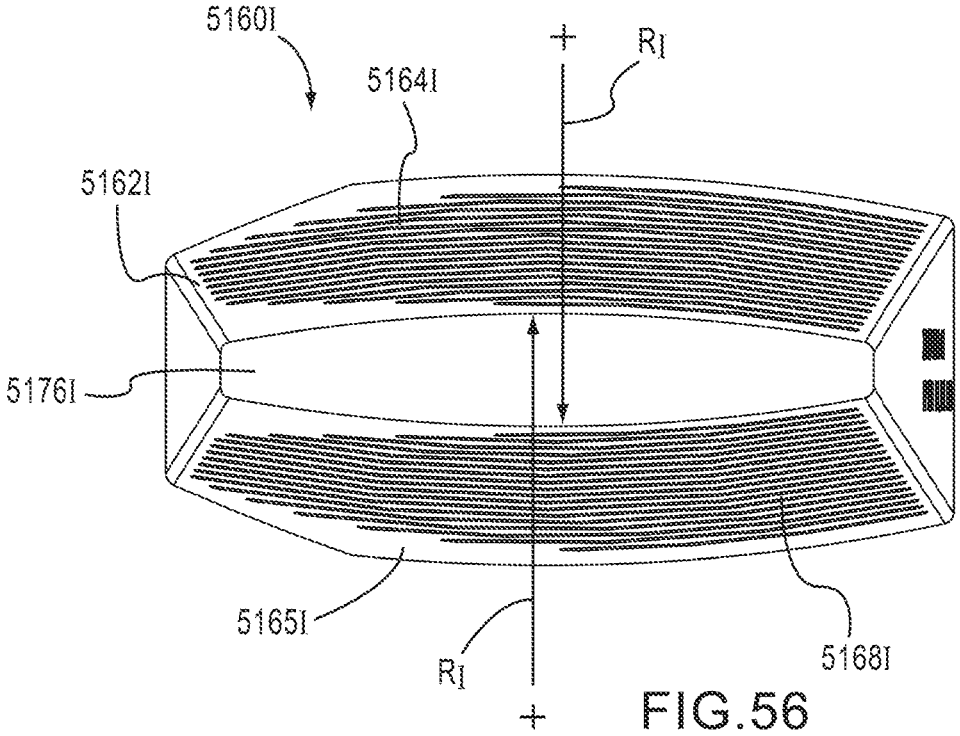
FIG. 56 is a front view of the intake valve shown in FIG. 54.

Referring to FIGS. 54-56, the intake valve 5160I has tapered portion 5162I, a first end portion 5176I and a second end portion 5177I, and defines a center line $CL_I$. As shown in FIG. 55, the second end portion 5177I defines a threaded opening 5178I within which the intake pull rod 5212 is threadedly coupled. The second end portion 5177I includes a spring engagement surface 5179 against which the intake valve spring 5118I is disposed (see e.g., FIGS. 51-53). In this manner, the intake valve 5160I can be biased in the closed position within the intake valve pocket 5138I.

The tapered portion 5162I of the intake valve 5160I includes a first surface 5164I and a second surface 5165I. As shown in FIG. 56, the first surface 5164I and the second surface 5165I are each curved surfaces having a radius of curvature $R_1$ about an axis parallel to the center line $CL_I$. Although the first surface 5164I and the second surface 5165I are shown has having the same radius of curvature, in other embodiments, the radius of curvature of the first surface 5164I can be different from the radius of curvature of the second surface 5165I. Similarly stated in some embodiments, the tapered portion 5162I of the intake valve 5160I can be asymmetrical when viewed in a plane substantially normal to the center line $CL_I$. The radius of curvature $R_1$ can have any suitable value. In some embodiments, the radius of curvature $R_1$ can be approximately 114 mm (4.5 inches).

As shown in FIG. 54, which illustrates a top view of the intake valve 5160I, the tapered portion 5162I of the intake valve 5160I has a first taper angle $\Theta_1$. Similarly stated, a width of the tapered portion 5162I as measured along a first axis normal to the center line $CL_I$ linearly decreases along the center line $CL_I$. As shown in FIG. 55, which presents a side view of the intake valve 5160I, the first surface 5164I and the second surface 5165I are angularly offset from each other by a second taper angle $\alpha_I$. Similarly stated, a thickness of the tapered portion 5162I as measured along a second axis normal to the center line $CL_I$ linearly decreases along the center line $CL_I$. In this manner, the tapered portion 5162I of the intake valve 5160I is tapered in two dimensions. The first taper angle $\Theta_I$ and the second taper angle $\alpha_I$ can have any suitable value. For example, in some embodiments, the first taper angle $\Theta_I$ has a value of between approximately 3 degrees and approximately 10 degrees and the second taper angle $\alpha_I$ has a value of approximately 10 degrees (5 degrees for each side).

The tapered portion 5162I of the intake valve 5160I defines a set of flow passages 5168I therethrough (only one flow passage is labeled in FIGS. 54 and 55). As shown in FIG. 55, the flow passages 5168I are angularly offset from the center line $CL_I$ of the intake valve 5160I by an angle $\beta_I$ greater than ninety degrees. Similarly stated, a longitudinal axis $A_{FP}$ of each flow passage 5168I is non-normal to the center line $CL_I$. In this manner, as shown in FIGS. 51-53, when the intake valve 5160I is disposed within the intake valve pocket 5138I such that the center line $CL_I$ of the intake valve 5160I is non-normal to a center line $CL_{cyl}$ of the cylinder, the longitudinal axis $A_{FP}$ of each flow passage 5168I is substantially normal to the center line $CL_{cyl}$ the cylinder.

As shown in FIG. 54, each flow passage 5168I does not have the same shape and/or size as the other flow passages 5168I. Rather, the size of the flow passages 5168I closer to the ends of the tapered portion 5162I is smaller than the size of the flow passages 5168I at the center of the tapered portion 5162I. In this manner, the size (e.g., length) of the flow passages 5168I can correspond to the size and/or shape of the cylinder 5103.

The first surface 5164I of the tapered portion 5162I and the second surface 5165I of the tapered portion 5162I each include a set of sealing portions (not shown in FIGS. 54-56) that correspond to the flow passages 5168I. As described above, the sealing portions substantially circumscribe the openings of the first surface 5164I and the second surface 5165I. Thus, when the intake valve 5160I is in the closed position, the sealing portions engage and/or contact the surface of the cylinder head 5132 that defines the intake valve pocket 5138I such that the cylinder flow passages 5148I and the intake manifold flow passages 5144I are fluidically isolated from the intake valve pocket 5138I.

Figure 64:
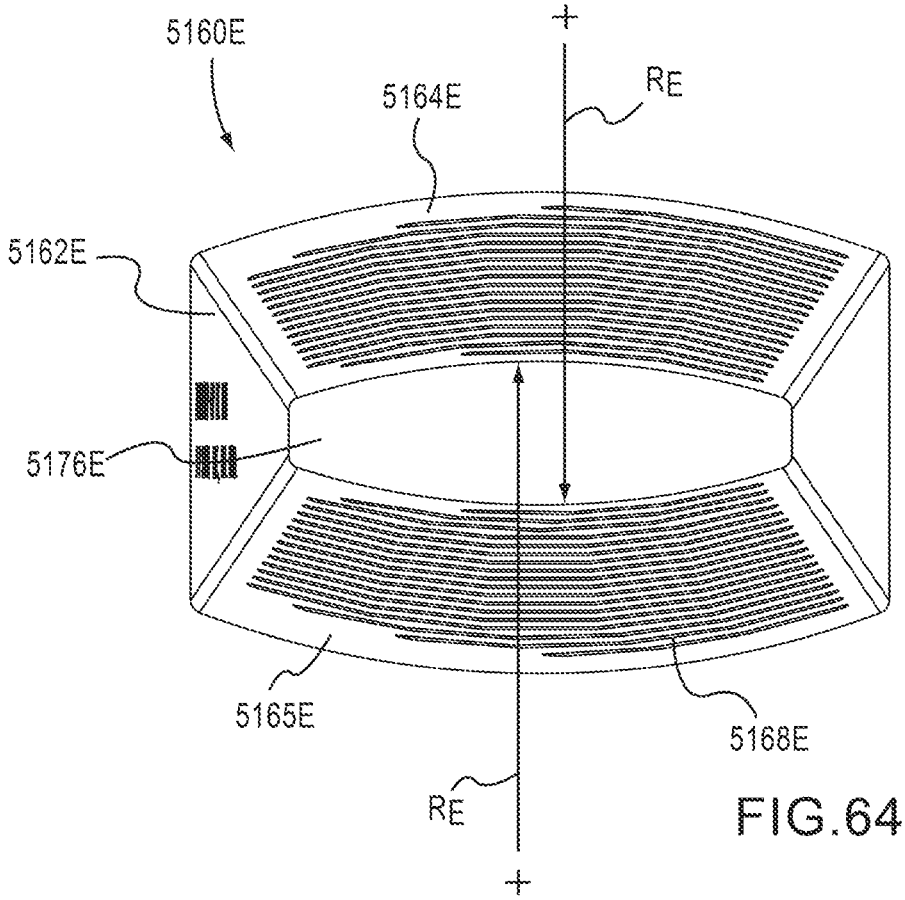
FIG. 64 is a front view of the intake valve shown in FIG. 62.
Figure 62:
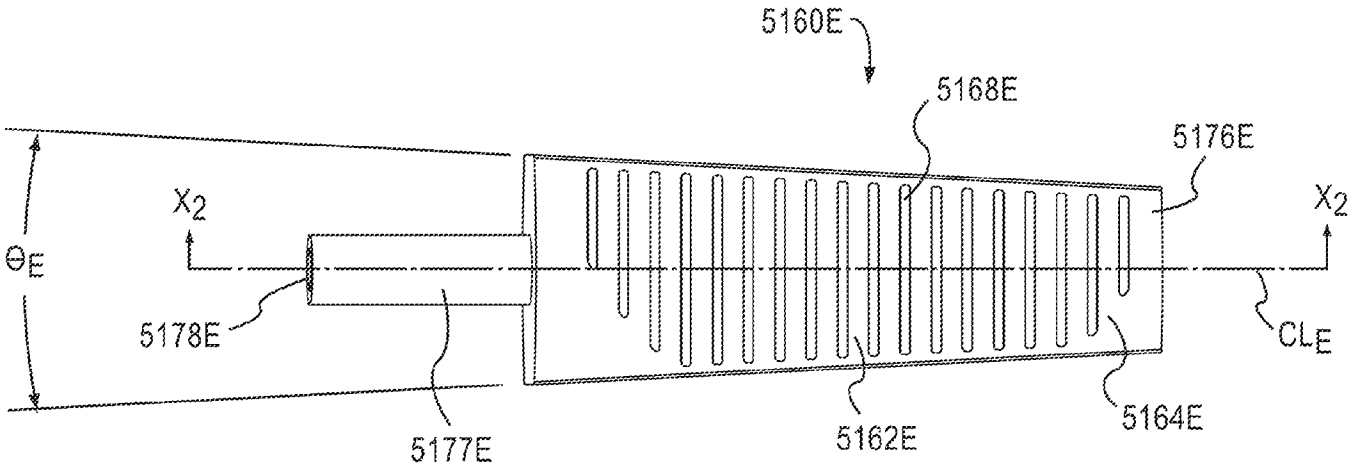
FIG. 62 is a top perspective view of the exhaust valve of the engine shown in FIG. 49.
Figure 63:
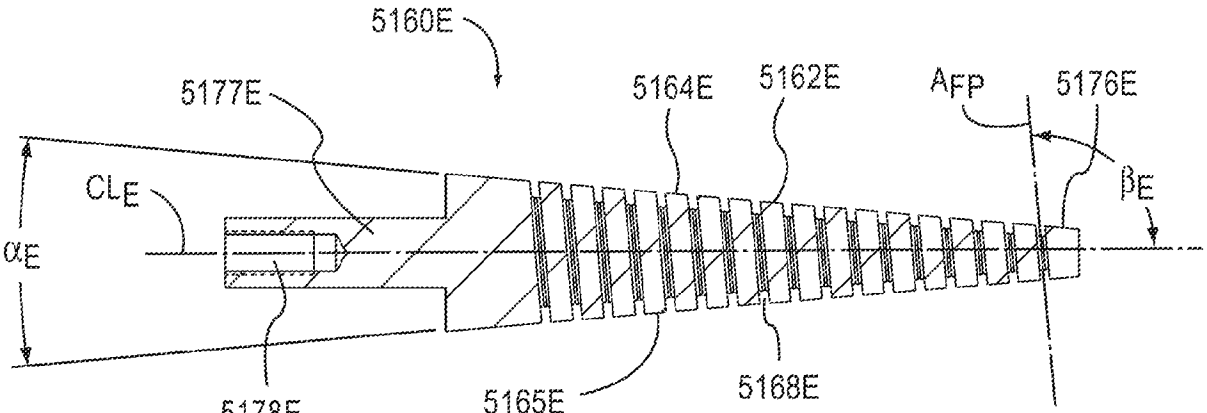
FIG. 63 is a side cross-sectional view of the exhaust valve shown in FIG. 62 taken along line X2-X2 in FIG. 62.

Referring to FIGS. 62-64, the exhaust valve 5160E has tapered portion 5162E, a first end portion 5176E and a second end portion 5177E, and defines a center line $CL_E$. As shown in FIG. 63, the second end portion 5177E defines a threaded opening 5178E within which the exhaust pull rod 5312 is threadedly coupled. The tapered portion 5162E of the exhaust valve 5160E includes a first surface 5164E and a second surface 5165E. As shown in FIG. 64, the first surface 5164E and the second surface 5165E are each curved surfaces having a radius of curvature $R_E$ about an axis parallel to the center line $CL_I$. Although the first surface 5164E and the second surface 5165E are shown has having the same radius of curvature, in other embodiments, the radius of curvature of the first surface 5164E can be different from the radius of curvature of the second surface 5165E. Similarly stated in some embodiments, the tapered portion 5162E of the exhaust valve 5160E can be asymmetrical when viewed in a plane substantially normal to the center line $CL_I$. The radius of curvature $R_E$ can have any suitable value. In some embodiments, the radius of curvature $R_E$ can be approximately can be approximately 47 mm (1.85 inches).

As shown in FIG. 62, which illustrates a top view of the exhaust valve 5160E, the tapered portion 5162E of the exhaust valve 5160E has a first taper angle $\Theta_E$. Similarly stated, a width of the tapered portion 5162E as measured along a first axis normal to the center line $CL_E$ linearly decreases along the center line $CL_E$. As shown in FIG. 63, which presents a side view of the exhaust valve 5160E, the first surface 5164E and the second surface 5165E are angularly offset from each other by a second taper angle $\alpha_E$. Similarly stated, a thickness of the tapered portion 5162E as measured along a second axis normal to the center line $CL_E$ linearly decreases along the center line $CL_E$. In this manner, the tapered portion 5162E of the exhaust valve 5160E is tapered in two dimensions. The first taper angle $\Theta_E$ and the second taper angle $\alpha_E$ can have any suitable value. For example, in some embodiments, the first taper angle $\Theta_E$ has a value of between approximately 3 degrees and approximately 10 degrees and the second taper angle $\alpha_E$ has a value of approximately 10 degrees (5 degrees for each side).

The tapered portion 5162E of the exhaust valve 5160E defines a set of flow passages 5168E therethrough (only one flow passage is labeled in FIGS. 62 and 63). As shown in FIG. 63, the flow passages 5168E are angularly offset from the center line $CL_E$ of the exhaust valve 5160E by an angle $\beta_E$ greater than ninety degrees. Similarly stated, a longitudinal axis $A_{FP}$ of each flow passage 5168E is non-normal to the center line $CL_E$. In this manner, as shown in FIGS. 59-61, when the exhaust valve 5160E is disposed within the exhaust valve pocket 5138E such that the center line $CL_E$ of the exhaust valve 5160E is non-normal to a center line $CL_{cyl}$ of the cylinder, the longitudinal axis $A_{FP}$ of each flow passage 5168E is substantially normal to the center line $CL_{cyl}$ the cylinder.

As shown in FIG. 62, each flow passage 5168E does not have the same shape and/or size as the other flow passages 5168E. Rather, the size of the flow passages 5168E closer to the ends of the tapered portion 5162E is smaller than the size of the flow passages 5168E at the center of the tapered portion 5162E. In this manner, the size (e.g., length) of the flow passages 5168E can correspond to the size and/or shape of the cylinder 5103.

The first surface 5164E of the tapered portion 5162E and the second surface 5165E of the tapered portion 5162E each include a set of sealing portions (not shown in FIGS. 62-64) that correspond to the flow passages 5168E. As described above, the sealing portions substantially circumscribe the openings of the first surface 5164E and the second surface 5165E. Thus, when the exhaust valve 5160E is in the closed position, the sealing portions engage and/or contact a surface of the cylinder head 5132 that defines the exhaust valve pocket 5138E such that the cylinder flow passages 5148E and the exhaust manifold flow passages 5144E are fluidically isolated from the exhaust valve pocket 5138E.

Referring to FIGS. 49 and 51-53, the intake valve 5160I is movably disposed within the intake valve pocket 5138I of the cylinder head 5132. A plug 5182 is disposed within the intake valve pocket 5138I adjacent the second end portion 5177I of the intake valve 5160I. The plug 5182 has a tapered outer surface that corresponds to the shape of the intake valve pocket 5138I. In this manner, the outer surface of the plug 5182 and the surface defining the intake valve pocket 5138I can form a substantially fluid-tight seal. Moreover, the tapered outer surface of the plug 5182 prevents further inward movement of the plug 5182 when the plug 5182 is disposed within the intake valve pocket 5138I. A spacer 5184 is disposed at least partially within the intake valve pocket 5138I in contact with the plug 5182. The spacer 5184 provides a mechanism by which the plug 5182 can be securely coupled within the intake valve pocket 5138I. The spacer 5184 can be coupled within the valve pocket 5138I by a set screw, a clamping force exerted by the housing 5270 or the like.

As shown in FIG. 52, when the intake valve 5160I is in the fully opened position, the spring engagement surface 5179 of the intake valve 5160I is spaced apart from the end of the plug 5182. Thus, the plug 5182 does not provide a positive stop to limit the travel of the intake valve 5160I within the valve pocket 5138I. Rather, as described more detail below, the travel of the intake valve 5160I is controlled by the intake valve actuator assembly 5200. Moreover, as shown in FIGS. 51-53, the sleeve 5182 defines a spring groove 5183 within which an end portion of the intake valve spring 5118I is disposed. The opposite end portion of the intake valve spring 5118I is in contact with the spring engagement surface 5179 of the intake valve 5160I. In this manner, the intake valve 5160I is biased in the closed position within the intake valve pocket 5138I.

Referring to FIGS. 49, 59-61, the exhaust valve 5160E is movably disposed within the exhaust valve pocket 5138E of the cylinder head 5132. A plug 5180 is disposed within the exhaust valve pocket 5138E adjacent the second end portion 5177E of the exhaust valve 5160I. The plug 5180 has a tapered outer surface that corresponds to the shape of the exhaust valve pocket 5138I. In this manner, the outer surface of the plug 5180 and the surface defining the exhaust valve pocket 5138E can form a substantially fluid-tight seal. Moreover, when the plug 5180 is disposed within the exhaust valve pocket 5138I, the tapered arrangement prevents further inward movement of the plug 5182. A spacer 5181 is disposed at least partially within the exhaust valve pocket 5138E in contact with the plug 5180. The spacer 5181 provides a mechanism by which the plug 5180 can be securely coupled within the exhaust valve pocket 5138I, as described above.

As shown in FIG. 60, when the exhaust valve 5160E is in the fully opened position, the shoulder of the exhaust valve 5160E is spaced apart from the end of the plug 5182. In this manner, the plug 5182 does not provide a positive stop to limit the travel of the exhaust valve 5160E within the valve pocket 5138I. Rather, as described more detail below, the travel of the exhaust valve 5160E is controlled by the exhaust valve actuator assembly 5300. In contrast to the intake valve train, as shown in FIGS. 59-61, the exhaust valve spring 5118E is disposed outside of the exhaust valve pocket 5138E. In this manner, the exhaust valve spring 5118E is not exposed to the high temperatures associated with the exhaust gas. As discussed in more detail herein, the exhaust valve spring 5118E is disposed within the exhaust valve actuator assembly 5300.

Figure 50:
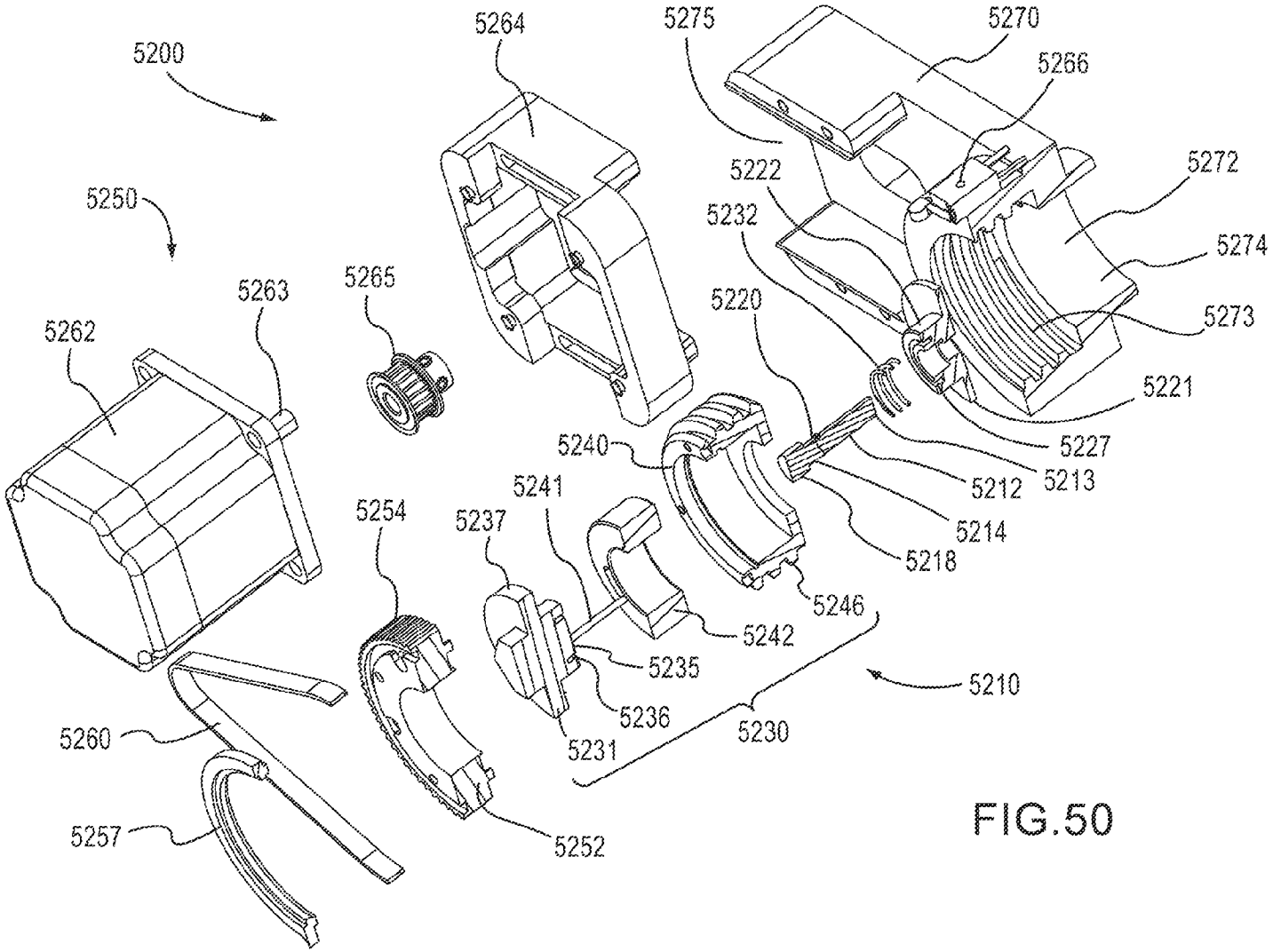
FIG. 50 is a perspective exploded view of the intake valve actuator assembly of the engine shown in FIGS. 46 and 47.

As described in more detail below, the intake actuator assembly 5200 is configured to move the intake valve 5160I between its closed position and its opened position and selectively vary the distance through which the intake valve 5160I travels when moving between its closed position and an opened position. Similarly stated, the intake actuator assembly 5200 is configured to move the intake valve 5160I between its closed position (FIG. 51) and any number of different opened positions. Referring to FIG. 50, the intake actuator assembly 5200 includes a housing 5270 that contains a valve actuator 5210 and a variable travel actuator 5250. More particularly, the housing 5270 defines a first cavity 5272, within which the valve actuator 5210 is disposed, and a second cavity 5275, within which a portion of the variable travel actuator 5250 is disposed. As shown in FIGS. 46 and 47, the housing 5270 is coupled to the cylinder head 5132 such that at least a portion of the first cavity 5272 is aligned with the intake valve pocket 5138I. In this manner, as described in more detail below, the valve actuator 5210 can engage and/or actuate the intake valve 5160I. Note that FIGS. 51-53 shows the housing 5270 as being spaced apart from the cylinder head 5132 for purposes of clarity.

The valve actuator 5210 is a electronic actuator configured to move the intake valve 5160I between its closed position and its opened position. The valve actuator 5210 includes a solenoid assembly 5230, a pull rod 5212 and an armature 5222. The solenoid assembly 5230 includes a solenoid casing 5240, a solenoid coil 5242 and an end stop 5231. The solenoid casing 5240 has a threaded portion 5246 corresponding to a threaded portion 5273 side wall of the housing 5270 that defines the first cavity 5272. Similarly stated, the outer surface of the solenoid casing 5240 includes male threads configured to mate with the female threads 5273 within the first cavity 5272 of the housing 5270. In this manner, the solenoid assembly 5230 can be threadedly coupled within the first cavity 5272 of the housing 5270. Thus, rotation of the solenoid assembly 5230 relative to the housing 5270 results in axial movement of the solenoid assembly 5230 within the first cavity 5272, as shown by the arrow II in FIG. 53. In this manner, as described in more detail below, the solenoid stroke (i.e., the distance between the solenoid assembly 5230 and the armature 5222 when the solenoid is not energized) can be selectively adjusted.

The solenoid coil 5242 is disposed within the solenoid casing 5240 such that the lead wire 5241 of the solenoid coil 5242 are accessible from a region outside of the solenoid casing 5240. Moreover, the solenoid coil 5242 is fixedly disposed within the solenoid casing 5240. Similarly stated, the solenoid coil 5242 is disposed within the housing 5240 such that movement of the solenoid coil 5242 relative to the housing 5240 is prevented.

The end stop 5231 has a flanged portion 5237 and an end surface 5235. The flanged portion 5237 is coupled to the solenoid casing 5240 such that the solenoid coil 5242 is enclosed and/or contained within the solenoid casing 5240. The flanged portion 5237 can be coupled to the solenoid casing 5240 in any suitable manner, such as, for example, using cap screws, a snap ring, a welded joint, an adhesive and/or the like. When the end stop 5231 is coupled to the solenoid casing 5240, the end surface 5235 is disposed within the central opening of the solenoid coil 5242 (see e.g., FIGS. 51-53). The end surface 5235 of the end stop 5231 defines a groove 5236 within which an end portion of the armature spring 5232 is disposed. As described in more detail below, the end surface 5235 contacts the armature 5222 when the solenoid assembly 5230 is energized.

Figure 57:
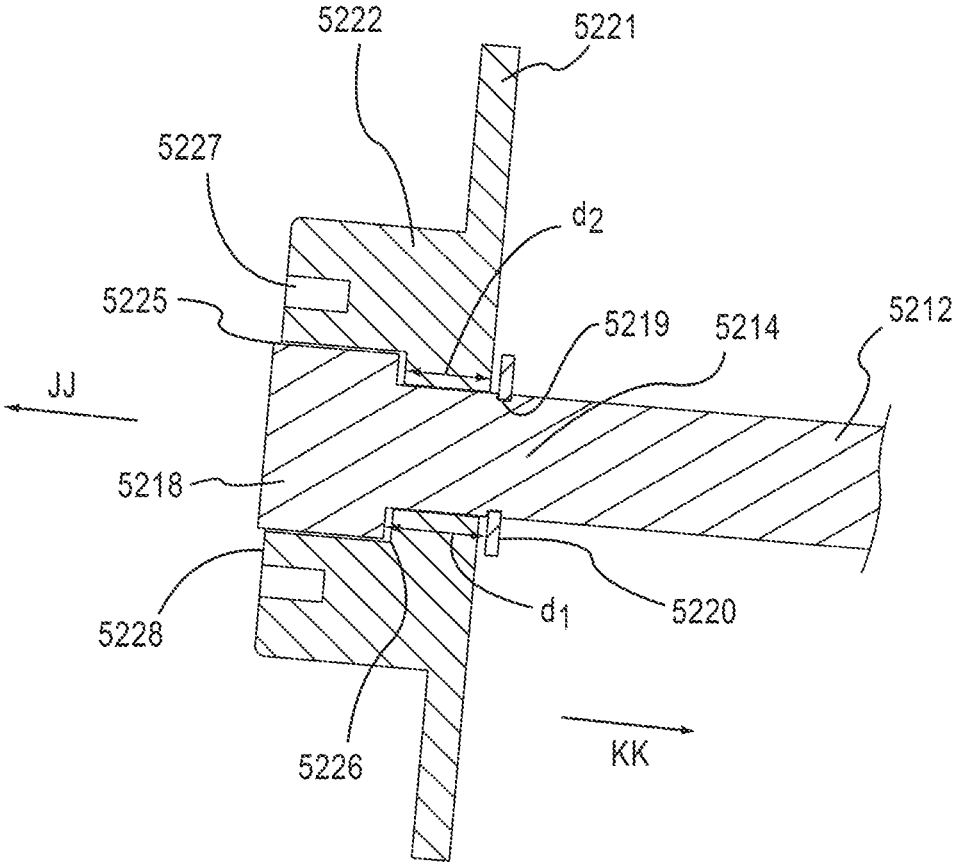
FIG. 57 is a cross-sectional view of a portion of the intake valve actuator assembly.

Referring to FIG. 57, the armature 5222 defines a lumen 5225 therethrough, and includes a flange 5221 and a contact surface 5228. The lumen 5225 is counter-bored such that an inner surface of the armature 5222 has a shoulder 5226. As described in more detail below, the shoulder 5226 is configured to engage the head 5218 of the pull rod 5212 to limit the axial movement of the armature 5222 relative to the pull rod 5212. The flange 5221 has a diameter smaller than a diameter of the inner surface 5274 of the first cavity 5272 of the housing 5270 (see e.g., FIG. 50). In this manner, the armature 5222 can move within the first cavity 5272 of the housing 5270 when the solenoid assembly 5240 is energized and/or de-energized. The contact surface 5228 of the armature 5222 defines a groove 5227 within which an end portion of the armature spring 5232 is disposed.

The pull rod 5212 has a first end portion 5213 and a second end portion 5214. The second end portion 5214 of the pull rod 5212 is coupled to the armature 5222. More particularly, as shown in FIG. 57, the second end portion 5214 of the pull rod 5212 has a head 5218 and defines a retaining ring groove 5219 within which a retaining ring 5220 is disposed. The second end portion 5214 of the pull rod 5212 is disposed within the lumen 5225 of the armature 5222 such that the head 5218 of the pull rod 5212 can engage and/or contact the shoulder 5226 of the armature 5222 to limit axial movement of the armature 5222 relative to the pull rod 5212 in a direction shown by the arrow JJ in FIG. 57.

When the second end portion 5214 of the pull rod 5212 is coupled to the armature 5222, the retaining ring 5220 is configured to contact the flange 5221 of the armature 5222 to limit axial movement of the armature 5222 relative to the pull rod 5212 in a direction shown by the arrow KK in FIG. 57. As shown in FIG. 57, the distance d1 between the head 5218 and the snap ring 5220 is greater than the distance d2 between the shoulder 5226 of the armature 5222 and the flange 5221 of the armature. In this manner, when the second end portion 5214 of the pull rod 5212 is coupled to the armature 5222, the armature 5222 can move axially relative to the pull rod 5212 by a predetermined amount (i.e., the difference between d1 and d2). Moreover, as described above, a first end of the armature spring 5232 is disposed within the groove 5236 of the end stop 5231 and a second end of the armature spring 5232 is disposed within the groove 5227 of the armature 5222. Thus, when the solenoid assembly 5230 is not energized, the armature 5222 is biased in a position such that the flange 5221 is in contact with the snap ring 5220. Accordingly, when the solenoid assembly 5230 is energized, the armature 5222 initially travels relative to the pull rod 5212 in the direction shown by the arrow JJ in FIG. 57. When the shoulder 5226 of the armature 5222 contacts the head 5218 of the pull rod 5212, the armature 5222 and the pull rod 5212 move together until the contact surface 5228 of the armature engages and/or contacts the end surface 5235 of the end stop 5231. By allowing the armature 5222 to move relative to the pull rod 5212 when the solenoid assembly 5230 is energized, the armature 5222 can accelerate and thereby generate an impulse force before engaging the pull rod 5212. This arrangement can provide more repeatable and/or reliable valve opening performance.

The distance through which the armature 5222 can move axially relative to the pull rod 5212 (i.e., the difference between d1 and d2) can be any suitable amount. In some embodiments, for example, the difference between the spacing of the head 5218 and the groove 5219 (d1) and the thickness of the armature 5222 (d2) is between 0.015 inches and 0.050 inches. In other embodiments, the difference between d1 and d2 is approximately 0.030 inches.

As described above, the first end portion 5213 of the pull rod 5212 is coupled to second end portion 5177I of the intake valve 5160I. More particularly, the first end portion 5213 of the pull rod 5212 includes a male threaded portion disposed within the female threaded opening 5178I of the intake valve 5160I. Accordingly, axial movement of the pull rod 5212 results in axial movement of the intake valve 5160I. In some embodiments, a lock nut can be disposed about the first end portion 5213 of the pull rod 5212 to limit rotational movement of the pull rod 5212 relative to the intake valve 5160I (i.e., to prevent the pull rod 5212 from "backing out" of the threaded opening 5178I of the intake valve 5160I).

In use, when the solenoid coil 5242 is energized with an electrical current, a magnetic field is produced that exerts a force upon the armature 5222 in a direction shown by the arrow LL in FIG. 52. The magnetic force causes the armature 5222 to move relative to (and towards) the solenoid coil 5242, as shown by the arrow LL in FIG. 52 and the arrow JJ in FIG. 57. As described above, the armature 5222 initially travels relative to the pull rod 5212. When the shoulder 5226 of the armature 5222 contacts the head 5218 of the pull rod 5212, and the force exerted by the pull rod 5212 on the intake valve 5160I is greater than the biasing force exerted by the spring 5118I, the armature 5222 and the pull rod 5212 move together, thereby causing the intake valve 5160I to move from the closed position (FIG. 51) to the opened position (FIG. 52). The armature 5222 and pull rod 5212 travel together until the contact surface 5228 of the armature 5222 engages and/or contacts the end surface 5235 of the end stop 5231. When the solenoid coil 5242 is energized, the armature 5222 travels through a distance Sd (i.e., the solenoid stroke as shown in FIG. 51). The distance through which the pull rod 5212 (and therefore the intake valve 5160I) travels is the difference between the solenoid stroke and the difference between d1 and d2, as given by equation (6).

$$\text{Travel}=Sd-(d1-d2) \tag{6}$$

Thus, the travel of the intake valve 5160I can be adjusted by changing the solenoid stroke Sd.

When the solenoid coil 5242 is de-energized, the force exerted by the intake valve spring 5118I causes the intake valve 5160I, the pull rod 5212 and armature 5222 to travel in a direction opposite the direction shown by the arrow LL in FIG. 52. Additionally, the force exerted by the armature spring 5232 moves the armature 5222 relative to the pull rod 5212 such that the flange 5221 of the armature 5222 is in contact with the snap ring 5220.

The variable travel actuator 5250 is configured to selectively vary the distance through which the intake valve 5160I travels when moving between the closed and an opened position. More particularly, the variable travel actuator 5250 is configured to selectively adjust the stroke of the solenoid assembly 5230. In this manner, the intake valve 5160I can be moved between the closed position and any number of different partially opened positions. Moreover, because the valve actuator 5210 is electrically operated, the valve 5160 can be moved between the closed position and an opened position independently from the rotational position of a camshaft or a crankshaft of the engine 5100.

As shown in FIG. 50, the variable travel actuator 5250 includes a motor 5262, a drive belt 5260 and a driven ring 5252. As described herein, the variable travel actuator 5250 is configured to selectively rotate the solenoid assembly 5230 within the housing 5270 to adjust the solenoid stroke Sd (see e.g., FIG. 51). The motor 5262 includes a drive shaft 5263 and a drive member 5265. The motor 5262 can be, for example a stepper motor, such as the Model 23Y104S-LWB 2A/phase series stepper motor available from Anaheim Automation, Inc. The motor 5262 is coupled to the housing 5270 via a motor housing 5264. The motor housing 5264 aligns the motor 6262 relative to the housing 5270 such that the drive member 5265 is disposed within the second cavity 5275 of the housing 5270.

The driven ring 5252 includes an outer surface 5254 having a series of protrusions (e.g., teeth or knurling). The driven ring 5252 is coupled to the end stop 5231 of the solenoid assembly 5230 such that rotation of the driven ring 5252 results in rotation of the solenoid assembly 5230. The driven ring 5252 can be coupled to the end stop 5231 in any suitable manner. For example, in some embodiments, the driven ring 5252 can be coupled to the end stop 5231 via cap screws, a welded joint, an adhesive, a snap-ring and/or the like. The drive belt 5260 is disposed about the drive member 5265 and the outer surface 5254 of the driven ring 5252. In this manner, rotational movement of the drive shaft 5263 can be transferred to the solenoid assembly 5230 via the drive belt 5260.

A position ring 5257 is coupled to the driven ring 5252 such that the position ring rotates with the driven ring 5252. The position ring 5257 includes a protrusion 5258 (see e.g., FIG. 58) configured to engage the sensor 5266. In this manner, the rotational position of the solenoid assembly 5230 can be measured electronically. Although the sensor 5266 is shown as sensing the rotational position of the solenoid assembly 5230 via contact with the protrusion 5258, in other embodiments, the sensor 5266 can use any suitable mechanism for sensing the position of the solenoid assembly 5230. For example, in some embodiments, the sensor 5266 can include an optical shaft encoder configured to provide an electronic output associated with the rotational position of the solenoid assembly 5230.

The variable travel actuator 5250 is configured to selectively vary the valve travel by moving the intake valve actuator assembly 5200 between any number of different configurations corresponding to the position of the solenoid assembly 5130 within the housing 5270. For example, FIGS. 51 and 52 show the intake valve actuator assembly 5200 in a first (or full opening) configuration, and FIG. 53 shows the intake valve actuator assembly 5200 in a second (or partial opening) configuration. When the intake valve actuator assembly 5200 is in the full opening configuration, end surface 5235 of the end stop 5231 is spaced apart from a shoulder of the housing 5270 by a distance $d_3$. The shoulder is identified only as a reference point for purposes of showing the position of the solenoid assembly 5230 within the housing 5270. Thus, when the intake valve actuator assembly 5200 is in the full opening configuration, the solenoid stroke Sd is at its maximum value. Accordingly, when the solenoid assembly 5230 is energized, the intake valve 5160I moves from the closed position (FIG. 51) to the fully opened position (FIG. 52). When the intake valve 5160I is in the fully opened position, each flow opening 5168I of the intake valve 5160I is substantially aligned with the corresponding intake manifold flow passages 5144I and cylinder flow passages 5148I.

To move the intake valve actuator assembly 5200 to another configuration (e.g., the partial opening configuration, as shown in FIG. 53), the motor 5262 is energized thereby causing rotational motion of the drive shaft 5263. The rotational movement of the drive shaft 5263 is transmitted to the driven ring 5252 via the belt 5260, thereby causing the solenoid assembly 5230 to rotate within the housing 5270, as shown by the arrow MM in FIG. 53. Because the solenoid assembly 5230 is threadedly coupled to the housing 5270, the rotation of the solenoid assembly 5230 results in axial movement of the solenoid assembly 5230 within the housing 5270, as shown by the arrow NN in FIG. 53.

When the intake valve actuator assembly 5200 is in the partial opening configuration, end surface 5235 of the end stop 5231 is spaced apart from a shoulder of the housing 5270 by a distance $d_4$ that is less than the distance $d_3$. Thus, when the intake valve actuator assembly 5200 is in the partial opening configuration, the solenoid stroke (not shown in FIG. 53) less than the maximum value Sd. Accordingly, when the solenoid assembly 5230 is energized, the intake valve 5160I moves from the closed position (FIG. 51) to the partially opened position (FIG. 53). When the intake valve 5160I is in the partially opened position, each flow opening 5168I of the intake valve 5160I is partially aligned with the corresponding intake manifold flow passages 5144I and cylinder flow passages 5148I. Thus, when the intake valve 5160I is in the partially opened position, the intake air flow rate through the cylinder head assembly 5130 is less than the air flow rate through the cylinder head assembly 5130 when the intake valve 5160I is in the fully opened position.

Figure 58:
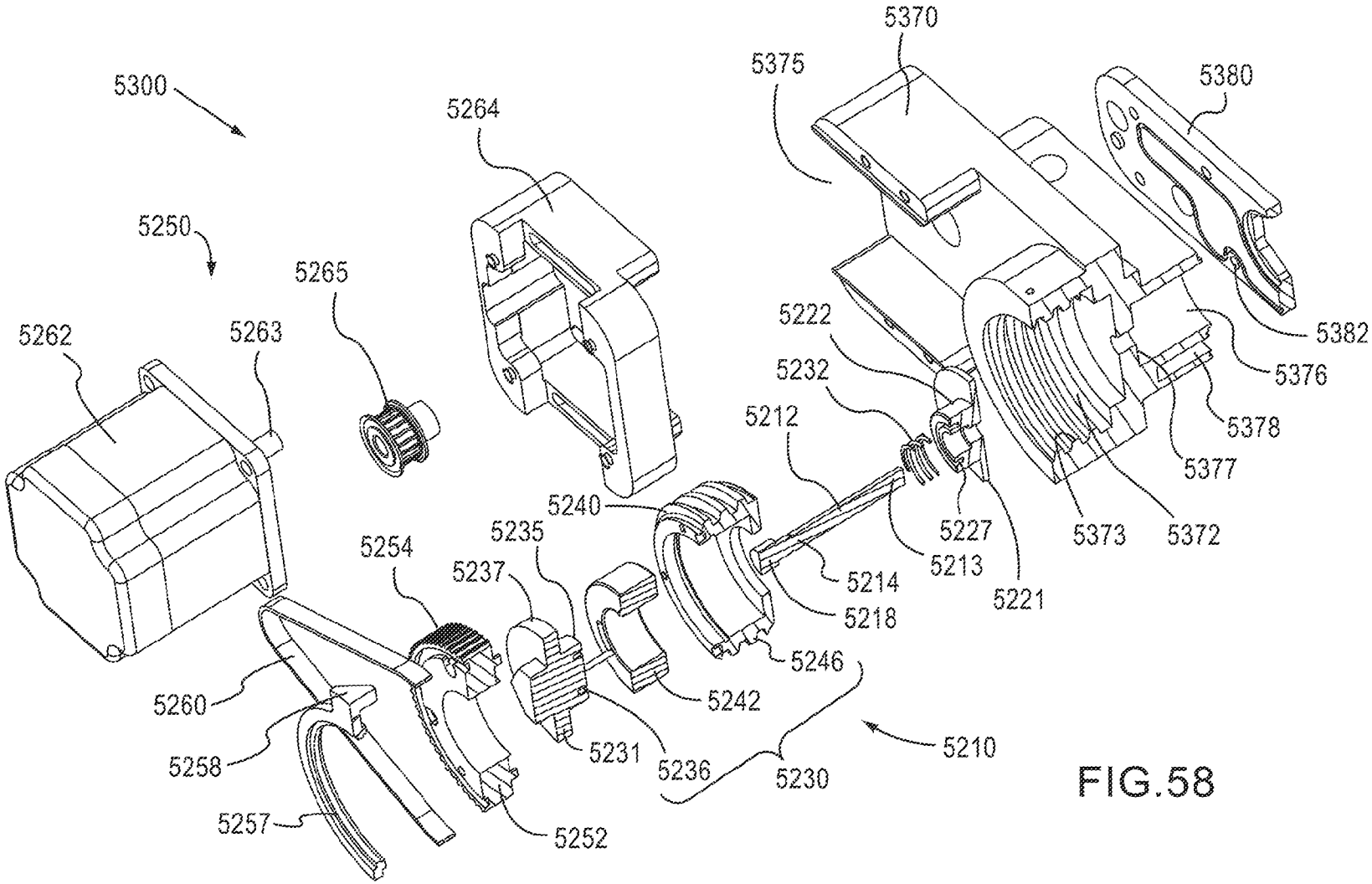
FIG. 58 is a perspective exploded view of the exhaust valve actuator assembly of the engine shown in FIGS. 46 and 47.

In a similar manner as described above with reference to the intake actuator assembly 5200, the exhaust actuator assembly 5300 is configured to move the exhaust valve 5160E between its closed position and its opened position and selectively vary the distance through which the exhaust valve 5160E travels when moving between its closed position and an opened position. Similarly stated, the exhaust actuator assembly 5300 is configured to move the exhaust valve 5160E between its closed position (FIG. 59) and any number of different opened positions (e.g., FIGS. 60 and 61). Referring to FIG. 58, the exhaust actuator assembly 5300 includes a housing 5370 that contains a valve actuator 5210 and a variable travel actuator 5250.

The housing 5370 defines a first cavity 5372, a second cavity 5375 and a third cavity 5376. The first cavity 5372 is defined by a side wall that includes a female threaded portion 5373 that corresponds to the male threads 5246 on the solenoid casing 5240. In this manner, a portion of the valve actuator 5210 is movably disposed within the first cavity 5372. As described above with reference to the intake actuator assembly 5200, a portion the variable lift actuator 5250 is disposed within the second cavity 5375.

As shown in FIGS. 58-61, the third cavity 5376 contains the exhaust valve spring 5118E. The side wall that defines the third cavity 5376 includes a spring shoulder 5377 against which a first end of the exhaust valve spring 5118E is disposed. A second end of the exhaust valve spring 5118E is disposed within a groove 5317 of a lock nut 5316 coupled to the first end 5213 of the pull rod 5212. In this manner, the exhaust valve 5160E is biased in the closed position within the exhaust valve pocket 5138E. By disposing the exhaust valve spring 5118E outside of the exhaust valve pocket 5138E, the exhaust valve spring 5118E is not directly exposed to hot exhaust gases. Additionally, the side wall adjacent the third cavity 5376 defines a coolant passage 5378 within which coolant can flow to further maintain the exhaust valve spring 5118E and associated components below a desired temperature.

As shown in FIGS. 46 and 47, the housing 5370 is coupled to the cylinder head 5132 such that at least a portion of the first cavity 5372 and the third cavity 5376 are aligned with the exhaust valve pocket 5138E. In this manner, as described above, the valve actuator 5210 can engage and/or actuate the exhaust valve 5160E. As shown in FIG. 58, the housing 5370 is coupled to the cylinder head 5132 via a cooling plate 5380. The cooling plate 5380 includes a set of cooling passages 5382 (only one is identified in FIG. 58), at least one of which is in fluid communication with the coolant passage 5378 of the housing 5370. In this manner, the cooling plate 5380 can further promote the transfer of heat away from the exhaust valve spring 5118E, the valve actuator assembly 5210 and/or components of the exhaust valve train. Note that FIGS. 59-61 show the housing 5270 and the cooling plate 5380 as being spaced apart from the cylinder head 5132 for purposes of clarity.

The valve actuator 5210 of the exhaust valve actuator assembly 5300 is the same as the valve actuator 5210 disposed within the intake valve actuator assembly 5200 as shown and described above. Similarly, the variable travel actuator 5250 of the exhaust valve actuator assembly 5300 is the same as the variable travel actuator 5250 disposed within the intake valve actuator assembly 5200 as shown and described above. Accordingly, the components within and the operation of the valve actuator 5210 and the variable travel actuator 5250 are not described below. In other embodiments, the exhaust valve actuator assembly 5300 can include a valve actuator and/or a variable travel actuator different from the valve actuator 5210 and/or the variable travel actuator 5250, respectively. For example, in some embodiments, the solenoid assembly of the exhaust valve actuator can produce a different opening force than the solenoid assembly 5230.

The only substantial difference between the exhaust valve actuator assembly 5300 and the intake valve actuator assembly 5200 is that, as described above, the exhaust valve spring 5118E is disposed within the housing 5370 rather than within the exhaust valve pocket 5138E. More particularly, as shown in FIGS. 59-61, the lock nut 5316 is disposed about the first end portion 5213 of the pull rod 5212. In some embodiments, the lock nut 5216 can limit rotational movement of the pull rod 5212 relative to the exhaust valve 5160E (i.e., to prevent the pull rod 5212 from "backing out" of the threaded opening 5178E of the exhaust valve 5160E). The lock nut 5316 includes a spring grove 5317 within which an end portion of the exhaust valve spring 5118E is disposed. In this manner, as described above, the exhaust valve 5160E is biased in the closed position (see e.g., FIG. 59).

The variable travel actuator 5250 is configured to selectively vary the exhaust valve travel by moving the exhaust valve actuator assembly 5300 between any number of different configurations corresponding to the position of the solenoid assembly 5130 within the housing 5370. For example, FIGS. 59 and 60 show the exhaust valve actuator assembly 5300 in a first (or full opening) configuration, and FIG. 61 shows the exhaust valve actuator assembly 5300 in a second (or partial opening) configuration. When the exhaust valve actuator assembly 5300 is in the full opening configuration, end surface 5235 of the end stop 5231 is spaced apart from a shoulder of the housing 5370 by a distance $d_5$. The shoulder is identified only as a reference point for purposes of showing the position of the solenoid assembly 5230 within the housing 5370. Thus, when the exhaust valve actuator assembly 5300 is in the full opening configuration, the solenoid stroke Sd is at its maximum value. Accordingly, when the solenoid assembly 5230 is energized, the exhaust valve 5160E moves from the closed position (FIG. 59) to the fully opened position (FIG. 60). When the exhaust valve 5160E is in the fully opened position, each flow opening 5168E of the exhaust valve 5160E is substantially aligned with the corresponding exhaust manifold flow passages 5144E and cylinder flow passages 5148E.

When the exhaust valve actuator assembly 5300 is in the partial opening configuration, end surface 5235 of the end stop 5231 is spaced apart from a shoulder of the housing 5370 by a distance $d_6$ that is less than the distance $d_5$. Thus, when the exhaust valve actuator assembly 5300 is in the partial opening configuration, the solenoid stroke (not shown in FIG. 61) less than the maximum value Sd. Accordingly, when the solenoid assembly 5230 is energized, the exhaust valve 5160E moves from the closed position (FIG. 59) to the partially opened position (FIG. 61). When the exhaust valve 5160E is in the partially opened position, each flow opening 5168E of the exhaust valve 5160E is partially aligned with the corresponding exhaust manifold flow passages 5144E and cylinder flow passages 5148E. Thus, when the exhaust valve 5160E is in the partially opened position, the exhaust gas flow rate through the cylinder head assembly 5130 is less than the exhaust gas flow rate through the cylinder head assembly 5130 when the exhaust valve 5160E is in the fully opened position.

Although the intake valve actuator assembly 5200 and the exhaust valve actuator assembly 5300 are shown as having only one partial opening configuration (e.g., FIGS. 53 and 61, respectively), the intake valve actuator assembly 5200 and the exhaust valve actuator assembly 5300 can be moved between the full opening configuration and any number of partial opening configurations. For example in some embodiments, the intake valve actuator assembly 5200 and/or the exhaust valve actuator assembly 5300 can adjust the distance between the closed position and the opened position of the intake valve 5160I and/or the exhaust valve 5160E, respectively, to any value between approximately zero inches and 0.090 inches. By selectively varying the distance between the opened position and the closed position (e.g., the valve travel), the intake valve actuator assembly 5200 and/or the exhaust valve actuator assembly 5300 can accurately and/or precisely control the amount and/or flow rate of gas flow into and/or out of the cylinder 5103. More particularly, the intake valve and/or exhaust valve travel can be varied in conjunction with the timing and duration of the respective valve opening event to provide the desired gas flow characteristics as a function of the engine operating conditions (e.g., low idle, road cruising conditions or the like). Moreover, because the intake valve 5160I and the exhaust valve 5160E are not disposed within the cylinder 5103 when the intake valve 5160I and the exhaust valve 5160E are in their respective partially opened and/or fully opened positions, the timing of the valve opening can be adjusted without concern for the possibility of valve-to-piston contact. In some embodiments, the control afforded by this arrangement allows the engine gas exchange process to be controlled using only the intake valve 5160I and the exhaust valve 5160E, thereby removing the need for a throttle valve upstream of the cylinder head 5132.

This arrangement allows the valve events and/or engine throttling to be tailored for a particular engine operating condition, as well as for a particular engine performance rating or "package." For example, in certain situations, a particular base engine design (e.g., a 2.2 liter, V6) is used in many different markets (e.g., Europe, California, other U.S. states, high altitude markets and the like), each having different performance and/or emissions requirements. To accommodate the different markets, manufacturers may change the rating or performance "package" of the base engine by changing certain hardware (e.g., the camshafts, the pistons, the fuel injection system or the like). In some embodiments, the valve systems and methods of control described herein can be used to provide multiple different engine ratings or performance "packages" without requiring that engine hardware be changed.

Figures 65, 66:
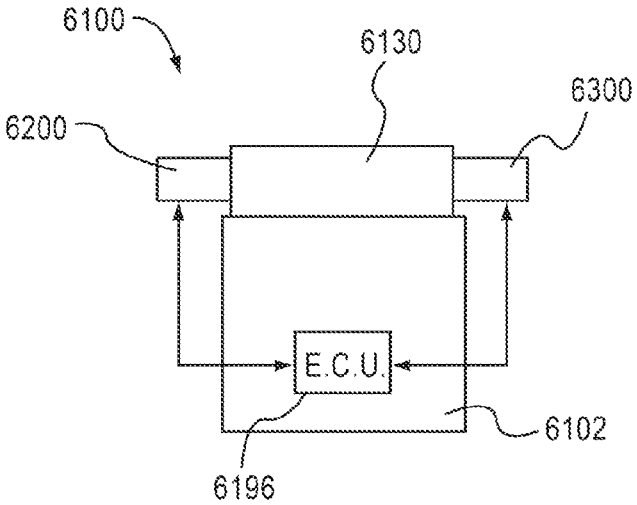

For example, FIG. 65 is a schematic illustration of an engine 6100 according to an embodiment. The engine 6100 includes an engine block 6102 defining at least one cylinder (not identified in FIG. 65). A cylinder head assembly 6130 is coupled to the engine block 6102. The cylinder head assembly 6130 can be any of the cylinder head assemblies shown and described above, and can include, for example, a tapered valve such as the valves 5160I and 5160E shown and described above. The engine 6100 includes an intake valve actuator assembly 6200 and an exhaust valve actuator assembly 6300. The intake valve actuator assembly 6200 is configured to open the intake valve of the engine 6100 at a predetermined time, for a predetermined duration and/or at a predetermined amount of valve travel, as described above. The exhaust valve actuator assembly 6300 is configured to open the exhaust valve of the engine 6100 at a predetermined time, for a predetermined duration and/or at a predetermined amount of valve travel, as described above.

The engine 6100 includes an electronic control unit (ECU) 6196 in communication with the intake valve actuator assembly 6200 and the exhaust valve actuator assembly 6300. The ECU 6196 is processor of the type known in the art configured to receive input from various sensors (e.g., an engine speed sensor, an exhaust oxygen sensor, an intake manifold temperature sensor or the like), determine the desired engine operating conditions and convey signals to various actuators to control the engine accordingly. As described below, the ECU 6196 is configured determine the desired valve events (e.g., the opening time, duration of opening and/or valve travel) and provide an electronic signal to the intake valve actuator assembly 6200 and the exhaust valve actuator assembly 6300 so that the intake and exhaust valves open and close as desired.

The ECU 6196 includes a memory component within which a series of calibration tables are stored. The calibration tables can also be referred to as calibration maps and/or data arrays. The calibration tables can include, for example, a table specifying a target fueling level for the engine 6100 as a function of throttle position, a table specifying a target fuel injector timing and duration as a function of engine operating conditions (e.g., speed and fueling level), a table specifying a target ignition timing as a function of engine operating conditions, and/or the like. The memory of the ECU 6196 also includes calibration tables associated with the intake valve and/or the exhaust valve. FIGS. 66-68 are tabular representations of calibration tables for the intake valve. Although the calibration tables shown in FIGS. 66-68 are for the intake valve, the memory of the ECU 6196 can include similar tables for the exhaust valve.

FIG. 66 is a valve travel calibration table 6410. The valve travel calibration table 6410 is a "three dimensional table" that includes a first axis 6412 specifying the target engine speed (e.g., in revolutions per minute). The valve travel calibration table 6410 includes a second axis 6414 specifying the target engine fueling level per operating cycle (e.g., in cubic millimeters of fuel per engine cycle). Although the first axis 6412 and the second axis 6414 specify the target speed and fueling level, respectively, in other embodiments, the axes of the valve travel calibration table 6410 can specify any suitable target engine operating parameter (e.g., target power output, ambient temperature, exhaust oxygen level or the like). The body 6416 of the valve travel calibration table 6410 includes the target valve travel setting (in units of percentage of the maximum travel) for each engine speed (from the first axis 6412) and each target fueling level (from the second axis 6414). In other embodiments, the body 6416 of the calibration table 6410 can specify the target valve travel in units of length of travel (e.g., inches), steady state airflow at a given valve travel, or the like. The data values provided in the valve travel calibration table 6410 are provided for example only and are not intended to limit the data that can be included in the valve travel calibration table 6410.

FIG. 67 is a valve opening calibration table 6420. The valve opening calibration table 6420 is a "three dimensional table" that includes a first axis 6422 specifying the target engine speed (e.g., in revolutions per minute). The valve opening calibration table 6420 includes a second axis 6424 specifying the target engine fueling level per operating cycle (e.g., in cubic millimeters of fuel per engine cycle). Although the first axis 6422 and the second axis 6424 specify the target speed and fueling level, respectively, in other embodiments, the axes of the valve opening calibration table 6420 can specify any suitable target engine operating parameter (e.g., target power output, ambient temperature, exhaust oxygen level or the like). The body 6426 of the valve opening calibration table 6420 includes the target valve opening timing (in units of the angular position of the crankshaft in degrees) for each engine speed (from the first axis 6422) and each target fueling level (from the second axis 6424). In other embodiments, the body 6426 of the valve opening calibration table 6420 can specify the target opening timing in units of time (e.g., milliseconds), relative crankshaft position (e.g., after the fuel injector shuts off), or the like. The data values provided in the valve opening calibration table 6420 are provided for example only and are not intended to limit the data that can be included in the valve opening calibration table 6420.

FIG. 68 is a valve duration calibration table 6430. The valve opening calibration table 6420 is a "three dimensional table" that includes a first axis 6432 specifying the target engine speed (e.g., in revolutions per minute). The valve duration calibration table 6430 includes a second axis 6434 specifying the target engine fueling level per operating cycle (e.g., in cubic millimeters of fuel per engine cycle). Although the first axis 6432 and the second axis 6434 specify the target speed and fueling level, respectively, in other embodiments, the axes of the valve duration calibration table 6430 can specify any suitable target engine operating parameter (e.g., target power output, ambient temperature, exhaust oxygen level or the like). The body 6436 of the valve duration calibration table 6430 includes the target valve closing timing (in units of the angular position of the crankshaft in degrees) for each engine speed (from the first axis 6432) and each target fueling level (from the second axis 6434). In other embodiments, the body 6436 of the valve duration calibration table 6430 can specify the target valve open duration in units the crank angle period during which the valve is opened, in units of time (e.g., milliseconds), or the like. The data values provided in the valve duration calibration table 6430 are provided for example only and are not intended to limit the data that can be included in the valve duration calibration table 6430.

During operation of the engine 6100, the ECU 6196 can control the valve events (e.g., the opening time, duration of opening and/or valve travel of the intake and/or exhaust valve) using the calibration tables 6410, 6420 and/or 6430. More particularly, when the engine is operating at a particular set of operating conditions (e.g., engine speed and fueling level), the ECU 6196 can determine the target valve travel by interpolating (or "looking up") the target valve travel in the valve travel calibration table 6410 based on the target engine speed and the target fueling level. The target engine speed can be, for example, the engine speed as measured by an engine speed sensor. Under certain conditions (e.g., transient conditions), the target engine speed can be a calculated target based on the current measured engine speed and the temporal history of the measured engine speed (e.g., the rate of change of the engine speed). Similarly, the target fueling level can be, for example, the fueling level as measured determined from another calibration table. Under certain conditions (e.g., transient conditions), the target fueling level can be a calculated target based on the current value for the fueling level and the temporal history of the fueling level (e.g., the rate of change of the fueling level).

Similarly, the ECU 6196 can determine the target valve opening timing by interpolating (or "looking up") the target valve opening timing in the valve opening calibration table 6420 based on the target engine speed and the target fueling level. Similarly, the ECU 6196 can determine the target valve open duration by interpolating (or "looking up") the target valve duration in the valve duration calibration table 6430 based on the target engine speed and the target fueling level.

In this manner, the ECU 6296, the intake valve actuator assembly 6200 and/or the exhaust valve actuator assembly 6300 can collectively control the amount and/or flow rate of gas into and/or out of the cylinder during engine operation. More particularly, the intake valve and/or exhaust valve timing, duration and/or travel can be varied to provide the desired gas flow characteristics as a function of the engine operating conditions (e.g., low idle, road cruising conditions or the like). In some embodiments, the control afforded by this arrangement allows the engine gas exchange process to be controlled using only the intake valve and/or the exhaust valve, thereby removing the need for a throttle valve upstream of the cylinder head. In such embodiments, the "throttle position" as referenced above, does not refer to the position of a throttle valve, but rather refers to a position of an accelerator pedal, which corresponds to a desired fueling level of the engine.

In some embodiments, the ECU 6196 can include one or more "cold start" calibration tables that include target valve travel, timing and/or duration values for use during engine start up. In some embodiments, for example, the ECU 6196 can be configured to open the exhaust valve early (e.g., at a crank angle position of less than 140 crank angle degrees after top dead center on the firing stroke) during a start up event. In this manner, the temperature of the exhaust gas exiting the cylinder can be increased, thereby heating up the catalytic converter faster than could be done with standard exhaust valve events.

In some embodiments, the ECU 6196 can include one or more altitude calibration tables that include target valve travel, timing and/or duration values for use when the engine is operating at high altitudes. For example, in some embodiments, an altitude calibration table can include a first axis that specifies atmospheric pressure.

In some embodiments, the ECU 6196 can include an idle stability algorithm that adjusts the target valve travel, timing and/or duration values for the valves of a cylinder of a multi-cylinder engine independently from the target valve travel, timing and/or duration values for the valves of an adjacent cylinder of the engine. In this manner, an intake valve of a first cylinder can have a different lift, opening timing and/or duration than an intake valve of a second cylinder. Such an arrangement can allow the engine to maintain idle stability at very low speeds. For example, in some embodiments, such an idle stability algorithm can allow the engine to maintain idle stability at engine speeds below 500 revolutions per minute.

Although the engine 6100 is illustrated and described as including an ECU 6196, in some embodiments, an engine 6100 can include software in the form of processor-readable code instructing a processor to perform the functions described herein. In other embodiments, an engine 6100 can include firmware that performs the functions described herein.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above. While the embodiments have been particularly shown and described, it will be understood that various changes in form and details may be made.

For example, although the valves 5160I and 5160E are shown and described above as having a tapered portion, in other embodiments, the valves 5160I and/or 5160E can be substantially non-tapered. Although the valves 5160I and 5160E are shown and described above as being disposed outside of the cylinder 5103 when moved between their respective closed and opened positions, in other embodiments, a portion of the intake valve 5160I and/or a portion of the exhaust valve 5160E can be disposed within the cylinder 5103 when in the opened (or partially opened) position.

Although the engine 5100 is shown and described as including a single cylinder, in some embodiments, an engine can include any number of cylinders in any arrangement. For example, in some embodiments, an engine can include any number of cylinders in an in-line arrangement. In other embodiments, any number of cylinders can be arranged in a vee configuration, an opposed configuration or a radial configuration.

Although movement of the drive shaft 5263 is shown as being transferred to the solenoid assembly 5230 via the drive belt 5260, in other embodiments, the rotational movement of the drive shaft 5263 can be transferred to the solenoid assembly 5230 via any suitable mechanism, such as, for example, hydraulically, via a gear drive, or the like.

Although various embodiments have been described as having particular features and/or combinations of components, other embodiments are possible having a combination of any features and/or components from any of embodiments as discussed above. For example, in some embodiments, a variable travel actuator can selectively vary the valve travel by varying both the valve lash, similar to the variable travel actuator 3250, and the solenoid stroke, similar to the variable travel actuator 4250.

What is claimed is:

1. A method, comprising:

moving a valve member, in a direction parallel to a longitudinal axis of the valve member, into a valve pocket defined by a cylinder head, via a side opening defined by the cylinder head, the valve member having a portion defining a plurality of valve flow passages, the valve member configured to be reciprocated within the valve pocket by an actuator, the portion having a first radius of curvature about the longitudinal axis of the valve member, the portion having a second radius of curvature about the longitudinal axis greater than the first radius of curvature; and disposing a first portion of a biasing member into the valve pocket such that the first portion contacts an end portion of the valve member.

2. The method of claim 1, further comprising:

coupling an end plate to the cylinder head such that the end plate substantially covers the side opening and a second portion of the biasing member engages the end plate; and coupling the cylinder head to an engine block.

3. The method of claim 1, wherein portion is a tapered portion, the tapered portion is configured such that each of a width and a thickness of the tapered portion decreases linearly along the longitudinal axis of the valve member.

4. The method of claim 3, wherein the valve pocket surrounds substantially the tapered portion of the valve member.

5. The method of claim 1, wherein a surface of the cylinder head defines a portion of a combustion chamber.

* * * * *